US011718965B2

(12) United States Patent
Saadatmanesh et al.

(10) Patent No.: US 11,718,965 B2
(45) Date of Patent: Aug. 8, 2023

(54) APPARATUS AND METHOD FOR REINFORCING A PARTIALLY SUBMERGED STRUCTURAL ELEMENT

(71) Applicant: CARBOSHIELD, INC., Tucson, AZ (US)

(72) Inventors: Hamid Saadatmanesh, Tucson, AZ (US); Ehsan Mahmoudabadi, Tucson, AZ (US); Farokh Mehrshahi, Tucson, AZ (US)

(73) Assignee: CARBOSHIELD, INC., Tucson, AZ (US)

( * ) Notice: Subject to any disclaimer, the term of this patent is extended or adjusted under 35 U.S.C. 154(b) by 91 days.

(21) Appl. No.: 17/099,375

(22) Filed: Nov. 16, 2020

(65) Prior Publication Data

US 2021/0115634 A1 Apr. 22, 2021

Related U.S. Application Data

(63) Continuation-in-part of application No. 16/884,585, filed on May 27, 2020, now Pat. No. 11,118,364, (Continued)

(51) Int. Cl.
*E01D 21/00* (2006.01)
*E01D 22/00* (2006.01)

(52) U.S. Cl.
CPC ..... *E01D 22/00* (2013.01)

(58) Field of Classification Search
CPC ..... E04C 5/07; E04C 3/34; E04C 5/06; E01D 22/00; E01D 19/02; E01D 2101/24; E01D 2101/26; E04G 23/0225; E04G 2023/0251
(Continued)

(56) References Cited

U.S. PATENT DOCUMENTS 1,947,413 A 2/1934 Hay
2,897,553 A 8/1959 Gorrow
(Continued)

FOREIGN PATENT DOCUMENTS

EP 0572243 A1 12/1993
WO 9523898 A1 9/1995
(Continued)

OTHER PUBLICATIONS

Hoff, G.W. "Strong Medicine. Fiber-reinforced polymer materials can help cure many ills that beset concrete" Concrete Construction (2000):40-47.

*Primary Examiner* — Chi Q Nguyen
(74) *Attorney, Agent, or Firm* — Nguyen Tarbet LLC

(57) ABSTRACT

An apparatus and method for reinforcement of partially submerged structural elements such as piles, posts, pillars, and pipes are disclosed. The apparatus includes an upper unit which may be fixed to the structural element above the waterline and a lower unit which is suspended from the upper unit via cables or other support members. The apparatus enables a reinforcing sleeve structure to be constructed in multiple segmented layers from above the waterline which the sleeve structure is lowered beneath the waterline. The lower unit guides the lower end of the sleeve structure down around the submerged portion of the structural element and supports the weight of the sleeve structure until it is fixed in place and filled with concrete or another reinforcing core filler material.

5 Claims, 40 Drawing Sheets

Related U.S. Application Data which is a continuation-in-part of application No. 16/321,163, filed as application No. PCT/US2017/044378 on Jul. 28, 2017, now Pat. No. 10,689,868.

(60) Provisional application No. 62/936,151, filed on Nov. 15, 2019, provisional application No. 62/367,762, filed on Jul. 28, 2016.

(58) Field of Classification Search
USPC ..... 405/211, 211.1, 212, 216; 134/172, 180, 134/199, 152; 15/104.04; 52/834; 118/72, 306, 317, 323, DIG. 10
See application file for complete search history.

(56) References Cited

U.S. PATENT DOCUMENTS 3,963,546 A 6/1976 Roberti
4,019,301 A 4/1977 Fox
4,116,013 A 9/1978 Hellmers
4,244,156 A 1/1981 Watts, Jr.
4,439,071 A 3/1984 Roper, Jr.
4,694,622 A 9/1987 Richard
4,993,876 A * 2/1991 Snow ..... E02B 17/0034 52/834
5,398,461 A * 3/1995 Rose ..... B24C 3/32 451/92
5,458,683 A * 10/1995 Taylor ..... B08B 9/023 134/122 R
5,505,030 A 4/1996 Michalcewiz et al.
5,513,477 A 5/1996 Farber
5,640,825 A 6/1997 Ehsani et al.
5,694,734 A 12/1997 Cercone et al.
5,753,340 A 5/1998 Welch et al.
5,996,521 A 12/1999 Kitano et al.
6,224,294 B1 * 5/2001 Mansfield ..... B63C 3/06 173/127
6,379,085 B1 4/2002 Vanderklaauw
6,382,878 B1 * 5/2002 Yang ..... E02D 5/48 405/250
6,519,909 B1 2/2003 Fawley
7,780,375 B1 * 8/2010 Khachaturian ..... E02B 17/0809 405/196
8,341,860 B2 1/2013 Boyce et al.
8,353,643 B2 * 1/2013 Khachaturian ..... E02B 17/0809 405/196
8,465,228 B2 * 6/2013 Doleshal ..... B08B 3/024 15/104.04
8,628,275 B1 * 1/2014 Trader ..... E02D 5/64 405/211
8,650,831 B2 2/2014 Ehsani
9,038,353 B2 * 5/2015 Huncovsky ..... E04G 23/0218 403/312
9,890,546 B2 2/2018 Ehsani
10,119,238 B2 11/2018 Doudican et al.
10,619,321 B2 * 4/2020 Hess ..... B05B 13/0436
10,689,868 B2 * 6/2020 Saadatmanesh ..... E04C 3/34
11,118,364 B2 * 9/2021 Saadatmanesh ..... E04C 5/07
2004/0048022 A1 3/2004 Pratt
2004/0074199 A1 4/2004 Gordin et al.
2004/0202511 A1 10/2004 Bae
2004/0211148 A1 10/2004 Foust et al.
2008/0017263 A1 1/2008 Robinson et al.
2009/0165404 A1 7/2009 Choi
2015/0159387 A1 6/2015 Chou et al.
2015/0190972 A1 7/2015 Ehsani
2016/0060892 A1 3/2016 Odegard et al.
2016/0076249 A1 3/2016 Gibson et al.
2016/0145882 A1 5/2016 Ehsani
2019/0264409 A1 8/2019 Hess et al.

FOREIGN PATENT DOCUMENTS

WO 2006032033 A2 3/2006
WO 2016007503 A1 1/2016

* cited by examiner

APPARATUS AND METHOD FOR REINFORCING A PARTIALLY SUBMERGED STRUCTURAL ELEMENT

CROSS-REFERENCES TO RELATED APPLICATIONS

This application is a Continuation-in-Part of U.S. application Ser. No. 16/884,585, filed on May 27, 2020, now U.S. Pat. No. 11,118,364, which is a Continuation-in-Part of U.S. application Ser. No. 16/321,163, filed on Jan. 28, 2019, now U.S. Pat. No. 10,689,868, which is the National Stage of International Application No. PCT/US2017/044378, filed on Jul. 28, 2017, which claims priority to U.S. Provisional Application No. 62/367,762, filed on Jul. 28, 2016, the contents of which are incorporated by reference.

This application also claims priority to U.S. Provisional Application No. 62/936,151, filed on Nov. 15, 2019, the contents of which are incorporated by reference.

BACKGROUND OF THE INVENTION

Field of the Invention

The present invention generally relates to the reinforcement of structural elements. More specifically, the present invention relates to apparatuses and methods for the reinforcement of partially submerged structural elements.

Background Art

Fiber-reinforced polymers have become frequently used in structural engineering applications due to their inherent cost-effectiveness in a number of field applications, including those involving structural materials including concrete, masonry, steel, cast iron, and wood. Fiber-reinforced polymers can be used in industry for retrofitting to strengthen an existing structure and/or as an alternative reinforcing (or pre-stressing) material instead of conventional materials from the outset of a project. Recently, retrofitting has become a dominant industrial use of fiber-reinforced polymers, with applications including increasing the load capacity of old structures, such as bridges, which were designed with much lower service load tolerances than are typically required today. Other uses include seismic retrofitting and repairing damaged structures.

Applied to reinforced concrete structures for flexure, fiber-reinforced polymers typically have a large effect on strength, but only provide a moderate increase in stiffness of the reinforced concrete structures. This is thought to be due to the high strength, but low stiffness, of relatively thin fiber-reinforced polymer cross-sections. Consequently, however, only small cross-sectional areas of the fiber-reinforced polymers are typically used. Likewise, small areas of fiber-reinforced polymer having very high strength, but moderate stiffness applied to a section of a reinforced concrete structure will significantly increase the strength, but to a lesser degree, the stiffness of the reinforced concrete structure.

Structural elements in marine environments are especially susceptible to deterioration and damage. For example, concrete piles may crack or incur crevices due to freezing and thawing. Wood piles may crack or incur tunnels due to marine animal infestation. Metal piles, pipes and beams may rust or corrode due to galvanic or electrolytic chemical reactions. The structural element may also be damaged by boat collisions, debris impact and particle abrasion. Consequently, the structural element may create a safety hazard.

For instance, a bridge may be susceptible to fracture or collapse, and a pipeline may be susceptible to fracture or explosion. Conventional solutions such as tubular casings and localized grout patches installed by workers on marine vessels and underwater sleeves, shells, wraps and grout patches installed by scuba divers tend to be slow, cumbersome and expensive. Therefore, a need exists for structural element reinforcement in a marine environment that is rapid, efficient and cost-effective.

BRIEF SUMMARY OF THE INVENTION

It is an objective of the present invention to provide systems, devices and methods that allow for reinforcement of partially submerged structural elements, as specified in the independent claims. Embodiments of the invention are given in the dependent claims. Embodiments of the present invention can be freely combined with each other if they are not mutually exclusive.

The present invention features apparatuses and methods which allow for reinforcing sleeve structures to be assembled around the non-submerged portions of partially submerged structural elements, and lowered beneath the waterline as segments of the sleeve structures are completed. An upper unit of such an apparatus may be secured in place above the waterline, for example, by fixation to the non-submerged portion of the partially submerged structural element. A lower unit may be suspended from the upper unit via flexible support members such as cables, so as to support and incrementally lower the sleeve structure as it is assembled above the waterline.

One of the unique and inventive technical features of the present invention is that the lower unit of the lowering apparatus includes releasable attachments for fixing multiple perimeter components together. Without wishing to limit the invention to any theory or mechanism, it is believed that the technical feature of the present invention advantageously provides for fixation of the lower unit around the partially submerged structural element in such a way that it may be released from above the waterline. None of the presently known prior references or work has the unique inventive technical feature of the present invention.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE SEVERAL VIEWS OF THE DRAWINGS

The features and advantages of the present invention will become apparent from a consideration of the following detailed description presented in connection with the accompanying drawings in which.

DETAILED DESCRIPTION OF THE INVENTION

Figure 1:
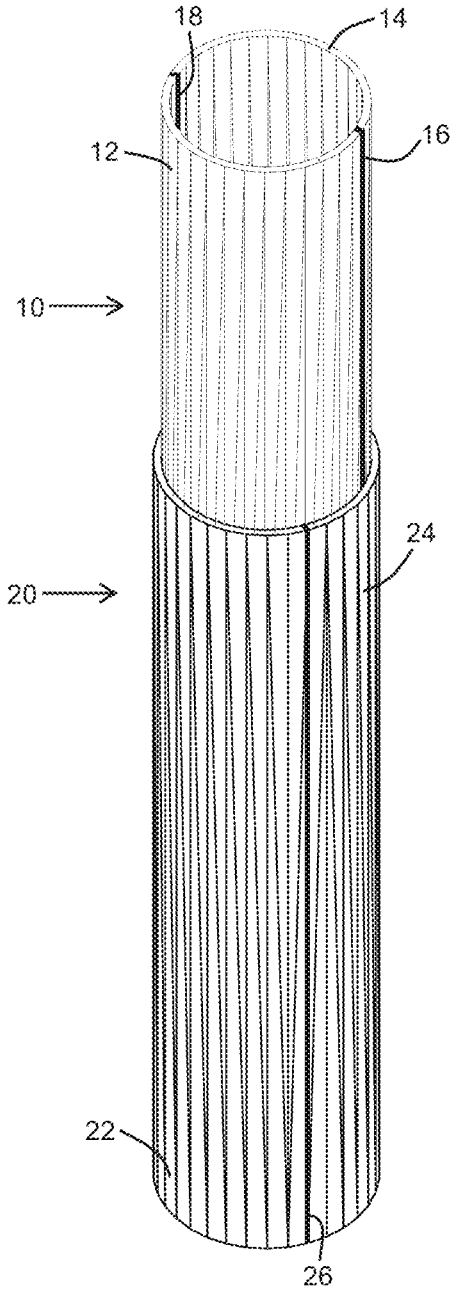
FIG. 1 shows a first pair of rigid, semi-rigid, or flexible fiber-reinforced shells and a second pair of rigid, semi-rigid, or flexible fiber-reinforced shells disposed about the first pair of rigid, semi-rigid, or flexible fiber-reinforced shells.

Following is a list of elements corresponding to a particular element referred to herein:

1 Reinforced structural element
2 Structural element
10 First pair of rigid, semi-rigid, or flexible fiber-reinforced shells
12 First rigid, semi-rigid, or flexible fiber-reinforced shell
14 Second rigid, semi-rigid, or flexible fiber-reinforced shell
16 First seam
18 Second seam
20 Second pair of rigid, semi-rigid, or flexible fiber-reinforced shells
22 Third rigid, semi-rigid, or flexible fiber-reinforced shell
24 Fourth rigid, semi-rigid, or flexible fiber-reinforced shell
26 Third seam
210 Third pair of rigid, semi-rigid, or flexible fiber-reinforced shells
212 Fifth rigid, semi-rigid, or flexible fiber-reinforced shell
214 Sixth rigid, semi-rigid, or flexible fiber-reinforced shell
216 Fifth seam
218 Sixth seam
220 Fourth pair of rigid, semi-rigid, or flexible fiber-reinforced shells
222 Seventh rigid, semi-rigid, or flexible fiber-reinforced shell
224 Eighth rigid, semi-rigid, or flexible fiber-reinforced shell
228 Eighth seam
310 Fifth pair of rigid, semi-rigid, or flexible fiber-reinforced shells
312 Ninth rigid, semi-rigid, or flexible fiber-reinforced shell
314 Tenth rigid, semi-rigid, or flexible fiber-reinforced shell
316 Ninth seam
318 Tenth seam

320 Sixth pair of rigid, semi-rigid, or flexible fiber-reinforced shells
322 Eleventh rigid, semi-rigid, or flexible fiber-reinforced shell
324 Twelfth rigid, semi-rigid, or flexible fiber-reinforced shell
328 Twelfth seam
400 Reinforced structural element
402 Structural element
404 Axis
405 Length
406 Chamber
408 Surface
410 Sleeve structure
412 First segmented layer
414 Second segmented layer
416 Segment
417 Diameter
418 Horizontal seams
420 Reinforcing shells
422 Interior surface
424 Vertical seams
426 Core filler material
428 Shell adhesive
430 Wrapped layer
440 Axial reinforcing members
450 Shear key
452 Shear key protrusion
454 Spacer
710 Bridge
712 Body of water
714 Marine pile
716 Water line
720*a-b* Marine vessels
722*a-b* Workers
730*a-b* Fiber-reinforced sheds
732*a-b* First inner pair of fiber-reinforced shells
734*a-b* Second inner pair of fiber-reinforced shells
736*a-b* Third inner pair of fiber-reinforced shells
738 Inner reinforcement layer
742*a-b* First outer pair of fiber-reinforced shells
744*a-b* Second outer pair of fiber-reinforced shells
748 Outer reinforcement layer
750 Hoist
752 Base
754*a-b* Cables
756 Mud line
760*a-b* Storage tanks
762*a-b* Pumps
764 Grout mixture
766 Grout
800 Lowering apparatus
810 Upper unit
812 Upper perimeter component
814 Anchor
816 Support bracket
818 Hoist system
819 Winch
820 Pulley
822 Flexible support member
830 Lower unit
832 Lower perimeter component
834 Releasable attachment
835 Attachment pin
836 Attachment barrel
837 Flexible release member
838 Gap guide
840 Roller
842 Lower attachment point
844 Sleeve structure support
846 Plug
850 Support clamp
852 Clamp segment
854 Hinge
855 Cotter pin
856 Fastening tab
857 Fastening tab gap
858 Support ledge As used herein, the terms "vertical" and "horizontal" refer to orientation relative to the axis of the structural element, where a vertical orientation is parallel with the axis and a horizontal orientation is perpendicular to the axis. The axis of the structural element may be in any orientation. For example, the structural element may be a vertical, a horizontal, or a diagonal structural element. The structural element may be a bridge pile, a post, a support pipe, a gas or water pipe, an electrical conduit, a column or any other structural element.

The present invention features apparatuses for lowering sleeve structures around partially submerged structural elements. As a non-limiting example, the present invention may feature an apparatus (800) for assembling and lowering a sleeve structure (410) around a partially submerged structural element (402), the apparatus (800) comprising a stationary upper unit (810) and a mobile lower unit (830) suspended from the upper unit (810) via flexible support members (822). In preferred embodiments, the lower unit (830) may support the sleeve structure (410) as it is assembled and lowered from the upper unit (810) by the flexible support members (822).

The upper unit (810) may be designed for fixation directly to the structural element (402) or for fixation to another surface in the vicinity of the structural element (402) such as a beam supported by the structural element (402). The upper unit (810) may include two or more upper perimeter components (812), which are designed to attach together so as to surround the structural element (402). The upper unit may additionally include two or more anchors (814), each extending inwardly from the upper perimeter components (812) so as to fix the upper unit (810) to the structural element (402). As a non-limiting example, the anchors (814) may be radially spaced screw-tightened swivel leveling mounts. The upper unit (810) may have 2, 3, 4, 5, 6, 7, 8, 9, 10, 11, 12, 13, 14, 15, 16 or more anchors (814), arranged in a single plane or in multiple planes.

The upper unit (810) may include two or more (e.g. 2, 3, 4, 5, 6, 7, 8, or more) support brackets (816), each extending outwardly from the upper perimeter components (812) so as to support two or more flexible support members (822). The support brackets (816) may serve to support the weight of the sleeve structure (410), via the flexible support members (822), and to direct the flexible support members (822) away from the structural element (402) so that they do not get in the way of assembly of the sleeve structure (410). Each support bracket (816) may be a short bracket or an extended arm. In some embodiments, each support bracket (816) may be made up of multiple segments, fixed together (e.g. bolted together). These segmented support brackets (816) may allow for adjustability of arm length and also allow for single-handed installation of the relatively lightweight components of the upper unit (810). As a non-limiting example, the support bracket (816) may extend about 2, 4, 6, 8, 10, 12, 14, 16, 18, 20, 24, 26, 28, 30, 32, 34, 36, 38, 40 or more than 40 inches from the upper perimeter component (812) to which it is affixed. Each support bracket (816) may be constructed so as to be able to support significant weight, for a non-limiting example, about 50, 100, 150, 200, 250, 300, 400, 500, 600, 700, 800, 900, 1000, 1500, 2000 or more than 2000 pounds. Each of the flexible support members (822) may preferably extend downwardly from one of the support brackets (816). As a non-limiting example, the flexible support members (822) may be ropes, cables, or chains, and may be strong enough to support about 50, 100, 150, 200, 250, 300, 400, 500, 600, 700, 800, 900, 1000, 1500, 2000 or more than 2000 pounds. As another non-limiting example, the flexible support member (822) may be an 85' long, 3/16' diameter cable with a hook on each end, capable of lifting 1000 lbs. As other non-limiting examples, the flexible support member (822) may be a 330' long, 3/32" diameter cable or a 780', 1/16' diameter cable.

In some embodiments, the lowering apparatus (800) may also include a support clamp (850) to help support the upper unit (810) and prevent it from slipping down the structural element (402). The support clamp (850) may be fastened around the structural element (402) prior to fastening the upper unit (810) around the structural element (402), and may provide a support ledge (858) for the upper unit (810) to rest upon. More specifically, the anchors (814) of the upper unit (810) may rest on the support ledge (858), both prior to being tightened against the structural element (402) and in the event that the upper unit (810) is pulled downwards against the support ledge (858). The support clamp (850) may be any sort of structural clamp that protrudes from the surface of the structural element (402). As a non-limiting example, the support clamp (850) may include two or more semicircular clamp segments (852) which are bolted together via bolts passing through one or more pairs of fastening tabs (856).

In one embodiment, the support clamp (850) may include two semicircular clamp segments (852) attached by a hinge (854) with a cotter pin (855), and by bolts passing through a pair of fastening tabs (856) opposite the hinge (854). In preferred embodiments, a diameter of the support clamp (850) may be selected so as to correspond with a diameter of the structural element (402). If the two diameters are nearly identical, a fastening tab gab (857) between the fastening tabs (856) may allow for the support clamp (850) to be tightened to a diameter slightly smaller than its original diameter, so as to snugly fit around the structural element (402). As a non-limiting example, a support clamp (850) with an 8" inside diameter may have a ½" fastening tab gap (850) to allow it to tighten down on a wooden structural element (402) with an 8" outside diameter. The support clamp may be made or metal (e.g. aluminum, steel) or any other suitable material.

The lower unit (830) may be designed to be suspended from the flexible support members (816), and may include two or more lower perimeter components (832). The lower perimeter components (832) may be designed to attach together so as to surround the structural element (402) and guide the sleeve structure (410) around the structural element (402) as it is lowered below the water line (716). In one embodiment, the lower unit (830) may be designed to disconnect into multiple subcomponents (e.g. halves), or to open about a hinge, so as to allow for release of the sleeve structure (410) and retrieval of the lower unit (830). In some embodiments, two or more of the lower perimeter components (832) may be connected via one or more releasable attachments (434) designed to be released from a distance. As a non-limiting example, each releasable attachment (834) may include an attachment pin (835) and two or more attachment barrels (836). Each attachment barrel (836) may be affixed to an end of a lower perimeter component (832) such that lower perimeter components (832) may be attached by aligning their respective attachment barrels (836) and passing the attachment pin (835) through the aligned attachment barrels (836). As a non-limiting example, the attachment pin (835) may be a loop grip quick-release pin. Furthermore, the apparatus (800) may additionally include a flexible release member (837) attached to each attachment pin (834) so as to enable release of the releasable attachments (834) via puling the one or more flexible release members (837) to remove the attachment pin (834) from the aligned attachment barrels (836). In this manner, the lower unit (830) may be configured to release the lowered sleeve structure (410) upon release of the releasable attachments (834), Without wishing to limit the present invention to any particular theory or mechanism, this feature may allow for the lowering apparatus (800) to be used and operated entirely from above the water line (716), without the need for underwater workers such as divers.

In some embodiments, the lower unit (830) may include two or more radially spaced gap guides (838). The gap guides (838) may each extend inwardly from the lower perimeter components (832) so as to maintain a gap between the lower perimeter components (832) and the structural element (402). As a non-limiting example, the gap guides may each extend inwardly a distance which is slightly less than half the difference between the diameter of the sleeve structure (410) and the diameter of the structural element (402). Without wishing to limit the present invention to any particular theory or mechanism, it is believed that the gap guides (838) may prevent the lower unit (830) from becoming misaligned with the structural element (402) and caught against a surface of the structural element (402). According to selected embodiments, the lower unit (830) may include two or more rollers (840). Each roller (840) may be positioned extending inwardly from one of the gap guides (838) so as to guide the lower unit (830) around the structural element (410). As a non-limiting example, each roller (840) may be a side-mounted bracket caster. In further embodiments, the rollers (840) may each have a spring tensioner so as to maintain tension between the rollers (840) and the structural element (402) while allowing the rollers (840) flexibility to pass over surface irregularities such as barnacles.

In one embodiment, the lower unit (830) may include two or more lower attachment points (842) for attachment of the lower perimeter components (832) to the flexible support members (822). The lower unit (830) may have an attachment point (842) for each flexible support member (822) extending from the upper unit (810), or may have more attachment points (842). As a non-limiting example, the upper unit may have two flexible support members (822) extending downwardly, and each splitting into two a short distance from the lower unit (830), such that the flexible support members (822) attach to the lower unit (830) at a total of four attachment points (842). In some embodiments, the lower unit (830) may include one or more sleeve structure supports (844), each extending inwardly or outwardly from the lower perimeter components (832). As a non-limiting example, the sleeve structure support (844) may be a circular or semicircular flange or lip for the sleeve structure (410) to rest upon. As another non-limiting example, the sleeve structure supports (844) may be a plurality of protrusions from the lower perimeter components (832) for the sleeve structure (410) to rest upon. In some embodiments, the flexible support members (822) may allow for recovery of the detached lower perimeter components (832) of the lower unit (830) after release of the releasable attachments (834).

In one embodiment, the present invention features an apparatus (800) for supporting and lowering a sleeve structure (410) around a partially submerged structural element (402). As a non-limiting example, the apparatus (800) may include: an upper unit (810), for fixation to the structural element (402); two or more flexible support members (822), each extending downwardly from the upper unit (810); and a lower unit (830), designed to surround the structural element (402) and to be suspended from the flexible support members (822). The lower unit (830) may include one or more sleeve structure supports (844). In some preferred embodiments, the lower unit (830) may be configured to support the sleeve structure (410) as it is assembled and lowered from the upper unit (810) by the flexible support members (822). In some embodiments, the lower unit (830) may include two or more lower perimeter components (832) which are connected by one or more releasable attachments (834). The lower unit may be designed to release the lowered sleeve structure (410) upon release of the releasable attachments (834).

Figure 25:
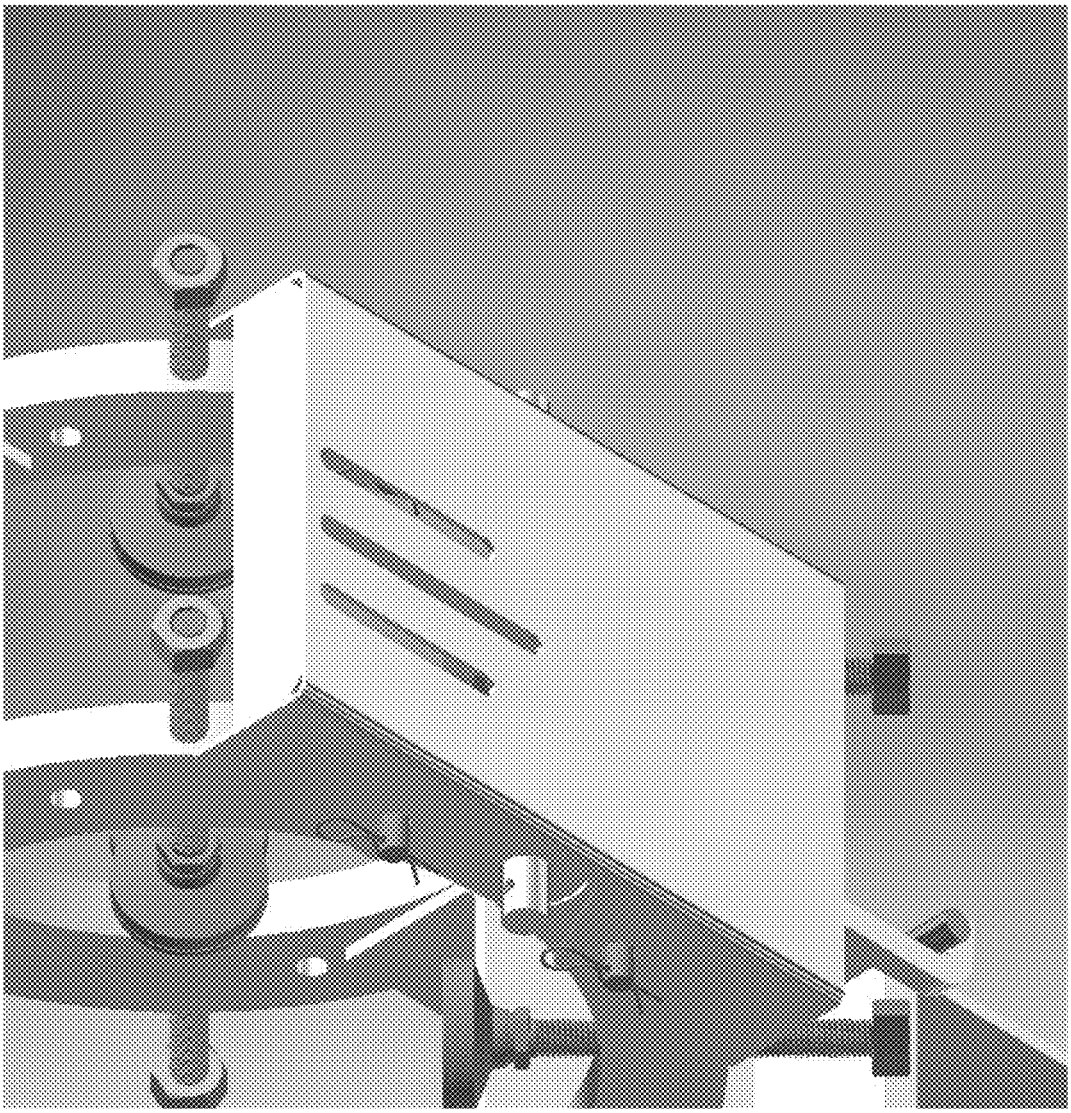
FIG. 25 shows an illustration of a joining component which attaches of two halves of an upper unit of a sheath structure lowering apparatus of the present invention. The joining component has slots cut in its face to allow for the attachment of a winch.
Figure 26:
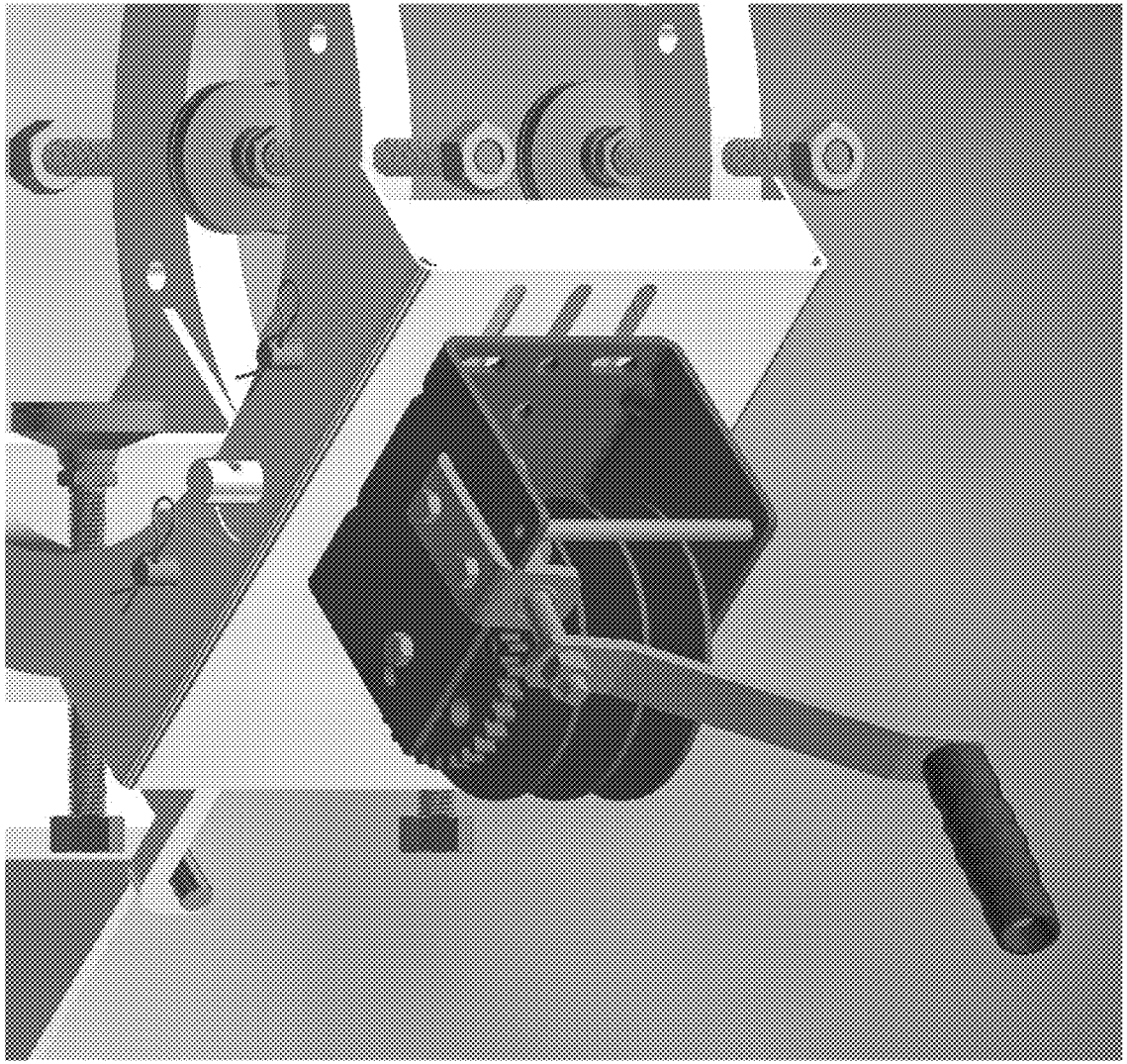
FIG. 26 shows an illustration of the attachment of a hand winch to the joining component shown in FIG. 25. The hand winch has a double spool, so that it can wind two cables which each run through a pulley at the end of an upper support arm and down to the lower unit.
Figure 27A:
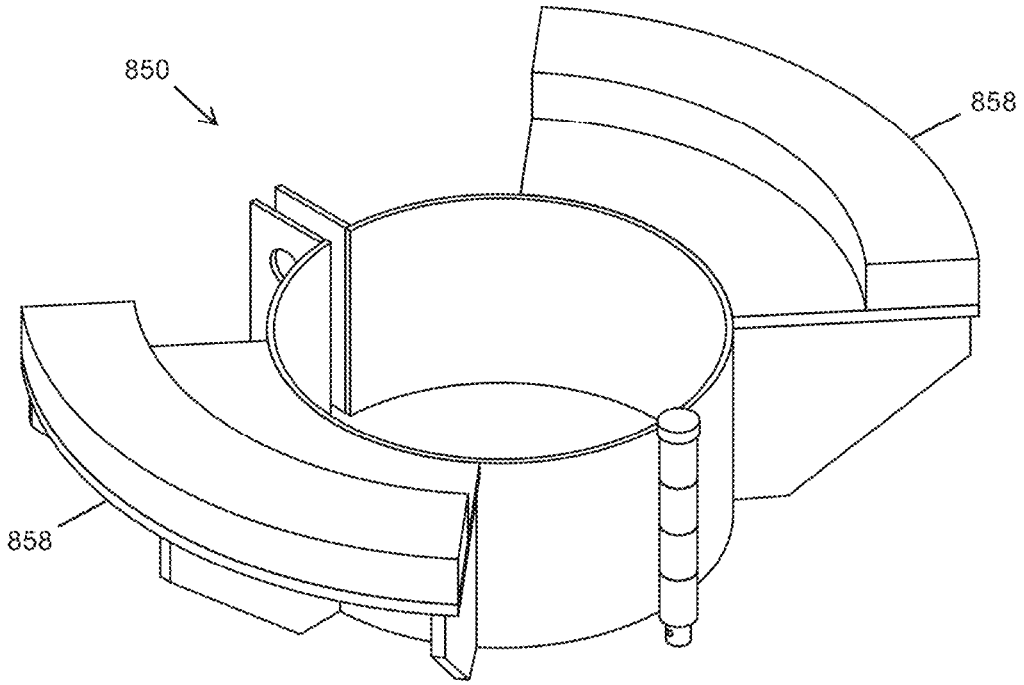
FIG. 27A shows a perspective view schematic of a support clamp of the present invention.
Figure 27B:
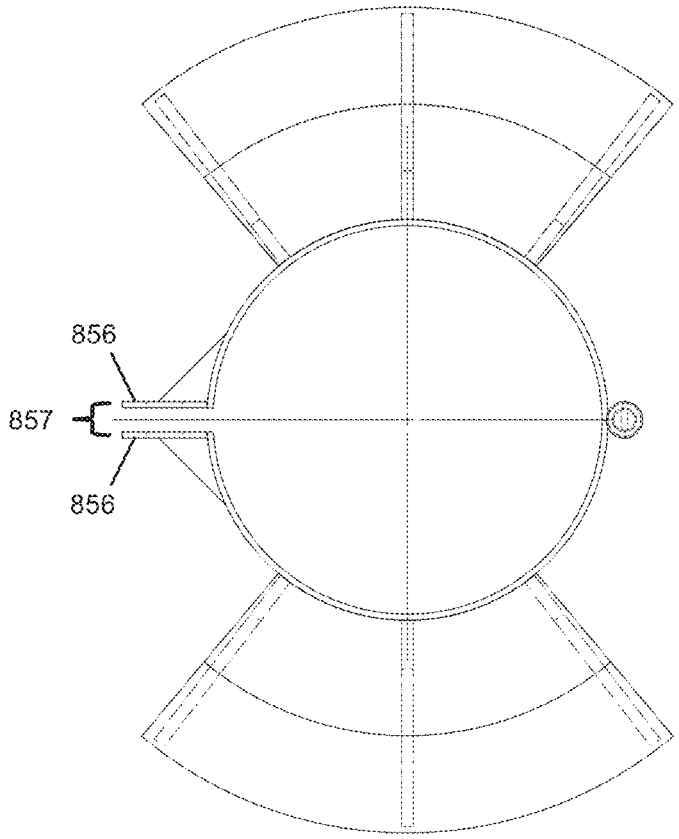
FIG. 27B shows a top view schematic of a support clamp of the present invention.
Figure 27C:
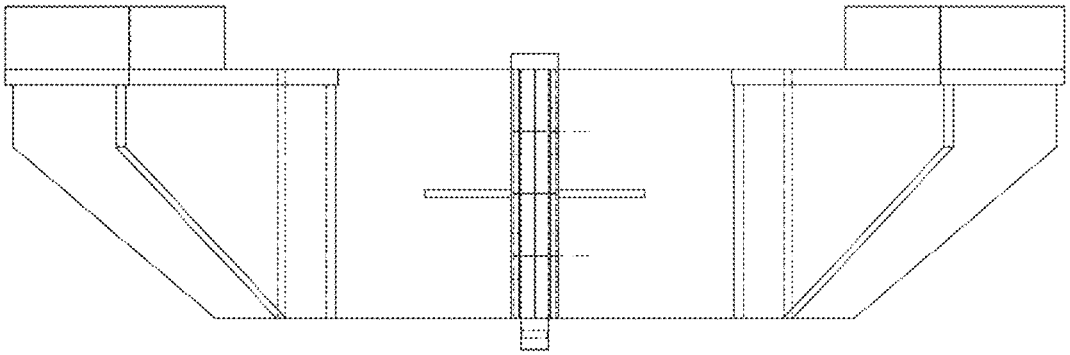
FIG. 27C shows a side view schematic of a support clamp of the present invention.
Figure 27D:
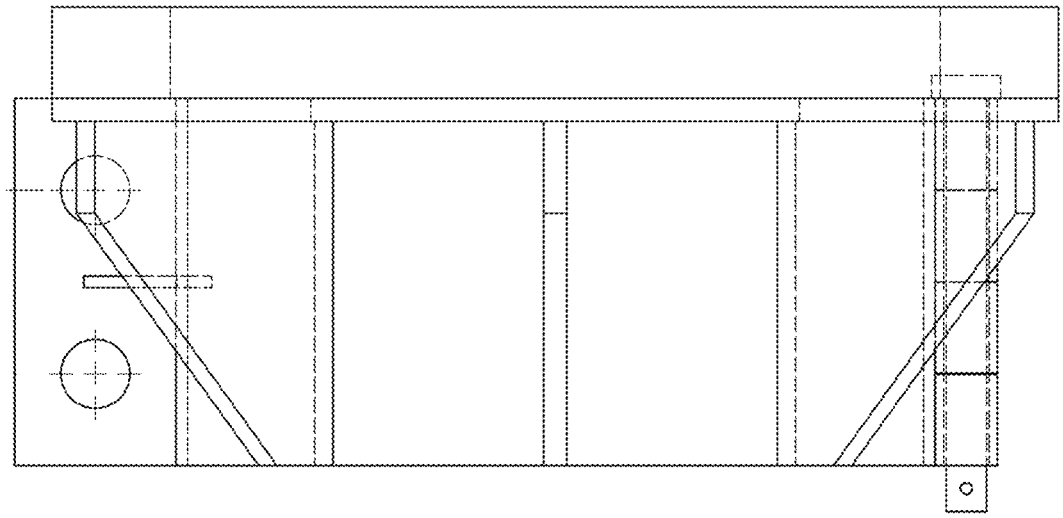
FIG. 27D shows another side view schematic of a support clamp of the present invention.

In selected embodiments, the apparatus (800) additionally comprises a hoist system (818). The hoist system (818) may be affixed to the upper unit (810) and may extend and retract the flexible support members (822) so as to lower and raise the lower unit (830). The hoist system (818) may be electric powered, or entirely mechanical. As a non-limiting example, the hoist system (818) may include one or more winches (819) and a plurality of pulleys (820). The winch (819) may be a worm gear winch with a split reel, set up to wind cable on each half of the split reel so that cable extends in opposite directions to pulleys (820) affixed to opposite support brackets (816), before redirecting down to the lower unit (830). In other embodiments, more than two flexible support members (822) such as cables may extend from one or more winches (819) to support the lower unit (830). As a non-limiting example, the pulleys may include both a horizontal directional block and a single swivel directional block on each support bracket (816) for directing the flexible support members (822) from the winch (819) away from the structural element (402) and then down to the lower unit (830). The hoist system (818) may lower the lower unit (830) continuously or in stages. The use of multiple pulleys positioned on either side of the upper unit (810) may allow for control of the lowering of the lower unit (830) from a single central control point so as to lower the lower unit (830) at an even level and avoid tipping it to any side. As shown in FIG. 25, in some embodiments, the upper unit (810) may include attachment slots such that the winch (819) may be adjusted to be affixed slightly closer to one side or the other so as to equalize tension on the flexible support members (822) and ensure that the lower unit (810) is not unevenly suspended.

Both the upper unit (810) and the lower unit (830) may be constructed from any suitable structural material (e.g. steel, aluminum) of combination of materials. As a non-limiting example, they may be constructed from aluminum plates which are welded together. In some embodiments, the apparatus (800) is lightweight enough to be easily affixed to the structural element (402) while still being strong enough to support the weight of the entire sleeve structure (410). As a non-limiting example, the weight of the upper unit (810) may be less than about 40, 50, 60, 70, 80, 90, 100, 110, 120, 130, 140, 150, 160, 170, 180, 190, or 200 pounds. As another non-limiting example, the weight of the lower unit (830) may be less than about 4, 5, 6, 7, 8, 9, 10, 11, 12, 13, 14, 15, 16, 17, 18, 19, 20, 25, 30, 35, or 40 pounds, and the total weigh of the apparatus (800) may be less than about 40, 50, 60, 70, 80, 90, 100, 110, 120, 130, 140, 150, 160, 170, 180, 190, 200, 210, 220, 230, 240 or 250 pounds.

In some embodiments, the present invention features a method for reinforcing a partially submerged structural element (402). As a non-limiting example, the method may comprise: providing a plurality of reinforcing shells (420) configured to form a sleeve structure (410) around a length of the structural element (402) such that there is a chamber (406) between the structural element (402) and the sleeve structure (410), wherein the sleeve structure (410) comprises: a first segmented layer (412), comprising a plurality of stacked segments (416), the segments (416) disposed along an axis (404), wherein each segment comprises two or more reinforcing shells (420) and two or more vertical seams (424) between the reinforcing shells (420); providing a core filler material (426) configured to fill the chamber (406) between the sleeve structure (410) and the structural element (402) so as to reinforce the structural element (402); providing an apparatus (800) for lowering the sleeve structure (410) around the structural element (402), the apparatus (800) comprising: an upper unit (810), configured for fixation to the structural element (402); two or more flexible structural support members (822), each extending downwardly from the upper unit (810); and a lower unit (830), configured to surround the structural element (402) and to be suspended from the flexible support members (822), the lower unit (830) comprising one or more sleeve structure supports (844) configured to support the sleeve structure (410); fixing the upper unit (810) to the structural element (402); constructing a first segment (416) such that it is supported by the lower unit (830); constructing additional segments (416) on top of the first segment (416) such that each segment (416) is supported by the segment (416) below; periodically lowering the lower unit (830) via the flexible structural support members (822), thereby lowering segments (416) of the sleeve structure (410) below a water line (716) as the sleeve structure (410) is constructed; and filling the chamber (406) between the structural element (402) and the sleeve structure (410) with the core filler material (426).

In some embodiments, the core filler material (426) may displace water or air from the chamber (406). In other embodiments, the chamber (406) may be is filled with the core filler material (426) in multiple fractions. In further embodiments, each fraction may be cured before the next fraction is added. In some embodiments, the first segment (416) may seal below a mud line (756) so as to prevent the core filler material (426) from leaking out of the chamber (406). In alternative embodiments, the first segment (416) may seal against an underwater surface such as a seabed, riverbed, creekbed, lakebed, or pondbed. In still other embodiments, an expandable plug (846) may seal a bottom end of the chamber (406) so as to prevent the core filler material (426) from leaking out of the chamber (406). This expandable plug (846) may be part of the lower unit (830) and may preferably be expanded remotely. As a non-limiting example, the expandable plug (846) may be an inflatable chamber, connected to an inflation hose that reaches above the water line (716), or alternatively, connected to a canister of compressed gas that is affixed to the lower unit (830). By placing a rope or cable through the lower attachment point (842), the lower unit (830) may be retrieved, after pulling out the attachment pin (835) via the flexible release member (837).

According to some embodiments, the sleeve structure (410) may additionally include a second segmented layer (414). The second segmented layer (414) may be made up of a plurality of stacked segments (416) which each surround the first segmented layer (412) and a plurality of horizontal seams (418) between the segments (416). The segments (416) may be disposed along the axis (404), and each segment (416) may include two or more reinforcing shells (420) and two or more vertical seams (424) between the reinforcing shells (420). In one preferred embodiment, the first segmented layer (412) and the second segmented layer (414) may be constructed and lowered simultaneously with each other. In some embodiments, the horizontal seams (418) of the first segmented layer (412) and the second segmented layer (414) may be staggered. In further embodiments, the vertical seams (424) of the first segmented layer (412) and the second segmented layer (414) may be staggered.

The present invention may provide a method of reinforcing a structural element in a marine environment. The method includes positioning marine vessels about the structural element, positioning first and second fiber-reinforced shells from the marine vessels about the structural element to form first and second seams, positioning third and fourth fiber-reinforced shells from the marine vessels about the first and second fiber-reinforced shells to form third and fourth seams, then lowering the shells relative to the water line and then adhering the first and second fiber-reinforced shells to the structural element and the third and fourth fiber-reinforced shells to the first and second fiber-reinforced shells.

An embodiment of the present invention includes a method of reinforcing a structural element that is partially submerged and extends along an axis between a structure above a water line and a seabed below the water line. The method below is provided as a non-limiting example of the invention.

The method includes (i) positioning first and second marine vessels about the structural element, and (ii) positioning a base with first and second ends about the structural element such that the first end of the base faces toward the seabed and the second end of the base faces toward the structure. Alternatively, the method may include only a single marine vessel or a working platform other than a marine vessel.

The method includes (iii) positioning a first fiber-reinforced shell with first and second edges and first and second ends about a first portion of the structural element by transferring the first fiber-reinforced shell from the first marine vessel to the base such that the first end of the first fiber-reinforced shell faces toward the second end of the base, (iv) positioning a second fiber-reinforced shell with first and second edges and first and second ends about a second portion of the structural element by transferring the second fiber-reinforced shell from the second marine vessel to the base such that the first end of the second fiber-reinforced shell faces toward the second end of the base, the first edge of the first fiber-reinforced shell is adjacent to the first edge of the second fiber-reinforced shell to provide a first seam and the second edge of the first fiber-reinforced shell is adjacent to the second edge of the second fiber-reinforced shell to provide a second seam, and (v) adhering the first and second fiber-reinforced shells together, thereby providing a first bonded shell pair that envelopes a portion of the structural element.

The method includes (vi) positioning a third fiber-reinforced shell with first and second edges and first and second ends about the first seam by transferring the third fiber-reinforced shell from the first marine vessel to the base such that the first end of the third fiber-reinforced shell faces toward the second end of the base, (vii) positioning a fourth fiber-reinforced shell with first and second edges and first and second ends about the second seam by transferring the fourth fiber-reinforced shell from the second marine vessel to the base such that the first end of the fourth fiber-reinforced shell faces toward the second end of the base, the first edge of the third fiber-reinforced shell is adjacent to the first edge of the fourth fiber-reinforced shell to provide a third seam and the second edge of the third fiber-reinforced shell is adjacent to the second edge of the fourth fiber-reinforced shell to provide a fourth seam, and (viii) adhering the third and fourth fiber-reinforced shells together, thereby providing a second bonded shell pair that envelopes at least a portion of the first and second fiber-reinforced shells.

The method includes (ix) lowering the base and the first, second, third and fourth fiber-reinforced shells relative to the water line such that the base and the first, second, third and fourth fiber-reinforced shells move towards the seabed, then (x) adhering the first and second fiber-reinforced shells to the structural element and (xi) adhering the third and fourth fiber-reinforced shells to the first and second fiber-reinforced shells.

The method may include offsetting the first and second fiber-reinforced shells relative to the third and fourth fiber-reinforced shells along the axis. For instance, the first ends of the first, second, third and fourth fiber-reinforced shells are aligned along the axis and coterminal with the second end of the base and the second ends of the first and second fiber-reinforced shells are offset relative to the second ends of the third and fourth fiber-reinforced shells along the axis. Alternatively, the second ends of the first and second fiber-reinforced shells protrude relative to the second ends of the third and fourth fiber-reinforced shells along the axis and the third and fourth fiber-reinforced shells envelope a portion of the first and second fiber-reinforced shells. As another example, the second ends of the third and fourth fiber-reinforced shells protrude relative to the second ends of the first and second fiber-reinforced shells along the axis and the third and fourth fiber-reinforced shells envelope the first and second fiber-reinforced shells. As a further example, the first ends of the first and second fiber-reinforced shells are offset relative to the first ends of the third and fourth fiber-reinforced shells along the axis and the second ends of the first and second fiber-reinforced shells are offset relative to the second ends of the third and fourth fiber-reinforced shells along the axis. In yet another example, the first and second fiber-reinforced shells extend a same distance as and are staggered relative to the third and fourth fiber-reinforced shells along the axis.

The method may include repeating steps (iii) to (v) to obtain a first stacked arrangement of fiber-reinforced shells that provide a first reinforcement layer for the structural element, and repeating steps (vi) to (viii) to obtain a second stacked arrangement of rigid fiber-reinforcement shells that provide a second reinforcement layer for the structural element. The method may include performing step (x) to adhere the first reinforcement layer to the structural element and performing step (xi) to adhere the second reinforcement layer to the first reinforcement layer. The method may also include incrementally repeating steps (id) to (viii) and lowering the base until it rests on the seabed.

Preferably, the first and second seams are offset by 170 to 190 degrees, the third and fourth seams are offset by 170 to 190 degrees and the third and fourth seams are offset relative to the first and second seams by 80 to 110 degrees.

Preferably, step (i) includes a first worker on the first marine vessel navigating the first marine vessel to the structural element and a second worker on the second marine vessel navigating the second marine vessel to the structural element, step (ii) includes the first worker installing the base about the structural element, step (iii) includes the first worker loading the first fiber-reinforced shell from the first marine vessel to the base, step (iv) includes the second worker loading the second fiber-reinforced shell from the second marine vessel to the base, step (vi) includes the first worker loading the third fiber-reinforced shell from the first marine vessel to the base, and step (vii) includes the second worker loading the fourth fiber-reinforced shell from the second marine vessel to the base. Alternatively, all the steps may be accomplished by a single worker or by more than two workers. Steps (iii) and (iv) may include a first time interval and exclude a second time interval and steps (vi) and (vii) may include the second time interval and exclude the first time interval.

Preferably, step (ii) includes suspending the base using first and second cables and step (ix) includes lowering the base using the cables. This may include repeating steps (iii) to (v) to obtain a first stacked arrangement of fiber-reinforced shells that provide a first reinforcement layer that extends from the seabed to a first elevation above the water line, repeating steps (vi) to (viii) to obtain a second stacked arrangement of rigid fiber-reinforcement shells that provide a second reinforcement layer that extends from the seabed to a second elevation above the water line, and incrementally lowering the base in response to repeating steps (iii) to (viii).

Preferably, step (x) includes providing a first grout that contacts and extends between and mechanically couples (a) the first and second fiber-reinforced shells and (b) the structural element, and step (xi) includes providing a second grout that contacts and extends between and mechanically couples (a) the third and fourth fiber-reinforced shells and (b) the first and second fiber-reinforced shells. For instance, step (x) includes pumping the first grout as a flowable mixture from a storage tank on the first marine vessel to a first gap between (a) the first and second fiber-reinforced shells and (b) the structural element and then hardening the first grout. Step (xi) includes pumping the second grout as a flowable mixture from the storage tank to a second gap between (a) the third and fourth fiber-reinforced shells and (b) the first and second fiber-reinforced shells and then hardening the second grout. Steps (x) and (xi) include simultaneously pumping and then simultaneously hardening the first and second grouts.

Advantageously, the present invention provides rapid, efficient and cost-effective reinforcement for a structural element. In preferred embodiments, a high strength, low weight, corrosion resistant reinforcement tube is installed on a structural element that accommodates numerous shapes and sizes, with minimal alteration to the structural element's shape and appearance, with minimal disruption and noise and without heavy equipment, scuba divers, surface preparation or environmental impact. The installation is safe and straightforward and requires limited manpower and no subsequent maintenance.

In one embodiment, the present invention features a reinforced structural element (400). The reinforced structural element (400) may comprise: a structural element (402) extending along an axis (404); a sleeve structure (410) disposed around a length (412) of the structural element (402) such that there is a chamber (406) between the structural element (402) and the sleeve structure (410); and a core filler material (426) disposed within the chamber (406) between the sleeve structure (410) and the structural element (402) so as to reinforce the structural element (402). In some embodiments, the chamber (406) may have a cross-sectional area which is significantly larger than a cross-sectional area of the structural element (402). As a non-limiting example, the chamber (406) may have a cross-sectional area which is 5, 10, 15, 20, 25, 30, 40, 50, 60, 70, 80, 90, 100, 120, 140, 160, 180, 200, 250, 300, 400, 500, 600, 700, 800, 900, 1000, or greater than 1000 percent larger than a cross-sectional area of the structural element (402).

Without wishing to limit the present invention to any particular theory or mechanism, it is believed that it is advantageous in certain situations to have a significant chamber (406) between the structural element (402) and the sleeve structure (410) because it provides area for reinforcing core filler material (426) and also allows the sleeve structure (410) to be freely slid along the structural element (402) without catching on the structural element (402) even if there are irregularities on the surface of the structural element (402). Additionally, the space between the structural element (402) and the sleeve structure (410) may advantageously allow for the introduction of axial reinforcing members (440) or horizontal rebar. In some embodiments, the core filler material (426) may comprise an adhesive material. As a non-limiting example, the core filler material (426) may comprise a cement, a polymer cement, a glue, a resin, a polymer, or a foam.

According to some preferred embodiments, the sleeve structure (410) may comprise multiple concentric layers. These layers may be rigid, semi-rigid, or flexible. As a non-limiting example, the sleeve structure may comprise: a first segmented layer (412), comprising a plurality of stacked segments (416) which each surround the structural element (402) and a plurality of horizontal seams (418) between the segments (416), the segments (416) disposed along the axis (404), wherein each segment (416) comprises two or more reinforcing shells (420) and two or more vertical seams (424) between the reinforcing shells (420); and a second segmented layer (414), comprising a plurality of stacked segments (416) which each surround the first segmented layer (412) and a plurality of horizontal seams (418) between the segments (416), the segments (416) disposed along the axis (404), wherein each segment (416) comprises two or more reinforcing shells (420) and two or more vertical seams (424) between the reinforcing shells (420).

In some embodiments, the sleeve structure (410) may comprise a single layer of segments (416) with overlapping joints. As one non-limiting example, instead of forming the segments (416) of the sleeve structure (410) by joining multiple reinforcing shells (420) together, each segment (416) may be formed by folding a single flexible or semi-rigid plate into a cylindrical shape with a single overlapped vertical seam (424). The width of the overlap for the overlapped seam may depend on the thickness of the single flexible or semi-rigid plate. These segments (416) may then be stacked vertically with overlapping horizontal seams (418). For example, each segment (416) may have a top diameter which is larger or smaller than the bottom diameter such that each segment fits partially within one adjacent segment and partially around another adjacent segment. Where other embodiments, may have multiple vertical seams (424) in each segment (416), this embodiment may have only a single vertical seam (424) in each segment (416), thus reducing the amount of work required to install the reinforcement.

In some embodiments the reinforcing shells (420) may comprise fiber-reinforced shells. As a non-limiting example, the reinforcing shells (420) may comprise carbon fiber/epoxy composite shells. In other embodiments, the reinforcing shells (420) may comprise metal, ceramic, polymer, cardboard, or another structural material. In some embodiments, the reinforcing shells (420) may be solid. In other embodiments, the reinforcing shells (420) may have holes or pores and may require coating with another layer so as to prevent core filler material (426) from escaping through the holes or pores. In some embodiments, the reinforcing shells (420) may be rigid. In other embodiments, the reinforcing shells (420) may be flexible, or may be flexible prior to hardening and rigid after hardening.

According to some embodiments, the sleeve structure (410) may additionally comprise one or more wrapped layers (430), each wrapped layer (430) formed by wrapping a flexible reinforcing material around one of the segmented layers or another of the wrapped layers (430). For example, sleeve structure (410) may comprise one or more segmented layers formed of reinforcing shells (420) which have one or more wrapped layers (430) surrounding them as a final reinforcement layer. As a non-limiting example, the flexible reinforcing material may be wrapped in a helical or a circumferential pattern. For added strength, multiple layers of the flexible reinforcing material may be wrapped in alternating helical patterns. In some embodiments, the flexible material may be coated or impregnated with a curable material so as to allow it to cure and harden. In other embodiments, additional segmented layers may be placed over the wrapped layers (430) so as to sandwich the wrapped layers (430) between segmented layers.

In some embodiments, the reinforced structural element (400) may additionally comprise axial reinforcing members (440) disposed within the chamber (406) and encapsulated within the core filler material (426). As non-limiting examples the axial reinforcing members (440) may comprise rigid, semi-rigid, or flexible rods, rigid, semi-rigid, or flexible bars, chains, springs, rebar, or cables. The axial reinforcing members (440) may comprise metal, polymer, ceramic, fibrous material, cord, or another structural material. The axial reinforcing members (440) may be oriented parallel or perpendicular to the axis (404) in straight, non-straight, spiral, or other configurations. In some embodiments, the axial reinforcing members (440) may be formed by coupled axial reinforcing segments. As a non-limiting example, the axial reinforcing segments may be rebar rods which are coupled with screw couplers so as to form long axial reinforcing members (440). Without wishing to limit the present invention to any particular theory or mechanism, it is believed that using axial reinforcing members (440) which are made up of axial reinforcing segments may allow for easy installation of the axial reinforcing members (440), one or more segments at a time.

In some embodiments, the axial reinforcing members (440) may be attached directly to the reinforcing shells (420). In other embodiments, the axial reinforcing members (440) may be positioned within the chamber (406) so as to avoid touching the reinforcing shells (420). The axial reinforcing members (440) may be positioned prior to positioning of the reinforcing shells (420) or may be inserted into the chamber (406) after the reinforcing shells (420) are positioned. Alternatively, the reinforcing shells (420) and the axial reinforcing members (440) may be assembled simultaneously. In some embodiments, the axial reinforcing members (440) may act as a guide to allow for the reinforcing shells (420) to be slid into position along the structural element (402). In another embodiment, the axial reinforcing members (440) may be directly wrapped with one or more wrapped layers (430) so as to form a sleeve structure (410) without the use of reinforcing shells (420).

In one embodiment, the reinforced structural element (400) may additionally comprise a plurality of sheer keys (450), extending radially from a surface (408) of the structural element (400) and encapsulated by the core filler material (426). Without wishing to limit the present invention to any particular theory or mechanism, it is believed that these sheer keys (450) may improve the bonding between the structural element (402) and the core filler material (426) by providing a strong mechanical interlock. In preferred embodiments, the sheer keys (450) may be installed into the surface (408) of the structural element (400) prior to formation of the sleeve structure (410) around the structural element (400). As a non-limiting example, for underwater applications, the sheer keys (450) may be screwed into the surface (408) of a pile by a diver, before the sleeve structure (410) is lowered around the pile from above the waterline.

In another embodiment, the reinforcing shells (420) of the first segmented layer (412) may comprise shear key protrusions (452) extending from an interior surface (422) of the reinforcing shells (420) such that the shear key protrusions (452) are encapsulated by the core filler material (426). These shear key protrusions (452) may be formed by the same material of the reinforcing shells (420) or by another material. In one embodiment, the shear key protrusions (452) may pass through multiple layers of the sleeve structure (410). As a non-limiting example, after a portion or all of the sleeve structure (410) is assembled, a plurality of shear key protrusions (452) may be punched or screwed through the layers of the sleeve structure (410) to provide for mechanical interlock with the core filler material (426) and to physically attach the layers of the sleeve structure (410) together.

In preferred embodiments, each segment (416) may comprise n reinforcing shells (420) and n vertical seams (424), wherein n is an integer between 2 and 10, In other embodiments, n may be an integer between 10 and 1000. For example, when n is 2, each segment (416) may have two half-shells, with 180 degrees between the two seams. When n is 3, each segment (416) may have three third-shells, with 120 degrees between each of the three seams. When n is 4, each segment (416) may have four quarter-shells, with 90 degrees between each of the four seams.

According to preferred embodiments the vertical seams (424) of adjacent segments (416) may be staggered. The vertical seams (424) of adjacent segments (416) may be staggered so as to maximize the distance between adjacent vertical seams (424). In some embodiments, each consecutive segment (416) may be rotated by an offset angle with respect to the proceeding segment (416) so as to effectively stagger the vertical seams (424) for multiple segments (416). As a non-limiting example, if the offset angle is equal to the angle between the vertical seams (424) divided by an integer m, the vertical seams (424) would only repeat orientation every m segments (416). Additionally, the orientation of the segments (416) may be selected to that vertical seams (424) of adjacent segments (416) in different layers are also staggered so as to maximize the distance between adjacent vertical seams (424).

In some embodiments, the reinforcing shells (420) may form an end to end butt joint. In other embodiments, the reinforcing shells (420) may form a lap joint. The amount of overlap may depend on the thickness of the reinforcing shells (420).

Furthermore, in some embodiments, the horizontal seams (418) of the first (412) and second (414) segmented layers, or of additional adjacent layers, may be staggered. In some embodiments, horizontal seams (418) may be staggered by 1/L times the height of each segment (416) where L is an integer equal to the total number of segmented layers. For example, in an embodiment where the sleeve structure (410) has three segmented layers, the horizontal seams (418) of each layer may be staggered from the other two layers by $\frac{1}{3}^{rd}$ of the height of the segments. In order to accomplish this staggering, the layers may include offset segments with reinforcing shells (420) which have a different height from all the other reinforcing shells (420), for example, half height, third height, quarter height for two, three, and four layers respectively. As a non-limiting example, in an embodiment with five layers, the first layer may have no offset segment, the second layer may have a one-fifth height offset segment, the third a two-fifths offset segment, the fourth a three-fifths offset segment, and the fifth a four fifths offset segment, such that the horizontal seams (418) of all five layers would be offset from the horizontal seams (418) in every other layer.

In selected embodiments the sleeve structure (410) may comprise additional segmented layers, each layer comprising a plurality of stacked segments (416) and a plurality of horizontal seams (418) between the segments (416), the segments (416) disposed along the axis (404), wherein each segment (416) comprises two or more reinforcing shells (420) and two or more vertical seams (424) between the reinforcing shells (420). As a non-limiting example, the sleeve structure (410) may comprise 2, 3, 4, 5, 6, 7, 8, 9, 10, 11, 12, 13, 14, 15, 16, 17, 18, 19, 20 or more segmented layers.

In preferred embodiments the reinforcing shells (420) of each segment (416) may be adhesively or mechanically affixed together. Additionally, the reinforcing shells (420) of the first (412) and second (414) segmented layers may be adhesively or mechanically affixed together. For example, reinforcing shells (420) may be adhesively bound by a shell adhesive (428) such as a glue, a cement, a resin, a polymer, or another adhesive, bolted together, welded together, mechanically interlocked together, or affixed by any other adhesive or mechanical coupling. In one embodiment, an epoxy or adhesive may be pre-applied to the reinforcing shells (420) and covered with a peel-back cover paper. This peel-back cover paper can then be removed in the field just prior to pressing the reinforcing shells (420) together. In a further embodiment, some portions of the reinforcing shells (420) may have a curable adhesive underneath the peel-back cover paper and other portions of the reinforcing shells (420) may have a hardening agent underneath the peel-back cover paper such that when multiple reinforcing shells (420) are pressed together, the curable adhesive is placed in contact with the hardening agent.

In many embodiments, the structural element (402) may have a circular cross-section and the sleeve structure (410) may also have a circular cross-section. In other embodiments, the structural element (402) may have a non-circular cross-section. For example, the structural element (402) may have a rectangular cross-section. In these situations, the sleeve structure (410) may have a circular or a non-circular cross-section. As a non-limiting example, for the reinforcement of rectangular structural elements, a rectangular sleeve structure (410) may be used. This rectangular sleeve structure (410) may be formed by joining angled reinforcing shells (420) with multiple sides. The joints between the angled reinforcing shells (420) may be at a corner of the rectangular sleeve structure (410) or on one of the sides.

In one embodiment, the present invention features a system for reinforcing a structural element (402). As a non-limiting example, the system may comprise: a plurality of reinforcing shells (420) configured to form a sleeve structure (410) around a length (405) of the structural element (402) such that there is a chamber (406) between the structural element (402) and the sleeve structure (410), wherein the sleeve structure (410) comprises: a first segmented layer (412), comprising a plurality of stacked segments (416) and a plurality of horizontal seams (418) between the segments (416), the segments (416) disposed along an axis (404), wherein each segment (416) comprises two or more reinforcing shells (420) and two or more vertical seams (424) between the reinforcing shells (420); and a core filler material (426) configured to fill the chamber (406) between the sleeve structure (410) and the structural element (402) so as to reinforce the structural element (402). In one embodiment, the system may additionally comprise a shell adhesive (428) for affixing the reinforcing shells (420) together so as to form the sleeve structure (410).

In some embodiments, the system for reinforcing a structural element (402) may include one or more spacers (454) to hold the sleeve structure (410) in a desired orientation around the structural element (402) prior to the addition of the core filler material (428). For example, the spacers (454) may hold the sleeve structure (410) around the structural element (402) such that the two are co-axial or substantially co-axial. The spacers (454) may be positioned at one or both ends of the sleeve structure (410) and/or disposed along the inside of the sleeve structure. The spacers (454) may be attached to the structural element (402) prior to the installation of the sleeve structure (410) and may guide the initial positioning of the sleeve structure (410) around the structural element. As a non-limiting example, each spacer (454) may comprise a spacing rod having a set length which corresponds to the desired thickness of the chamber (406), such as half the difference between the diameter of the structural element (402) and the inner diameter of the sleeve structure (410). In some embodiments, each spacer (454) may be attached to either the structural element (402) or the sleeve structure (410) at one end, and comprise a roller at the other end, such that the spacers (454) may be used as the sleeve structure (410) is slid along the structural element (402). In some embodiments, multiple spacers (454) may be used in a single position along the axis (404) so as to provide for three dimensional spacing. For example, three spacers (454) may be positioned around the structural element (402) at a single position along the axis with a radial spacing of 120°. As an alternative example a first set of two spacers (454) may be positioned around the structural element (402) at a first position along the axis with a radial spacing of 180° and a second set of two spacers (454) may be positioned around the structural element (402) at a second position along the axis with a radial spacing of 180°, such that the relative orientations of the first and second sets of spacers (454) are offset by 90°.

In another embodiment, the system for reinforcing a structural element (402) may additionally include an end cap (456) to allow the chamber (406) to be filled with core filler material (426) without the core filler material (426) escaping through the bottom of the sleeve structure (410). In other embodiments, the sleeve structure may extend to the bottom of the structural element (402) and seal against a floor surface so as to prevent the core filler material (426) from escaping through the bottom of the sleeve structure (410).

In some embodiments, the sleeve structure (410) may additionally comprise a second segmented layer (414), comprising a plurality of stacked segments (416) which each surround the first segmented layer (412) and a plurality of horizontal seams (418) between the segments (416), the segments (416) disposed along the axis (404), wherein each segment (416) comprises two or more reinforcing shells (420) and two or more vertical seams (424) between the reinforcing shells (420). In some additional embodiments, the segments (416) of the second segmented layer (414) may have a diameter (417) that is larger than a diameter (417) of the segments (416) of the first segmented layer (412).

In some embodiments, the present invention features a sleeve structure (410) for reinforcement of a structural element (402). As a non-limiting example, the sleeve structure (410) may comprise: a plurality of reinforcing shells (420) configured to form a sleeve structure (410) around a length (405) of the structural element (402) such that there is a chamber (406) between the structural element (402) and the sleeve structure (410). In some embodiments, the sleeve structure (410) may comprise: a first segmented layer (412), comprising a plurality of stacked segments (416) and a plurality of horizontal seams (418) between the segments (416), the segments (416) disposed along an axis (404), wherein each segment (416) comprises two or more reinforcing shells (420) and two or more vertical seams (424) between the reinforcing shells (420); and a second segmented layer (414), comprising a plurality of stacked segments (416) which each surround the first segmented layer (412) and a plurality of horizontal seams (418) between the segments (416), the segments (416) disposed along the axis (404), wherein each segment (416) comprises two or more reinforcing shells (420) and two or more vertical seams (424) between the reinforcing shells (420).

In another embodiment, the present invention may provide a method of reinforcing a structural element. For example, the present invention may provide a method of reinforcing a structural element using any of the structures described herein. The methods and elements disclosed herein can be utilized to form new structures, retrofit existing structures, and/or repair or rehabilitate damaged structures (e.g. such as due to corrosion, deterioration, excessive loading, etc.). The structure may be a building, a bridge, a foundation, or the like. The structural element may be any component of the structure. Examples of structural elements include rods, beams, poles, columns, pipes, struts, studs, piles, tubes, bollards, and the like. The structural element may be of any suitable size or proportion, and may have any cross-sectional shape (e.g. circular, elongate, or square cross-section) or configuration (e.g. a flange) and can be designed for any purpose. In addition, the structural element can be constructed of any suitable material, such as concrete, metal, wood, plastic, masonry, stone, and combinations thereof.

The structural element may be present in a variety of locations, such as on, in, or partially in the ground, under or partially under water, and combinations thereof. In certain embodiments, the structural element is at least partially submerged in water (i.e., underwater). In various embodiments, the structural element is at least partially underground. In specific embodiments, the structural element is both at least partially submerged in water and at least partially underground. The term "partially", as used in this context, is used herein to refer to at least a portion of the structural element being underground and/or underwater. For example, a structural element in a marine environment may be partially submerged in a body of water, extend above the water line to an overlying structure, extend below the water line to an underlying seabed and penetrate the seabed to anchor it. In this instance, the structural element is partially underwater, partially underground and partially in the atmosphere. Further, the structural element may be a marine pile that provides a foundation for a structure such as a bridge, pier or wharf over the water line. It is understood that the body of water may be an ocean, lake, river and the like, the water line refers broadly to the water surface (including waves and tides) and the seabed refers broadly to the sea floor (including mud, sand and gravel).

The structural element comprises and extends between at least a first end and a second end, which are separated by a distance along an axis A. The distance between the first and second ends can be any distance, such as a distance of from 0.5 to 100,000 feet (where 1 foot is 0.3048 meters). Typically, the distance between the first and second ends is a distance of from 1 to 200, alternatively from 5 to 150, alternatively from 10 to 100, feet. The structural element may have other portions extending from the axis A. For example, in some embodiments the structural element may be bifurcated.

The structural element also presents an external surface having a perimeter extending for a distance around a plane lying perpendicular to the axis A (i.e., a cross section). The external surface presents a shape of the structural element. The shape of the structural element may be any shape, such as cubic, cylindrical, pyramidal, conical, prismatic, trapezoidal, and the like, and combinations thereof. The external surface may also be of any contour, such as smooth or rough, flat or textured, and the like, or combinations thereof. Moreover, any portion of the external surface may be the same as or different from any other portion of the external surface. In some embodiments, the external surface is substantially flat (or smooth). In certain embodiments, the external surface is textured (or rough). In specific embodiments, the external surface is ribbed and/or includes reinforcing structures. In specific embodiments, the shape of the structural element is a cylinder, such that the perimeter of the external surface of the structural element may be further defined as a circumference.

The structural element further includes an outer radius extending radially from the axis A to the external surface. The outer radius can be any distance, such as a distance of from 1/12 to 100 feet, although distances outside of this range are also contemplated for the outer radius. Typically, the outer radius will be a distance of from 1/6 to 75, alternatively from 1/5 to 50, alternatively from 1/4 to 25, alternatively from 1/3 to 10, feet. In some embodiments, the structural element is a concentric cylinder that includes the outer radius and further includes an inner radius that extents from the axis A for distance less than the outer radius. It is to be appreciated that the structural element may comprise multiple radii, each independently of the same or different distance, depending on the shape of the structural element.

The method can be used to reinforce any portion of the structural element or the entire structural element. In some embodiments, the method is used to reinforce only a portion of the structural element. In certain embodiments, the method is used to reinforce the entire structural element. For instance, the method may reinforce a portion of a marine pile that extends across the water line. In this instance, the method may reinforce the marine pile to the seabed or only partially to the seabed, and similarly, the method may reinforce the marine pile to the overlying structure or only partially to the overlying structure.

The method may utilize rigid, semi-rigid, or flexible fiber-reinforced shells. Typically, the method comprises a number of pairs of rigid, semi-rigid, or flexible fiber-reinforced shells, such as 1, 2, 3, 4, 5, 6, 7, 8, 9, 10, 11, 12, 13, 14, 15, 16, 17, 18, 19, or 20 (or more) pairs of rigid, semi-rigid, or flexible fiber-reinforced shells. Each pair of rigid, semi-rigid, or flexible fiber-reinforced shells comprises two rigid, semi-rigid, or flexible fiber-reinforced shells. For example, the method comprises at least a first pair of rigid, semi-rigid, or flexible fiber-reinforced shells comprising both a first rigid, semi-rigid, or flexible fiber-reinforced shell and a second rigid, semi-rigid, or flexible fiber-reinforced shell. In some embodiments, the method further comprises a second pair of rigid, semi-rigid, or flexible fiber-reinforced shells comprising a third rigid, semi-rigid, or flexible fiber-reinforced shell and a fourth rigid, semi-rigid, or flexible fiber-reinforced shell. In certain embodiments, the method further comprises additional pairs of rigid, semi-rigid, or flexible fiber-reinforced shells.

It is to be appreciated that each rigid, semi-rigid, or flexible fiber-reinforced shell is independently selected and any one of the rigid, semi-rigid, or flexible fiber-reinforced shells may be partially the same, substantially the same, or the same as any other of the rigid, semi-rigid, or flexible fiber-reinforced shells. The term "same" is to be understood to refer to one rigid, semi-rigid, or flexible fiber-reinforced shell having at least one common property, dimension, shape, composition, or the like, to another rigid, semi-rigid, or flexible fiber-reinforced shell. Accordingly, it is also to be understood that, absent description to the contrary, reference to any one or more particular rigid, semi-rigid, or flexible fiber-reinforced shell, in either a singular or a plural form, may be descriptive of one or more of the rigid, semi-rigid, or flexible fiber-reinforced shells generally, within a pair of rigid, semi-rigid, or flexible fiber-reinforced shells, within different pairs of rigid, semi-rigid, or flexible fiber-reinforced shells, and the like. Typically, depending on a configuration and shape of the structural element, both rigid, semi-rigid, or flexible fiber-reinforced shells of a pair of rigid, semi-rigid, or flexible fiber-reinforced shells are complementary in shape and dimension. For example, in some embodiments the first and second rigid, semi-rigid, or flexible fiber-reinforced shells of the first pair of rigid, semi-rigid, or flexible fiber-reinforced shells are substantially the same. Likewise, in some embodiments, the third and fourth rigid, semi-rigid, or flexible fiber-reinforced shells of the second pair of rigid, semi-rigid, or flexible fiber-reinforced shells are substantially the same. However, it is to be appreciated that the method may also utilize at least one pair of rigid, semi-rigid, or flexible fiber-reinforced shells comprising two rigid, semi-rigid, or flexible fiber-reinforced shells that are not complementary to one another. Accordingly, any one of the rigid, semi-rigid, or flexible fiber-reinforced shells need not be substantially the same as any other of the rigid, semi-rigid, or flexible fiber-reinforced shells.

In general, each rigid, semi-rigid, or flexible fiber-reinforced shell comprises a first end and a second end, and a height extending for a distance between the first and second ends. In certain embodiments, the height of the rigid, semi-rigid, or flexible fiber-reinforced shells extends between the first and second ends for a distance along an axis A. However, it is to be appreciated that each rigid, semi-rigid, or flexible fiber-reinforced shell need not be linear. Rather, in some embodiments the rigid, semi-rigid, or flexible fiber-reinforced shells are curved, arcuate, bent, or combinations thereof. The height of each rigid, semi-rigid, or flexible fiber-reinforced shell can be any distance, such as a distance of from 1/12 to 1,000 feet. Typically, the height of each rigid, semi-rigid, or flexible fiber-reinforced shell is a distance of from 1/6 to 900, alternatively from 1/5 to 800, alternatively from 1/4 to 700, alternatively from 1/3 to 600, alternatively from 1/2 to 500, alternatively from 2/3 to 400, alternatively from 3/4 to 300, alternatively from 5/6 to 200, alternatively from 1 to 100, feet. Each rigid, semi-rigid, or flexible fiber-reinforced shell also includes at least a first edge and a second edge, with each of the first and second edges extending for a distance along at least a portion of the height of the rigid, semi-rigid, or flexible fiber-reinforced shell. The portion of the height may be any distance, such as a distance up to and including the entire distance of the height. In certain embodiments, the portion of the height is the entire distance of the height of the rigid, semi-rigid, or flexible fiber-reinforced shell, or a distance greater than the height of the rigid, semi-rigid, or flexible fiber-reinforced shell (i.e., when the first and/or second edge is not parallel to the height of the rigid, semi-rigid, or flexible fiber-reinforced shell). Each rigid, semi-rigid, or flexible fiber-reinforced shell also has a width extending for a distance between the first and second edges. The width of the rigid, semi-rigid, or flexible fiber-reinforced shell is typically perpendicular, or substantially perpendicular, to the height of the rigid, semi-rigid, or flexible fiber-reinforced shell. Likewise, the height of the rigid, semi-rigid, or flexible fiber-reinforced shell is typically parallel, or substantially parallel, to the first and second edges. However, in certain embodiments, the height is not parallel, or substantially parallel, to the first edge and/or second edge. Likewise, in these or other embodiments, the width of the rigid, semi-rigid, or flexible fiber-reinforced shell is not perpendicular, or substantially perpendicular, to the height of the rigid, semi-rigid, or flexible fiber-reinforced shell. The width of each rigid, semi-rigid, or flexible fiber-reinforced shell can be any distance, such as a distance of from 1/12 to 1,000 feet. Typically, the width of each rigid, semi-rigid, or flexible fiber-reinforced shell is a distance of from 1/6 to 900, alternatively from 1/5 to 800, alternatively from 1/4 to 700, alternatively from 1/3 to 600, alternatively from 1/2 to 500, alternatively from 2/3 to 400, alternatively from 3/4 to 300, alternatively from 5/6 to 200, alternatively from 1 to 100, feet.

Each rigid, semi-rigid, or flexible fiber-reinforced shell also presents at least an interior surface and an exterior surface. The interior and exterior surfaces of the rigid, semi-rigid, or flexible fiber-reinforced shell may be, independently, of any shape, texture, and/or contour, such as smooth or rough, flat or textured, and the like, or combinations thereof. Accordingly, it is to be appreciated that the interior and exterior surfaces of any one shell may be the same or different. As such, in some embodiments, the interior and exterior surfaces of any one shell are complementary. Additionally, the interior and/or exterior surface of any one of the rigid, semi-rigid, or flexible fiber-reinforced shells may be the same as or different from the interior and/or exterior surface of any other of the rigid, semi-rigid, or flexible fiber-reinforced shells. In some embodiments, the interior and/or exterior surface of the rigid, semi-rigid, or flexible fiber-reinforced shell is substantially flat. In certain embodiments, the interior and/or exterior surface of the rigid, semi-rigid, or flexible fiber-reinforced shell is textured. In specific embodiments, the interior and/or exterior surface of the rigid, semi-rigid, or flexible fiber-reinforced shell is ribbed and/or includes reinforcing structures.

In some embodiments, and as described in further detail below, the width of each rigid, semi-rigid, or flexible fiber-reinforced shell is independently a distance less than the distance of the perimeter of structural element, such as a distance of from 25 to 75, alternatively from 30 to 70, alternatively from 40 to 60, alternatively from 45 to 65, % of the perimeter of the structural element. In specific embodiments, the width of each of the first and second rigid, semi-rigid, or flexible fiber-reinforced shells is a distance of from 50 to 60% of the distance of the perimeter of the structural element. Additionally, the sum of the widths of the first and second rigid, semi-rigid, or flexible fiber-reinforced shells is a distance greater than the distance of the perimeter of the structural element. Furthermore, in some embodiments, the sum of the widths of the third and fourth rigid, semi-rigid, or flexible fiber-reinforced shells is a distance greater than the sum of the widths of the first and second rigid, semi-rigid, or flexible fiber-reinforced shells.

Each rigid, semi-rigid, or flexible fiber-reinforced shell may comprise a resin and a fiber. The resin may be any resin known in the art. Typically, thermosetting and/or thermoplastic resins are utilized due to the effectiveness of molding such resins through processes such as press molding, filament winding, or injection molding, and due to the good impact strength of molded products made therefrom. Accordingly, in some embodiments, the resin is a thermosetting and/or a thermoplastic resin. In these or other embodiments, elastomer or rubber can be added to or compounded with the thermosetting and/or thermoplastic resin to improve certain properties such as impact strength.

General examples of suitable thermosetting and/or thermoplastic resins typically include epoxy resins, polyester resins, phenolic resins (e.g. resol type), urea resins (e.g. melamine type), polyimide resins, and the like, as well as copolymers, modifications, and combinations thereof. Some specific examples of suitable thermosetting and/or thermoplastic resins include polyamides; polyesters such as polyethylene terephthalates, polybutylene terephthalates, polytrimethylene terephthalates, polyethylene naphthalates, liquid crystalline polyesters, and the like; polyolefins such as polyethylenes, polypropylenes, polybutylenes, and the like; styrenic resins; polyoxymethylenes; polycarbonates; polymethylenemethacrylates; polyvinyl chlorides; polyphenylene sulfides; polyphenylene ethers; polyimides; polyamideimides; polyetherimides; polysulfones; polyethersulfones; polyketones; polyetherketones; polyetheretherketones; polyetherketoneketones; polyarylates; polyethernitriles; phenolic resins; phenoxy resins; fluorinated resins, such as polytetrafluoroethylenes; thermoplastic elastomers, such as polystyrene types, polyolefin types, polyurethane types, polyester types, polyimide types, polybutadiene types, polyisoprene types, fluoro types, and the like; and copolymers, modifications, and combinations thereof.

In some embodiments the thermosetting and/or thermoplastic resin comprises, alternatively is, an epoxy resin. The term "epoxy" represents a compound comprising a cross-linked reaction product of a typically polymeric compound having one or more epoxide groups (i.e., an epoxide) and a curing agent. Thus, suitable epoxy resins include those formed by reacting an epoxide with a curing agent. The term "epoxy" is conventionally used to refer to an uncured resin that contains epoxide groups. With such usage, once cured, the epoxy resin is no longer an epoxy, or no longer includes epoxide groups, but for any unreacted or residual epoxide groups or reactive sites, which may remain after curing, as understood in the art. However, unless description to the contrary is provided, reference to epoxy herein in the context of an epoxy resin shall be understood to refer to a cured epoxy resin. The term "cured epoxy" shall be understood to mean the reaction product of an epoxide as defined herein and a curing agent as defined herein.

It is to be understood that the terms "curing agent" and "cross-linking agent" can be used interchangeably. Curing agents suitable for use in forming suitable epoxy resins are typically difunctional molecules that are reactive with epoxide groups. The term "cured" refers to a composition that has undergone cross-linking at an amount of from about 50% to about 100% of available cure sites. Additionally, the term "uncured" refers to the composition when it has undergone little or no cross-linking. However, it is to be understood that some of the available cure sites in an uncured composition may be cross-linked. Likewise, some of the available cure sites in a cured composition may remain uncross-linked. Thus, the terms "cured" and "uncured" may be understood to be functional terms. Accordingly, an uncured composition is typically characterized by a solubility in organic solvents and an ability to undergo plastic flow. In contrast, a cured composition suitable for the practice of the present invention is typically characterized by an insolubility in organic solvents and an absence of plastic flow under ambient conditions.

Examples of suitable epoxides include aliphatic, aromatic, cyclic, acyclic, and polycyclic epoxides, and modifications and combinations thereof. The epoxide may be substituted or unsubstituted, and hydrophilic or hydrophobic. Typically, the epoxide has an epoxy value (equiv./kg) of about 2 or greater, such as from 2 to 10, alternatively from 2 to 9, alternatively from 2 to 8, alternatively from 2 to 7, alternatively from 2.5 to 6.5.

Specific examples of suitable epoxides include glycidyl ethers of biphenol A and bisphenol F, epoxy novolacs (such as epoxidized phenol formaldehydes), naphthalene epoxies, trigylcidyl adducts of aminophenols, tetraglycidyl amines of methylenedianilines, triglycidyl isocyanurates, hexahydro-o-phthalic acid-bis-glycidyl esters, hexahydro-m-phthalic acid-bis-glycidyl esters, hexahydro-p-phthalicacid-bis-glycidyl esters, and modifications and/or combinations thereof.

Examples of suitable curing agents include phenols, such as biphenol, bisphenol A, bisphenol F, tetrabromobisphenol A, dihydroxydiphenyl sulfone, phenolic oligomers obtained by the reaction of above mentioned phenols with formaldehyde, and combinations thereof. Additional examples of suitable curing agents include anhydride curing agents such as nadir methyl anhydride, methyl tetrahydrophthalic anhydride, and aromatic anhydrides such pyromellitic dianhydride, biphenyltetracarboxylic acid dianhydride, benzophenonetetracarboxylic acid dianhydride, oxydiphthalic acid dianhydride, 4,4'-(hexafluoroisopropylidene) diphthalic acid dianhydride, naphthalene tetracarboxylic acid dianhydrides, thiophene tetracarboxylic acid dianhydrides, 3,4,9,10-perylenetetracarboxylic acid dianhydrides, pyrazine tetracarboxylic acid dianhydrides, 3,4,7,8-anthraquinone tetracarboxylic acid dianhydrides, oligomers or polymers obtained by the copolymerization of maleic anhydride with ethylene, isobutylene, vinyl methyl ether, and styrene, and combinations thereof. Further examples of suitable curing agents include maleic anhydride-grafted polybutadiene.

In some embodiments the thermosetting and/or thermoplastic resin comprises, alternatively is, a polyimide resin. Examples of suitable polyamides include polycaproamides (e.g. Nylon 6), polyhexamethyleneadipamides (e.g. Nylon 66), polytetramethyleneadipamides (e.g. Nylon 46), polyhexamethylenesebacamides (e.g. Nylon 610), polyhexamethylenedodecamides (e.g. Nylon 612), polyundecaneamides, polydodecaneamides, hexamethyleneadipamide/caproamide copolymers (e.g. Nylon 66/6), caproamide/hexamethyleneterephthalamide copolymers (e.g. Nylon 6/6T), hexamethyleneadipamide/hexamethyleneterephthalamide copolymers (e.g. Nylon 66/6T) hexamethyleneadipamide/hexamethyleneisophthalamide copolymers (e.g. Nylon 66/6I), hexamethyleneadipamide/hexamethyleneisophthalamide/caproamide copolymers (e.g. Nylon 66/6I/6), hexamethyleneadipamide/hexamethyleneterephthalamid/carpoamide copolymers (e.g. Nylon 66/6T/6), hexamethyleneterephthalamide/hexamethyleneisophthalamide copolymers (e.g. Nylon 6T/6I), hexamethyleneterephthalamide/dodecanamide copolymers (e.g. Nylon 6T/12), hexamethyleneadipamide/hexamethyleneterephthalamide/hexamethyleneisophthalamid e copolymers (e.g. Nylon 66/6T/6I), polyxylyleneadipamides, hexamethyleneterephthalamide/2-methyl-pentamethyleneterephthalamide copolymers, polymetaxylylenediamineadipamides (e.g. Nylon MXD6), polynonamethyleneterephthalamides (e.g. Nylon 9T), and combinations thereof.

In some embodiments the thermosetting and/or thermoplastic resin comprises, alternatively is, a phenol resin. Examples of suitable phenol resins include resins prepared by homopolymerzing or copolymerizing components containing at least a phenolic hydroxyl group. Specific examples of suitable phenol resins include phenolic resins such as phenolnovolaks, cresolnovolaks, octylphenols, phenylphenols, naphtholnovolaks, phenolaralkyls, naphtholaralkyls, phenolresols, and the like, as well as modified phenolic resins such as alkylbenzene modified (especially, xylene modified) phenolic resins, cashew modified phenolic resins, terpene modified phenolic resins, and the like. Further examples of suitable phenol resins include 2,2-bis(4-hydroxyphenyl)propane (generally referred to as bisphenol A), 2,2-bis(4-hydroxyphenyl)methane, 1,1-bis(4-hydroxyphenyl)ethane, 1,1-bis(4-hydroxyphenyl)cyclohexane, 2,2-bis(4-hydroxy-3,5-dimethylphenyl)propane, 2,2-bis(4-hydroxy-3,5-dibromophenyl)propane, 2,2-bis(hydroxy-3-methylphenyl)propane, bis(4-hydroxyphenyl)sulfide, bis(4-hydroxy-phenyl)sulfone, hydroquinone, resorcinol, 4,6-dimethyl-2,4,6-tri(4-hydroxyphenyl)heptene, 2,4,6-dimethyl-2,4,6-tri(4-hydroxyphenyl)heptane, 2,6-dimethyl-2,4,6-tri(4-hydroxyphenyl)heptene, 1,3,5-tri(4-hydroxyphenyl)benzene, 1,1,1-tri(4-hydroxyphenyl) ethane, 3,3-bis(4-hydroxyaryl)oxyindole, 5-chloro-3,3-bis(4-hydroxyaryl)oxyindole, 5,7-dichloro-3,3-bis(4-hydroxyaryl) oxyindole, 5-brome-3,3-bis(4-hydroxyaryl) oxyindole, and combinations thereof.

In some embodiments the thermosetting and/or thermoplastic resin comprises, alternatively is, a polyester resin. Examples of suitable polyester resins include polycondensation products of a dicarboxylic acid and a glycol, ring-opened polymers of a cyclic lactone, polycondensation products of a hydroxycarboxylic acid, and polycondensation products of a dibasic acid and a glycol. Specific examples of suitable polyester resins include polyethylene terephthalate resins, polypropylene terephthalate resins, polytrimethylene terephthalate resins, polybutylene terephthalate resins, polyethylene naphthalate resins, polybutylene naphthalate resins, polycyclohexanedimethylene terephthalate resins, polyethylene-1,2-bis(phenoxy) ethane-4,4'-dicarboxylate resins, polyethylene-1,2-bis(phenoxy)ethane-4,4'-dicarboxylate resins, as well as copolymer polyesters such as polyethylene isophthalate/terephthalate resins, polybutylene terephthalate/isophthalate resins, polybutylene terephthalate/decanedicarboxyate resins, and polycyclohexanedimethylene terephthalate/isophthalate resins, and combinations thereof.

The fiber comprises any fibrous material, such as carbon fiber, fiberglass, basalt fiber, natural fiber, metal fiber, polymer-based fibers such as aramid (e.g. Kevlar, Nomex, Technora), and combinations thereof. It is to be appreciated that the term "fiber" can denote a single fiber and/or a plurality of fibers. Herein, use of the term "fiber" denotes one or more individual fibers, which can be independently selected based on composition, size, length, and the like, or combinations thereof. For clarity and consistency, reference to the "fiber" is made herein, which is not intended to refer to just one fiber, but to any one fiber, which may be independently selected. The description below may relate to a single fiber, or all of the fibers, utilized.

In some embodiments, the fiber comprises more than one type of fibrous material. The fiber may be present in the rigid, semi-rigid, or flexible fiber-reinforced shells in the form of strings, wires, fabrics, tubes, particles, cables, strands, monofilaments, and combinations thereof. Additionally, the fiber may be woven or nonwoven. In some embodiments, the fiber is present in the rigid, semi-rigid, or flexible fiber-reinforced shells in the form of a filament product. Filament products include spun yarns (e.g. woven fabrics, knits, braids, etc.) webs (e.g. papers, mats, etc.), and chopped and milled fibers. In certain embodiments, the fiber is a staple product. Staple products include spun staple yarns, fabrics, knits, and braids of staple yarn, webs of staple including felts, mats, and papers, and chopped or milled staple fibers.

The fiber within each rigid, semi-rigid, or flexible fiber-reinforced shell may be randomly oriented or selectively oriented, such as aligned in one direction, oriented in cross directions, oriented in curved sections, and combinations thereof. The orientation of the fiber may be selected to provide various mechanical properties to the rigid, semi-rigid, or flexible fiber-reinforced shell such as tearing tendency, differential tensile strength along different directions, and the like.

In some embodiments, the fiber is arranged in the rigid, semi-rigid, or flexible fiber-reinforced shell in a direction running substantially parallel or parallel to the axis A, and the length of the fiber is substantially equal to the height of the rigid, semi-rigid, or flexible fiber-reinforced shell. When the fiber is curved, bent or twisted, the length of the fiber can be slightly longer than the height of the rigid, semi-rigid, or flexible fiber-reinforced shell. The phrase "substantially equal to" includes these cases. If almost equal shape of cross-section of the rigid, semi-rigid, or flexible fiber-reinforced shell is maintained in the axial direction, the length of the fiber may be generally regarded as substantially equal to the height of rigid, semi-rigid, or flexible fiber-reinforced shell. In certain embodiments, the fiber is arranged in the rigid, semi-rigid, or flexible fiber-reinforced shell in a direction running substantially perpendicular or perpendicular to the axis A, and the length of the fiber is substantially equal to the width of the rigid, semi-rigid, or flexible fiber-reinforced shell.

In some embodiments, the fiber is a carbon fiber. The carbon fiber may be or include graphene fibers, graphite fibers, and combinations thereof. The carbon fiber may be or include polyacrylonitrile (PAN)-type carbon fiber, pitch type carbon fiber, or combinations thereof. The carbon fiber may be in any form, such as single layer fibers, multilayer fibers, nanotubes, linked-particles, and combinations thereof. In these or other embodiments, the fiber further comprises an additional fibrous material, such as glass fiber, basalt fiber, natural fiber, metal fiber, polymer-based fiber such as aramid (e.g. Kevlar, Nomex, Technora), and the like, or combinations thereof.

In some embodiments, one or more of the rigid, semi-rigid, or flexible fiber-reinforced shells may further comprise additional components. Examples of additional components include: fillers, such as mica, talc, kaoline, sericite, bentonite, xonotlite, sepiolite, smectite, montmorillonite, wollastonite, silica, calcium carbonate, glass bead, glass flake, glass micro balloon, clay, molybdenum disulphide, titanium oxide, zinc oxide, antimony oxide, calcium polyphosphate, graphite, barium sulfate, magnesium sulfate, zinc borate, calcium borate, aluminum borate whisker, potassium titanate whisker, polymer, and the like; flame retardants and flame retardant aids; pigments; dyes; lubricants; releasing agents; compatibilizers; dispersants; crystallizing agents, such as mica, talc, kaoline, and the like; plasticizers, such as phosphate esters and the like; thermal stabilizers; antioxidants; anticoloring agents; UV absorbers; flowability modifiers; foaming agents; antimicrobial and/or antifouling agents; dust controlling agents; deodorants; sliding modifiers; antistatic agents, such as polyetheresteramide and the like; and combinations thereof. In certain embodiments, the rigid, semi-rigid, or flexible fiber-reinforced shells further comprise two or more additional components.

In some embodiments, the method further comprises forming the rigid, semi-rigid, or flexible fiber-reinforced shells. The rigid, semi-rigid, or flexible fiber-reinforced shells are typically formed by a molding process. Each rigid, semi-rigid, or flexible fiber-reinforced shell may be formed via independently selected techniques and/or methods. Accordingly, any one of the rigid, semi-rigid, or flexible fiber-reinforced shells may be formed by the same or different techniques and/or methods as any other of the rigid, semi-rigid, or flexible fiber-reinforced shells. Examples of suitable molding processes include: injection molding, such as injection compression molding, gas assisted injection molding, insert molding, and the like; blow molding; rotary molding; extrusion molding; press molding; transfer molding, such as resin transfer molding, resin injection molding, Seemann Composites Resin Infusion Molding Process, and the like; filament winding molding; autoclave molding; hand lay-up molding; and the like, and combinations thereof. In some embodiments, at least one of the rigid, semi-rigid, or flexible fiber-reinforced shells is formed via a single molding process, such as injection molding. In certain embodiments, at least one of the rigid, semi-rigid, or flexible fiber-reinforced shells is forming via more than one molding process, such as via a combination of extrusion and injection molding. In such certain embodiments, forming the rigid, semi-rigid, or flexible fiber-reinforced sheds may be performed in a single mold or multiple molds. In various embodiments, forming the first and second rigid, semi-rigid, or flexible fiber-reinforced shells comprises extruding the first and second rigid, semi-rigid, or flexible fiber-reinforced shells.

It is to be appreciated that the techniques and methods described above may be used to form the rigid, semi-rigid, or flexible fiber-reinforced shells as a single layer or a composite comprising multiple layers. In some embodiments, at least one of the rigid, semi-rigid, or flexible fiber-reinforced shells is formed from a single shot/pour to give a single layer. In certain embodiments, at least one of the rigid, semi-rigid, or flexible fiber-reinforced shells is formed from multiple shots/pours to give multiple layers, e.g. a composite. In these or other embodiments, one or more of the multiple layers is a reinforcing layer comprising steel, plastic, wood, resin, plastic, and the like, or combinations thereof.

In specific embodiments, the rigid, semi-rigid, or flexible fiber-reinforced shells comprise carbon fiber-reinforced epoxy and are formed by extrusion molding.

As introduced above, the method includes (i) positioning the first rigid, semi-rigid, or flexible fiber-reinforced shell partially about a portion of the external surface presented by the structural element to leave an exposed portion of the structural element.

Positioning the first rigid, semi-rigid, or flexible fiber-reinforced shell partially about the portion of the external surface presented by the structural element comprises disposing at least a portion of the interior surface of the first rigid, semi-rigid, or flexible fiber-reinforced shell into close proximity with the portion of the external surface presented by the structural element. The term "close proximity" as used herein is to be understood to refer to a close distance, and to encompass situations including abutting, adjoining, touching, being spaced apart, being contiguous, being adjacent, and the like, and combinations thereof. The close distance may be any distance suitable for reinforcing the structural element with the method described herein, and may be selected on a basis of: the shape, size, location, and/or type of the structural element; the shape and/or size of one or more of the fiber-reinforced shells; adhering one of the rigid, semi-rigid, or flexible fiber-reinforced sheds to another of the rigid, semi-rigid, or flexible fiber-reinforced shells and/or the structural element, as described in further detail below; or combinations thereof. In some embodiments, at least a portion of the interior surface of the first rigid, semi-rigid, or flexible fiber-reinforced shell is disposed about and contiguous to the external surface of the structural element. In certain embodiments, at least a portion of the interior surface of the first rigid, semi-rigid, or flexible fiber-reinforced shell is disposed about and spaced apart from the external surface of the structural element, e.g. to define a gap therebetween. In both such instances, the first rigid, semi-rigid, or flexible fiber-reinforced shell may be considered adjacent the structural element.

In some embodiments, the interior surface of the first rigid, semi-rigid, or flexible fiber-reinforced shell is shaped complementarily to at least a portion of the external surface presented by the structural element. By complementary shape, it is meant that the interior surface of the first rigid, semi-rigid, or flexible fiber-reinforced shell and the external surface of the structural element are similar in shape and dimension. In such some embodiments, positioning the first rigid, semi-rigid, or flexible fiber-reinforced shell partially about the portion of the external surface presented by the structural element typically comprises disposing the interior surface of the first rigid, semi-rigid, or flexible fiber-reinforced shell into close proximity with (i.e., adjacent to) the portion of external surface presented by the structural element that is complimentary to the interior surface of the first rigid, semi-rigid, or flexible fiber-reinforced shell.

The method also includes (ii) positioning the second rigid, semi-rigid, or flexible fiber-reinforced shell about the exposed portion of the structural element.

Positioning the second rigid, semi-rigid, or flexible fiber-reinforced shell about the exposed portion of the structural element comprises disposing at least a portion of the interior surface of the second rigid, semi-rigid, or flexible fiber-reinforced shell into close proximity with (i.e., adjacent to) the exposed portion of the external surface of the structural element. In some embodiments, the interior surface of the second rigid, semi-rigid, or flexible fiber-reinforced shell is shaped complementarily to at least a portion of the exposed portion of the external surface of the structural element. In such some embodiments, positioning the second rigid, semi-rigid, or flexible fiber-reinforced shell about the exposed portion of the structural element typically comprises disposing the interior surface of the second rigid, semi-rigid, or flexible fiber-reinforced shell into close proximity with the portion of the shape presented by the exposed portion of the external surface of the structural element that is complimentary to the interior surface of the first rigid, semi-rigid, or flexible fiber-reinforced shell. In some embodiments, at least a portion of the interior surface of the second rigid, semi-rigid, or flexible fiber-reinforced shell is disposed about and contiguous to the external surface of the structural element. In certain embodiments, at least a portion of the interior surface of the second rigid, semi-rigid, or flexible fiber-reinforced shell is disposed about and spaced from the external surface of the structural element, e.g. to define a gap therebetween.

Positioning the second rigid, semi-rigid, or flexible fiber-reinforced shell about the exposed portion of the structural element also comprises disposing the first edge of the second rigid, semi-rigid, or flexible fiber-reinforced shell adjacent to the first edge of the first rigid, semi-rigid, or flexible fiber-reinforced shell to give a first seam and disposing the second edge of the second rigid, semi-rigid, or flexible fiber-reinforced shell adjacent to the second edge of the first rigid, semi-rigid, or flexible fiber-reinforced shell to give a second seam, thereby enveloping at least a portion of the structural element. The first and/or second edges of the first and second rigid, semi-rigid, or flexible fiber-reinforced shells may be disposed contiguous to, overlapping with, or spaced apart from one another, or combinations thereof. In some embodiments, the first and/or second edges of the first and second rigid, semi-rigid, or flexible fiber-reinforced shells are disposed contiguous to one another. In certain embodiments, the first and/or second edges of the first and second rigid, semi-rigid, or flexible fiber-reinforced shells are disposed adjacent to, but not touching, one another. In specific embodiments, the first and/or second and/or second edges of the first and second rigid, semi-rigid, or flexible fiber-reinforced shells are disposed overlapping one another.

It is to be appreciated that the widths of the first and second rigid, semi-rigid, or flexible fiber-reinforced shells determine the orientation of the first and second seams, with respect to one another, about the axis A. For example, where the widths of the first and second rigid, semi-rigid, or flexible fiber-reinforced shells are substantially equal, the first and second seams are substantially opposite one another about the axis A. Typically, the first and second seams are arranged about the axis A in an orientation of from 170 to 190, alternatively from 175 to 185, alternatively of 180, degrees with respect to one another. This orientation of the seams, relative to each other, may depend on the number of layers of shells.

The method further includes (iii) adhering the first and second rigid, semi-rigid, or flexible fiber-reinforced shells to the structural element.

Adhering the first and second rigid, semi-rigid, or flexible fiber-reinforced shells to the structural element typically comprises applying a first adhesive between the interior surfaces of the first and second rigid, semi-rigid, or flexible fiber-reinforced shells and the external surface presented by the structural element. The first adhesive can be applied by any means, such as via brushing, rolling, spraying, pumping, and the like. The first adhesive can be applied manually or by an automated process. In certain embodiments, the first adhesive is applied between the interior surfaces of the first and second rigid, semi-rigid, or flexible fiber-reinforced shells and the external surface presented by the structural element by pumping or spraying, such as via an applicator or spray gun. If the first and second rigid, semi-rigid, or flexible fiber-reinforced shells are positioned such that there is a gap between the first and second rigid, semi-rigid, or flexible fiber-reinforced shells and the exterior structural element, the first adhesive can be disposed in the gap by any such techniques. It is also to be appreciated that the first adhesive may be applied to the interior surfaces of the first and second rigid, semi-rigid, or flexible fiber-reinforced shells and the external surface of the structural element at any time, and in any order. For example, in some embodiments, the first adhesive may be applied to the interior surfaces of the first and second rigid, semi-rigid, or flexible fiber-reinforced shells prior to such shells being positioned about the structural element. In these or other embodiments, the first adhesive may be applied to the interior surfaces of the first and second rigid, semi-rigid, or flexible fiber-reinforced shells subsequent to such shells being positioned about the structural element. In some embodiments, the first adhesive may be applied to the external surface of the structural element prior to the first and second rigid, semi-rigid, or flexible fiber-reinforced shells such shells being positioned about the structural element.

The first adhesive can be any adhesive suitable for bonding the first and second rigid, semi-rigid, or flexible fiber-reinforced shells to the structural element, such as a cement, glue, resin, and the like. Further, the first adhesive can bond the first and second rigid, semi-rigid, or flexible fiber-reinforced shells to the structural element via chemical bonding, mechanical bonding, and combinations thereof. Typically, the first adhesive comprises a polymer, or a combination of components that are polymerized before, during, and/or after adhering the first and second rigid, semi-rigid, or flexible fiber-reinforced shells to the structural element. Accordingly, the first adhesive can be solvent based, such as a dispersion, emulsion, or solution.

Examples of suitable adhesives for use as the first adhesive include non-reactive adhesives, such as hot melt adhesives, drying adhesives, pressure-sensitive adhesives, contact adhesives, and the like, and reactive adhesives, such as single-component adhesives and multi-component adhesives. Specific examples of suitable adhesives include epoxies, polyurethanes, polyolefins, ethylene-vinyl acetates, polyamides, polyesters, styrene block copolymers, polycarbonates, fluoropolymers, silicone rubbers, and the like, and combinations thereof. Particular examples of suitable adhesives include adhesive carbon bond putties produced by Composite Construction LLC. In some embodiments, the first adhesive is a resin comprising an epoxy. In these or other embodiments, the first adhesive is a resin comprising an epoxy and an amine curing agent. In such embodiments, the first adhesive is typically applied as an uncured resin.

In certain embodiments, the method further comprises repeating (i)-(iii) described above, along the distance of the structural element between the first and second ends with additional rigid, semi-rigid, or flexible fiber-reinforced shells. In such certain embodiments, pairs of the additional rigid, semi-rigid, or flexible fiber-reinforced shells may be positioned along the distance of the structural element such that the first and/or second ends of one pair of the additional rigid, semi-rigid, or flexible fiber-reinforced shells is adjacent the first and/or second end of another pair of the additional rigid, semi-rigid, or flexible fiber-reinforced shells (e.g. in a stacked arrangement). Multiple different stacked arrangements may be utilized together.

In certain embodiments, the method additionally comprises (iv) positioning the third rigid, semi-rigid, or flexible fiber-reinforced shell about at least one of the first and second seams, to leave the other of the first and second seams as an exposed seam. In such certain embodiments, positioning the third rigid, semi-rigid, or flexible fiber-reinforced shell about at least one of the first and second seams comprises disposing at least a portion of the interior surface of the third rigid, semi-rigid, or flexible fiber-reinforced shell into close proximity with the first or second seam, a portion of the exterior surface of the first rigid, semi-rigid, or flexible fiber-reinforced shell, and a portion of the exterior surface of the second rigid, semi-rigid, or flexible fiber-reinforced shell. In some embodiments, the interior surface of the third rigid, semi-rigid, or flexible fiber-reinforced shell is shaped complementarily to the portion of the exterior surface of the first rigid, semi-rigid, or flexible fiber-reinforced shell and the portion of the exterior surface of the second rigid, semi-rigid, or flexible fiber-reinforced shell. In specific embodiments, the method comprises positioning the third rigid, semi-rigid, or flexible fiber-reinforced shell about the first seam. In other embodiments, the method comprises positioning the third rigid, semi-rigid, or flexible fiber-reinforced shell about the second seam. In some embodiments, at least a portion of the interior surface of the third rigid, semi-rigid, or flexible fiber-reinforced shell is disposed about and contiguous to the exterior surface of the first and second rigid, semi-rigid, or flexible fiber-reinforced shells. In certain embodiments, at least a portion of the interior surface of the third rigid, semi-rigid, or flexible fiber-reinforced shell is disposed about and spaced apart from the exterior surface of the first and second rigid, semi-rigid, or flexible fiber-reinforced shells.

In further embodiments, the method also comprises (v) positioning the fourth rigid, semi-rigid, or flexible fiber-reinforced shell about the exposed seam.

Positioning the fourth rigid, semi-rigid, or flexible fiber-reinforced shell about the exposed seam typically comprises disposing the first edge of the fourth rigid, semi-rigid, or flexible fiber-reinforced shell adjacent to the first edge of the third rigid, semi-rigid, or flexible fiber-reinforced shell to give a third seam and disposing the second edge of the fourth rigid, semi-rigid, or flexible fiber-reinforced shell adjacent to the second edge of the third rigid, semi-rigid, or flexible fiber-reinforced shell to give a fourth seam, thereby enveloping the first and second rigid, semi-rigid, or flexible fiber-reinforced shells with the third and fourth rigid, semi-rigid, or flexible fiber-reinforced shells. The first and/or second edges of the third and fourth rigid, semi-rigid, or flexible fiber-reinforced shells may be disposed contiguous to, overlapping with, or spaced apart from one another, or combinations thereof. In some embodiments, the first and/or second edges of the third and fourth rigid, semi-rigid, or flexible fiber-reinforced shells are disposed contiguous to one another. In other embodiments, the first and/or second edges of the third and fourth rigid, semi-rigid, or flexible fiber-reinforced shells are disposed adjacent to, but not touching, one another. In specific embodiments, the first and/or second edges of the first and second rigid, semi-rigid, or flexible fiber-reinforced shells are disposed overlapping one another.

In some embodiments, at least a portion of the interior surface of the fourth rigid, semi-rigid, or flexible fiber-reinforced shell is disposed about and contiguous to the exterior surface of the first and second rigid, semi-rigid, or flexible fiber-reinforced shells. In certain embodiments, at least a portion of the interior surface of the fourth rigid, semi-rigid, or flexible fiber-reinforced shell is disposed about and spaced apart from the exterior surface of the first and second rigid, semi-rigid, or flexible fiber-reinforced shells.

It is to be appreciated that the widths of the third and fourth rigid, semi-rigid, or flexible fiber-reinforced shells determine the orientation of the third and fourth seems, with respect to one another, about the axis A. For example, where the widths of the third and fourth rigid, semi-rigid, or flexible fiber-reinforced shells are substantially equal, the third and fourth seams are substantially opposite one another about the axis A. Typically, the third and fourth seams are arranged about the axis A in an orientation of from 170 to 190, alternatively from 175 to 185, alternatively of 180, degrees with respect to one another. This orientation of the seams, relative to each other, may depend on the number of layers of shells.

The third and fourth seams may be offset relative to the first and second seams about the axis A. In particular embodiments, the third and fourth seams are offset about 90 degrees, relative to the first and second seams, about the axis A, such that each of the first, second, third, and fourth seams is spaced about 90 degrees from one another about the axis A. In such embodiments, the term "about 90 degrees" is used to refer to an offset from one another about the axis A of from 80 to 110, alternatively from 85 to 95, alternatively of 90, degrees.

It is to be appreciated that the third and fourth rigid, semi-rigid, or flexible fiber-reinforced shells may be the same as or different from the first and second rigid, semi-rigid, or flexible fiber-reinforced shells. In some embodiments, the third and fourth rigid, semi-rigid, or flexible fiber-reinforced shells are the same as the first and second rigid, semi-rigid, or flexible fiber-reinforced shells but with a larger perimeter.

In further embodiments, the method also comprises (vi) adhering the third and fourth rigid, semi-rigid, or flexible fiber-reinforced shells about the first and second rigid, semi-rigid, or flexible fiber-reinforced shells.

Adhering the third and fourth rigid, semi-rigid, or flexible fiber-reinforced shells about the first and second rigid, semi-rigid, or flexible fiber-reinforced shells typically comprises applying a second adhesive between the interior surfaces of the third and fourth rigid, semi-rigid, or flexible fiber-reinforced shells and the exterior surfaces of the first and second rigid, semi-rigid, or flexible fiber-reinforced shells. The second adhesive can be applied by any means, such as via brushing, rolling, spraying, pumping, and the like. The second adhesive can be applied manually or by an automated process. In certain embodiments, the second adhesive is applied between the interior surfaces of the third and fourth rigid, semi-rigid, or flexible fiber-reinforced shells and the exterior surface of the first and second rigid, semi-rigid, or flexible fiber-reinforced shells by pumping or spraying, such as via an applicator or spray gun. It is also to be appreciated that the second adhesive may be applied to the interior surfaces of the third and fourth rigid, semi-rigid, or flexible fiber-reinforced shells and the exterior surface of the first and second rigid, semi-rigid, or flexible fiber-reinforced shells at any time, and in any order. For example, in some embodiments, the second adhesive may be applied to the interior surfaces of the third and fourth rigid, semi-rigid, or flexible fiber-reinforced shells prior to such shells being positioned about the first and second rigid, semi-rigid, or flexible fiber-reinforced shells. In these or other embodiments, the second adhesive may be applied to the interior surfaces of the third and fourth rigid, semi-rigid, or flexible fiber-reinforced shells subsequent to such shells being positioned about the first and second rigid, semi-rigid, or flexible fiber-reinforced shells. In some embodiments, the second adhesive may be applied to the exterior surface of the first and second rigid, semi-rigid, or flexible fiber-reinforced shells prior to the third and fourth rigid, semi-rigid, or flexible fiber-reinforced shells such shells being positioned about the first and second rigid, semi-rigid, or flexible fiber-reinforced shells.

The second adhesive can be any adhesive suitable for bonding the third and fourth rigid, semi-rigid, or flexible fiber-reinforced shells to the first and second rigid, semi-rigid, or flexible fiber-reinforced shells, such as a cement, glue, resin, and the like. Further, the second adhesive can bond the third and fourth rigid, semi-rigid, or flexible fiber-reinforced shells to the first and second rigid, semi-rigid, or flexible fiber-reinforced shells via chemical bonding, mechanical bonding, and combinations thereof. Typically, the second adhesive comprises a polymer, or a combination of components that are polymerized before, during, and/or after adhering the third and fourth rigid, semi-rigid, or flexible fiber-reinforced shells to the first and second rigid, semi-rigid, or flexible fiber-reinforced shells. Accordingly, the second adhesive can be solvent based, such as a dispersion, emulsion, or solution.

Examples of suitable adhesives for use as the second adhesive include non-reactive adhesives, such as hot melt adhesives, drying adhesives, pressure-sensitive adhesives, contact adhesives, and the like, and reactive adhesives, such as single-component adhesives and multi-component adhesives. Specific examples of suitable adhesives include epoxies, polyurethanes, polyolefins, ethylene-vinyl acetates, polyamides, polyesters, styrene block copolymers, polycarbonates, fluoropolymers, silicone rubbers, and the like, and combinations thereof. Particular examples of suitable adhesives for use as the second adhesive include adhesive carbon bond putties produced by Composite Construction LLC. In some embodiments, the second adhesive is a resin comprising an epoxy. In these or other embodiments, the second adhesive is a resin comprising an epoxy and an amine curing agent. In such embodiments, the second adhesive is typically applied as an uncured resin. It is to be appreciated that the second adhesive may be the same or different from the first adhesive. As such, in some embodiments, the first and second adhesives are the same. In other embodiments, the first and second adhesives are different.

In certain embodiments, the method further comprises repeating (iv) through (vi) described above, along the length of the structural element between the first and second ends with additional pairs of the rigid, semi-rigid, or flexible fiber-reinforced shells.

It is to be appreciated that (iv) through (vi) can be repeated using the additional pairs of the rigid, semi-rigid, or flexible fiber-reinforced shells. For example, the method may additionally comprise (vii) positioning a fifth rigid, semi-rigid, or flexible fiber-reinforced shell about one of the third and fourth seams, (vii) positioning a sixth rigid, semi-rigid, or flexible fiber-reinforced shell about the other of the third and fourth seams, and (ix) adhering the fifth and sixth rigid, semi-rigid, or flexible fiber-reinforced shells to the third and fourth rigid, semi-rigid, or flexible fiber-reinforced shells, using any of the methods and materials described above.

It is also to be appreciated that the method can be repeated to reinforce any or all portions of the structural element. For example, in some embodiments, the method is used to reinforce the entire distance between the first and second ends of the structural element. In other embodiments, the method is used to reinforce only a portion of the distance between the first and second ends of the structural element. Furthermore, the method can be used to reinforce any number of different portions of the structural element. Accordingly, the rigid, semi-rigid, or flexible fiber-reinforced shells may envelop the entire structural element, may envelop only a portion, or may envelop multiple portions of the structural element. In some embodiments, the rigid, semi-rigid, or flexible fiber-reinforced shells envelop the first and/or second end of the structural element such that the first or second ends of the rigid, semi-rigid, or flexible fiber-reinforced shells are conterminal with the first and/or second end of the structural element. In certain embodiments, the rigid, semi-rigid, or flexible fiber-reinforced shells envelop the first and/or second end of the structural element such that the first or second ends of the rigid, semi-rigid, or flexible fiber-reinforced shells extend for a distance past the first and/or second end of the structural element along the axis A.

It is further to be appreciated that the rigid, semi-rigid, or flexible fiber-reinforced shells may be disposed about the structural element in any configuration. For example, the first and second ends of both the first or second rigid, semi-rigid, or flexible fiber-reinforced shells of any one pair of rigid, semi-rigid, or flexible fiber-reinforced shells may be aligned or misaligned, such as in a conterminal configuration, staggered configuration, or combinations thereof. In some embodiments, the first and second ends of both the first and second rigid, semi-rigid, or flexible fiber-reinforced shells of any one pair rigid, semi-rigid, or flexible fiber-reinforced shells are aligned in a conterminal configuration. In specific embodiments, the first and second ends of both the first and second rigid, semi-rigid, or flexible fiber-reinforced shells of any one pair rigid, semi-rigid, or flexible fiber-reinforced shells are misaligned, such that the rigid, semi-rigid, or flexible fiber-reinforced shells are oriented about the structural element in a staggered configuration. In some embodiments, any of the first and/or second ends of any of the rigid, semi-rigid, or flexible fiber-reinforced shells may be conterminal or staggered with respect to any other of the first and/or second ends of any of the rigid, semi-rigid, or flexible fiber-reinforced shells.

With reference to the specific embodiment of the Figures, wherein like numerals generally indicate like parts throughout the several views, FIG. 1 shows a first pair of rigid, semi-rigid, or flexible fiber-reinforced shells that comprises a first rigid, semi-rigid, or flexible fiber-reinforced shell 12 and a second rigid, semi-rigid, or flexible fiber-reinforced shell 14, which are positioned to form a first seam 16 and a second seam 18. FIG. 1 also shows a second pair of rigid, semi-rigid, or flexible fiber-reinforced shells 20 disposed about the first pair of rigid, semi-rigid, or flexible fiber-reinforced shells 10. The second pair of rigid, semi-rigid, or flexible fiber-reinforced shells 20 comprises a third rigid, semi-rigid, or flexible fiber-reinforced shell 22 and a fourth rigid, semi-rigid, or flexible fiber-reinforced shell 24, which are positioned to form a third seam 26 and a fourth seam (not shown).

Figure 2:
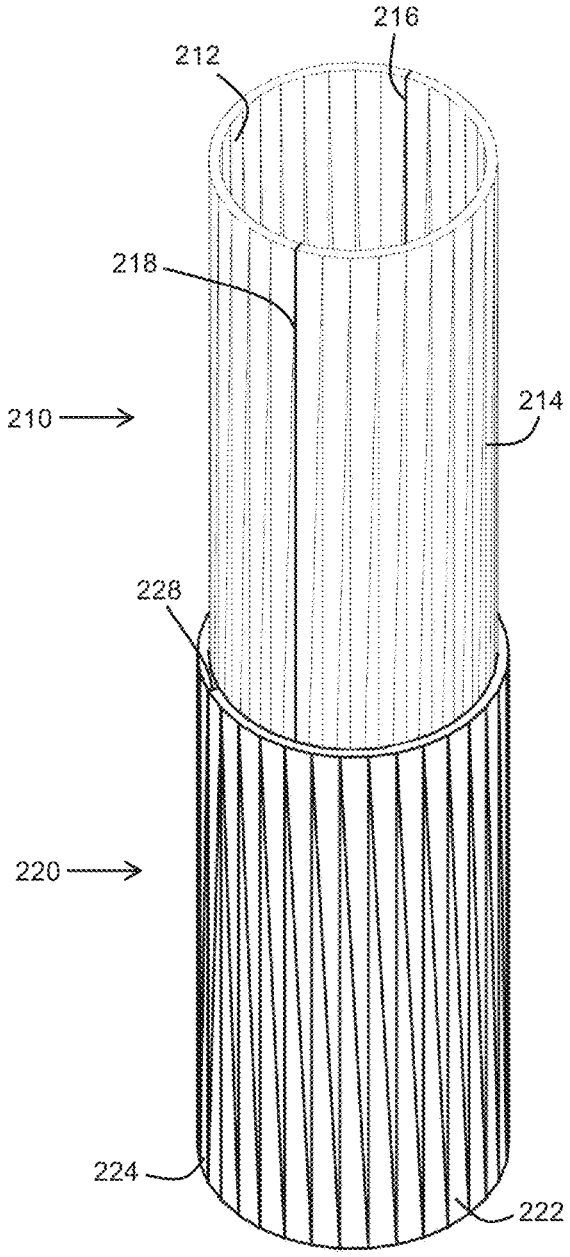
FIG. 2 shows a third pair of rigid, semi-rigid, or flexible fiber-reinforced shells and a fourth pair of rigid, semi-rigid, or flexible fiber-reinforced shells disposed about the third pair of rigid, semi-rigid, or flexible fiber-reinforced shells.

FIG. 2 shows a third pair of rigid, semi-rigid, or flexible fiber-reinforced shells 210 comprising a fifth rigid, semi-rigid, or flexible fiber-reinforced shell 212 and a sixth rigid, semi-rigid, or flexible fiber-reinforced shell 214, which are positioned to form a fifth seam 216 and a sixth seam 218. FIG. 2 also shows a fourth pair of rigid, semi-rigid, or flexible fiber-reinforced shells 220 disposed about the third pair of rigid, semi-rigid, or flexible fiber-reinforced shells. The fourth pair rigid, semi-rigid, or flexible fiber-reinforced shells 220 comprises a seventh rigid, semi-rigid, or flexible fiber-reinforced shell 222 and an eighth rigid, semi-rigid, or flexible fiber-reinforced shell 224, which are positioned to form a seventh seam (not shown) and a eighth seam 228.

Figure 3:
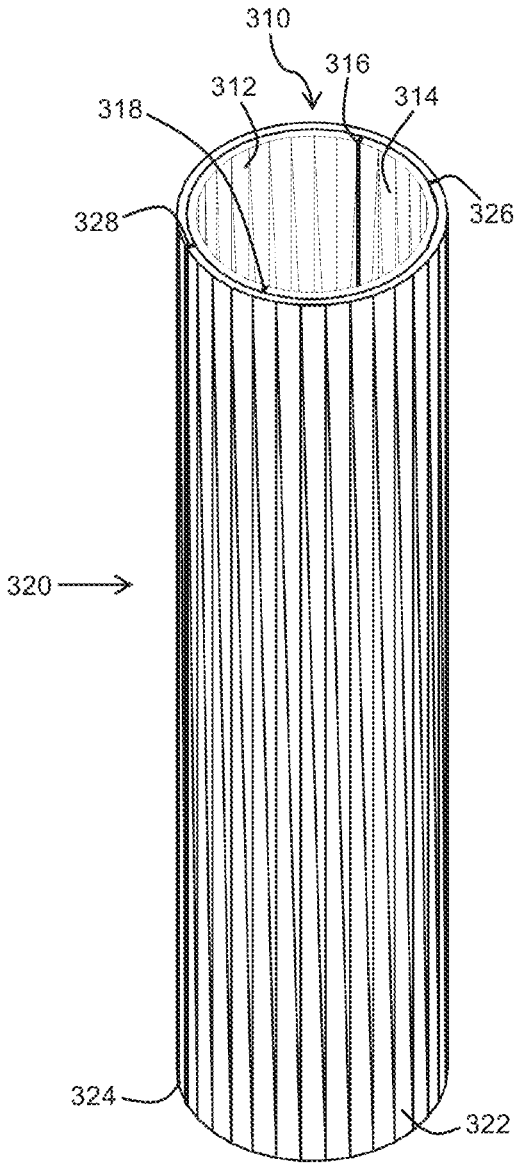
FIG. 3 shows a fifth pair of rigid, semi-rigid, or flexible fiber-reinforced shells and a sixth pair of rigid, semi-rigid, or flexible fiber-reinforced shells disposed about the fifth pair of rigid, semi-rigid, or flexible fiber-reinforced shells.

FIG. 3 shows a fifth pair of rigid, semi-rigid, or flexible fiber-reinforced shells 310 comprising a ninth rigid, semi-rigid, or flexible fiber-reinforced shell 312 and a tenth rigid, semi-rigid, or flexible fiber-reinforced shell 314, which are positioned to form a ninth seam 316 and a tenth seam 318. FIG. 3 also shows a sixth pair of rigid, semi-rigid, or flexible fiber-reinforced shells 320 disposed about the fifth pair of rigid, semi-rigid, or flexible fiber-reinforced shells 310. The sixth pair of rigid, semi-rigid, or flexible fiber-reinforced shells 320 comprises an eleventh rigid, semi-rigid, or flexible fiber-reinforced shell 322 and a twelfth rigid, semi-rigid, or flexible fiber-reinforced shell 324, which are positioned to form a eleventh seam 326 and a twelfth seam 328.

Figure 4:
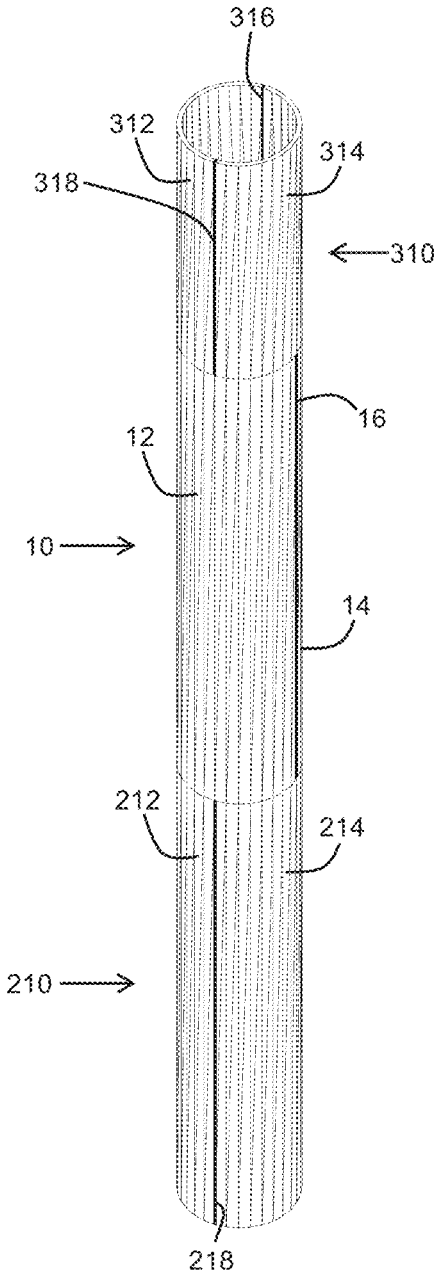
FIG. 4 shows the first, third, and fifth pairs of rigid, semi-rigid, or flexible fiber-reinforced shells positioned in a stacked arrangement.

FIG. 4 shows the first, third, and fifth pairs of rigid, semi-rigid, or flexible fiber-reinforced shells (10, 210, and 310, respectively) positioned in a stacked arrangement.

Figure 5:
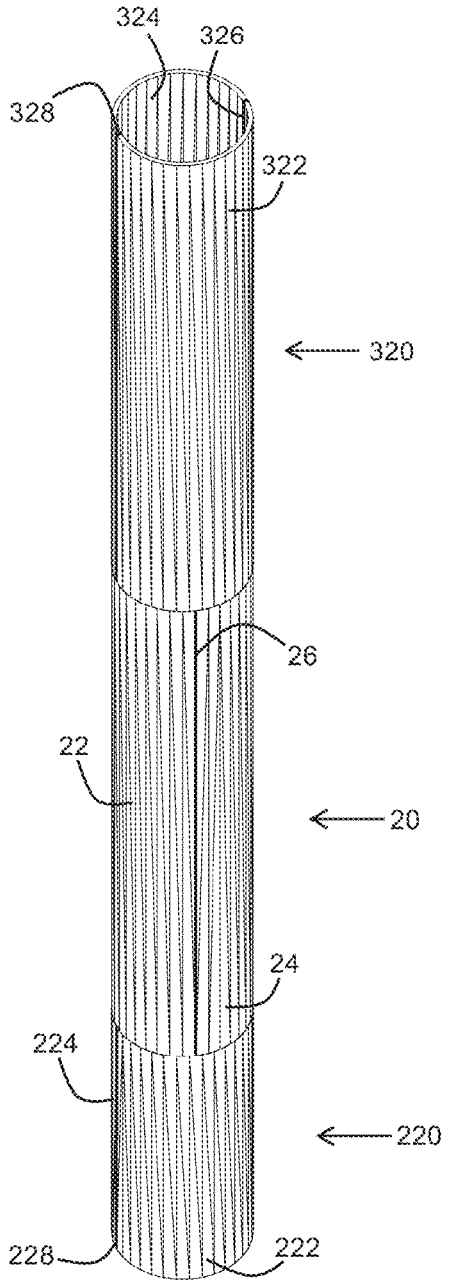
FIG. 5 shows the second, fourth, and sixth pairs of rigid, semi-rigid, or flexible fiber-reinforced shells positioned in a stacked arrangement.

FIG. 5 shows the second, fourth, and sixth pairs of rigid, semi-rigid, or flexible fiber-reinforced shells (20, 220, and 320, respectively) positioned in a stacked arrangement.

Figure 6:
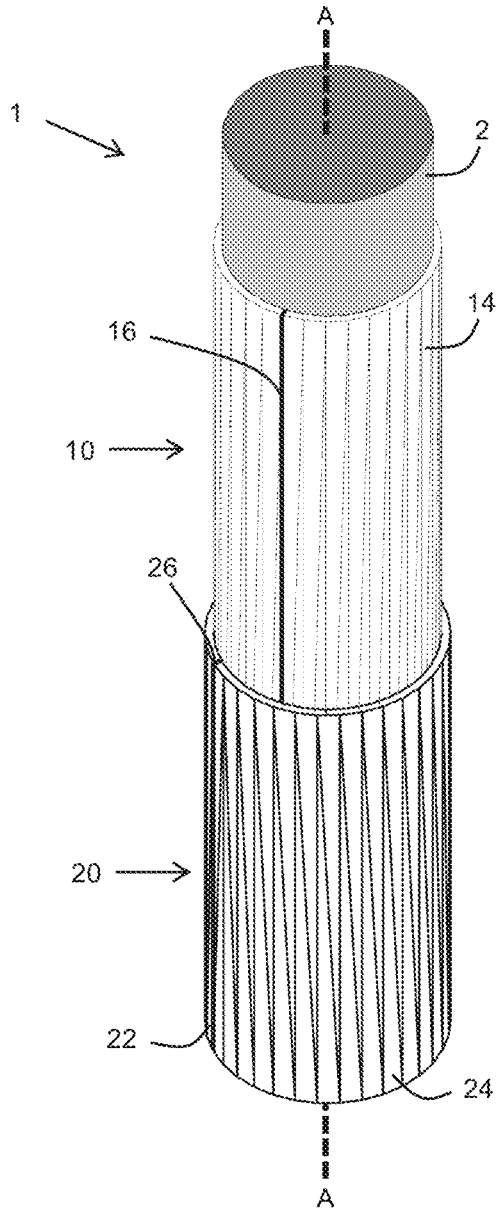
FIG. 6 shows a reinforced structural element formed in accordance with the method.
Figure 7:
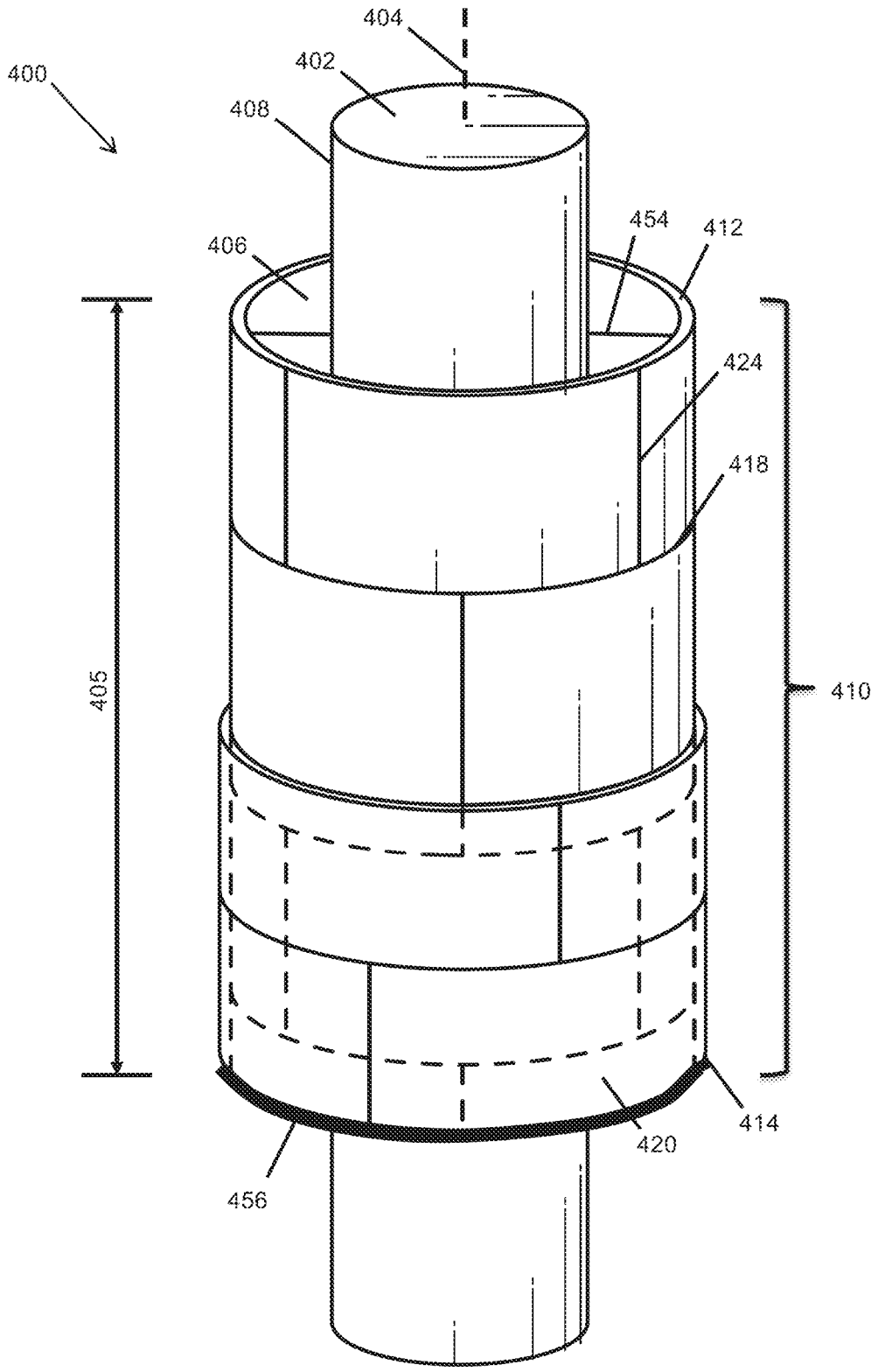
FIG. 7 shows a reinforced structural element of the present invention.
Figure 8A:
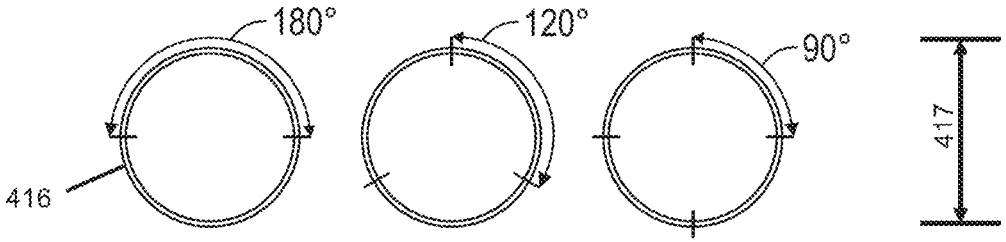
FIG. 8A shows segments of a segmented layer, made of reinforcing shells connected by vertical seams. The segment on the left has two reinforcing shells and two seams 180° apart. The segment in the center has three reinforcing shells and three seams 120° apart. The segment on the right has four reinforcing shells and four seams 90° apart.
Figure 8B:
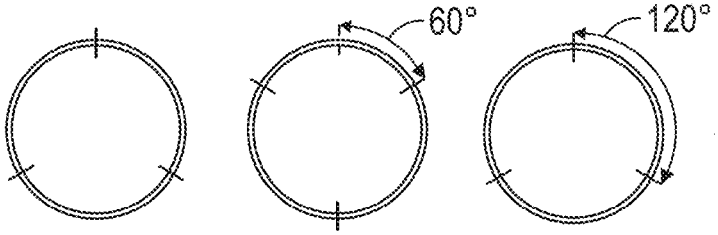
FIG. 8B shows an example staggering sequence for three consecutive segments of a segmented layer. The first segment, on the left, has an orientation such that a vertical seam is pointed towards the top of the page. The second segment in the center, has been rotated clockwise 60°, or half the 120° between the vertical seams. The third segment, on the right has been rotated an additional 60° clockwise for a total rotation from the original orientation of 120°. As such, the first and third segments have seams which are aligned, but each adjacent segment has vertical seams which are staggered relative to the other adjacent segment. This pattern repeats every third segment.
Figure 8C:
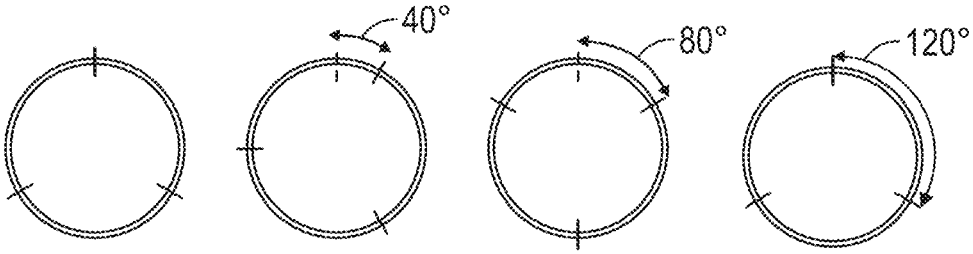
FIG. 8C shows an example staggering sequence for four consecutive segments of a segmented layer. The first segment, on the far left, has an orientation such that a vertical seam is pointed towards the top of the page. The second segment on the near left, has been rotated clockwise 40°, or a third of the 120° between the vertical seams. The third segment, on the near right has been rotated an additional 40° clockwise for a total rotation from the original orientation of 80°. The fourth segment, on the far right has been rotated an additional 40° clockwise for a total rotation from the original orientation of 120°. As such, the first and fourth segments have seams which are aligned, but each adjacent segment has vertical seams which are staggered relative to the other adjacent segment. This pattern repeats every fourth segment.
Figure 8D:
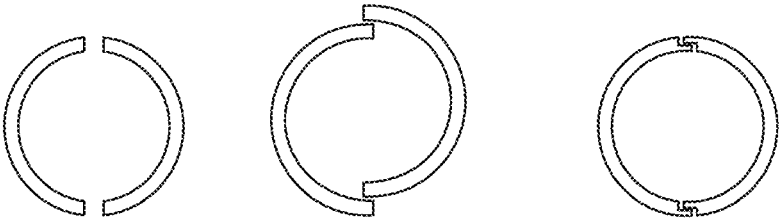
FIG. 8D shows three methods of joining reinforcing shells to form a segment. The segment on the left has butt joints. The segment in the center has full-thickness overlap joints. The segment on the right has half-thickness overlap joint.
Figure 8E:
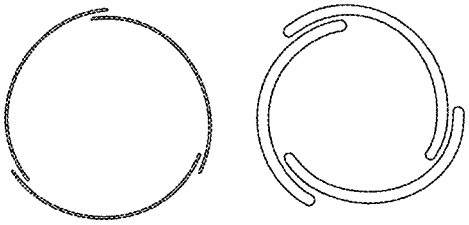
FIG. 8E shows that the thickness of the reinforcing shells may determine the amount of overlap required to form a strong bond. The segment on the left has thin reinforcing shells and a small overlap distance for each joint. The segment on the right has thicker reinforcing shells and a wider overlap distance for each joint.
Figure 9A:
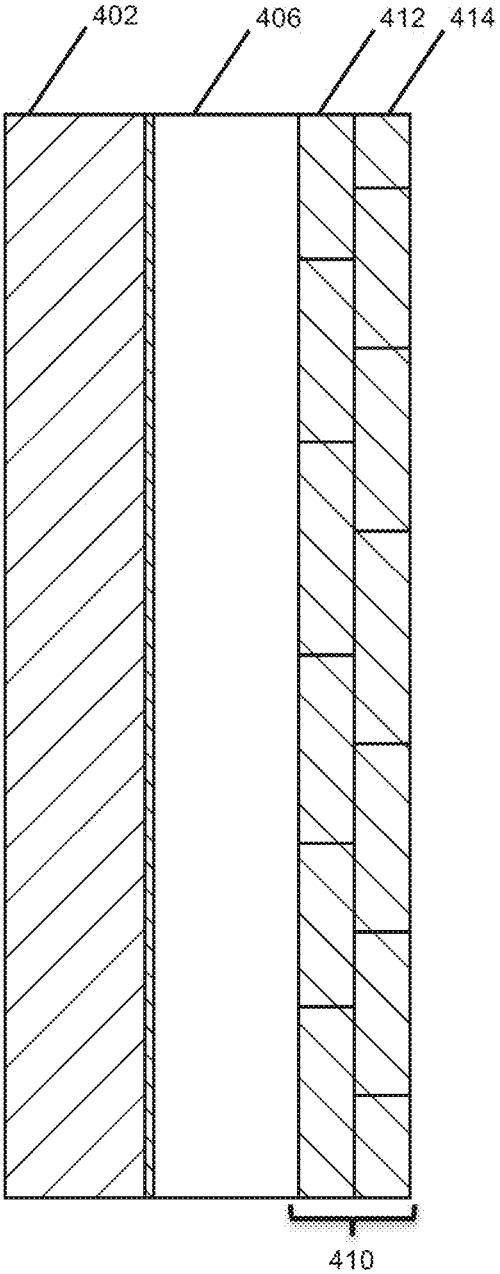
FIG. 9A shows a reinforced structural element having a sleeve structure with two segmented layers. The second layer has a half-height segment at each end, so that the horizontal seams of the first and second segmented layers are staggered by half the segment height.
Figure 9B:
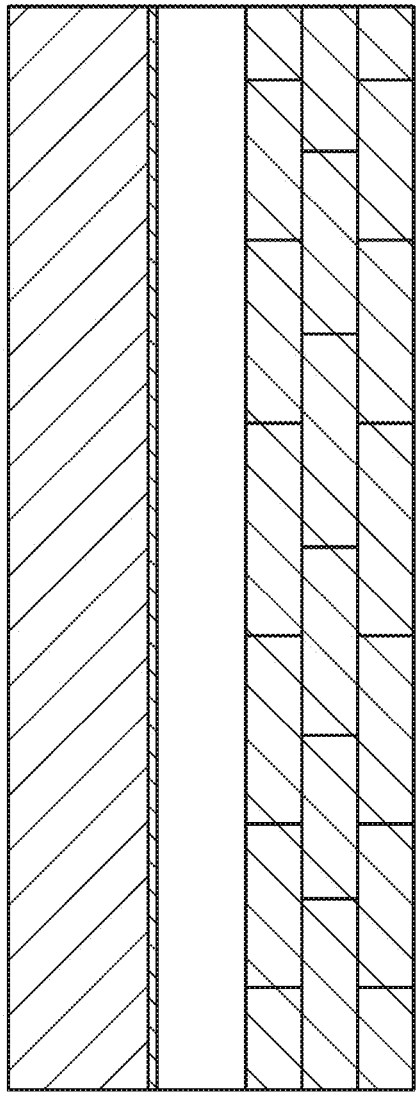
FIG. 9B shows a reinforced structural element having a sleeve structure with three segmented layers. The first and third layers have a half-height segment at each end, so that the horizontal seams of each adjacent layer are staggered by half the segment height. Alternatively, one-third and two-third height segments could be used at the ends such that each of the three layers had seams which were staggered from those of each other layer.
Figure 10:
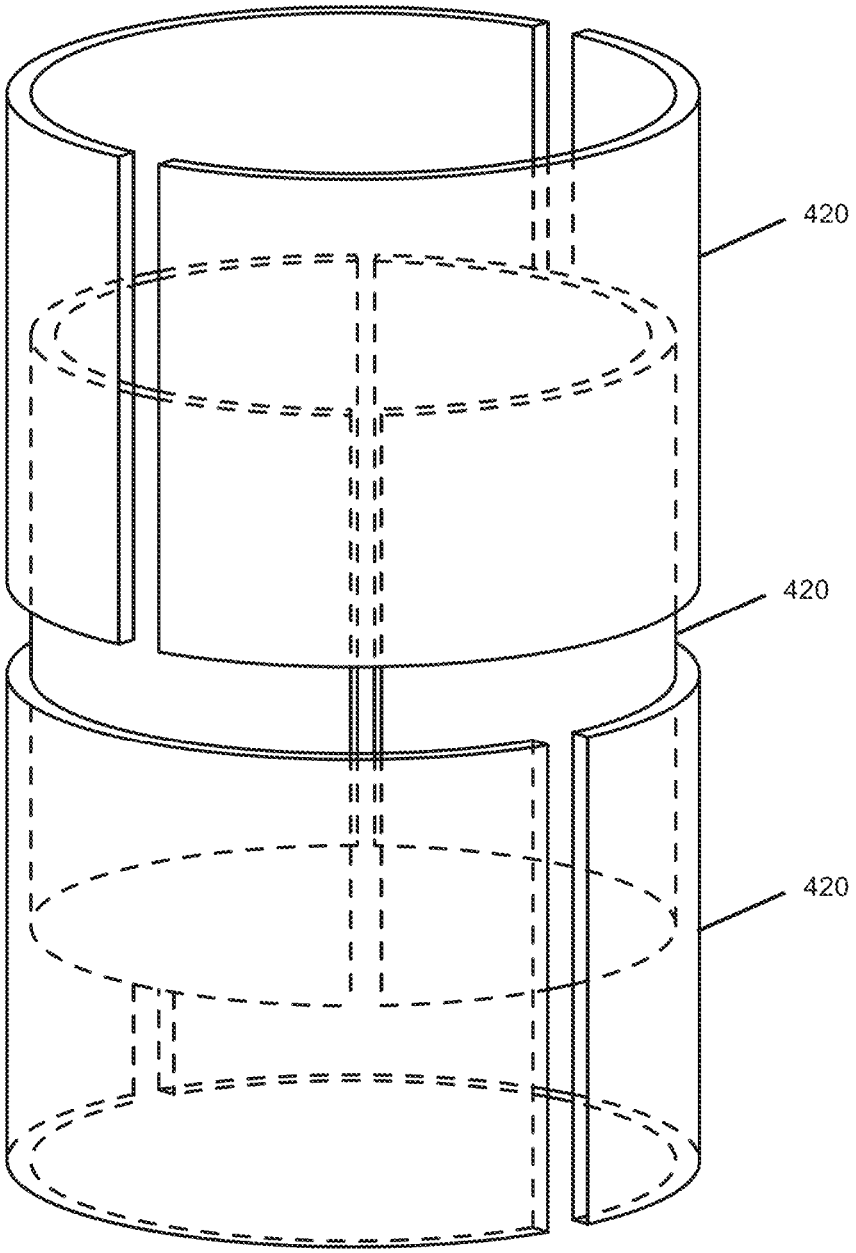
FIG. 10 shows that the vertical seams of each layer may additionally be staggered from the vertical seams of adjacent layers. The vertical seams of the two segments in the outer layer are staggered from each other by 90°. The vertical seams of the outer layer are additionally staggered by 45° from the vertical seams of the inner layer.
Figure 11A:
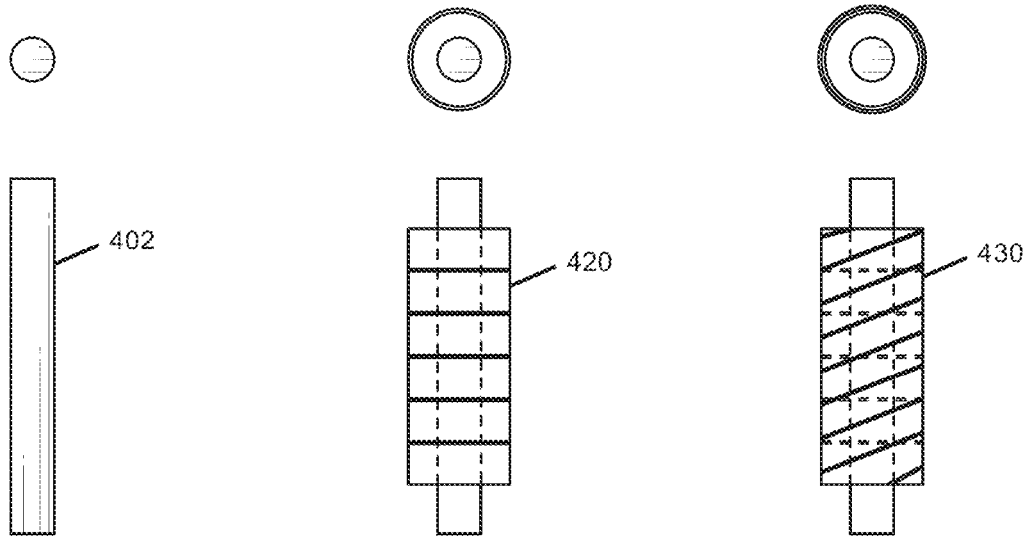
FIG. 11A shows a sequence for the reinforcement of a structural element. The left depicts the structural element alone. The center depicts the structural element with a surrounding sleeve structure formed of reinforcing shells. The right depicts the helical wrapping of the reinforcing shells with a flexible reinforcing material.
Figure 11B:
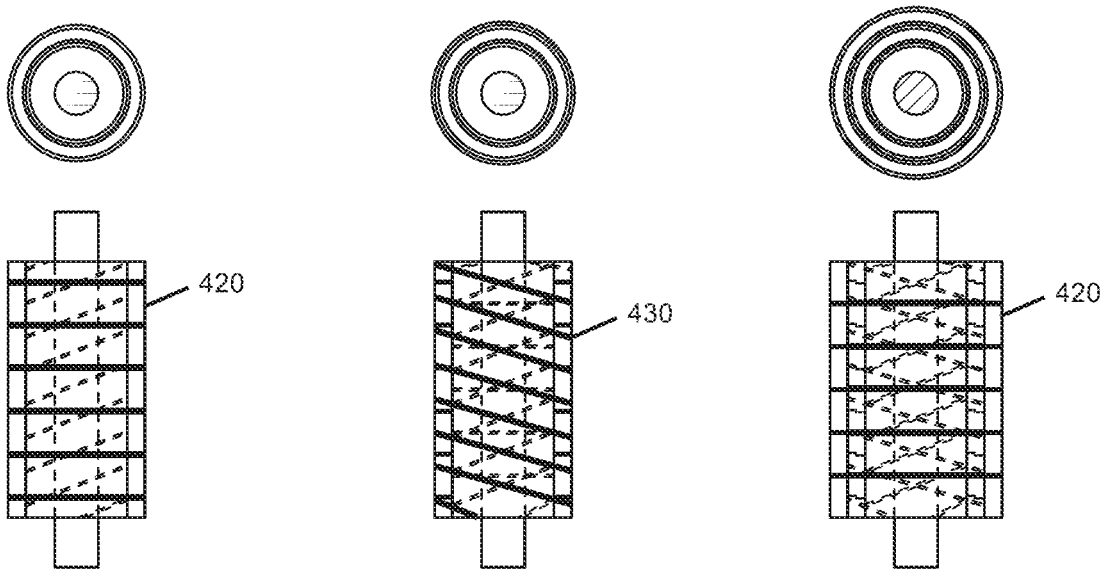
FIG. 11B shows a continued sequence for the reinforcement of the structural element of FIG. 11A. On the left, the sleeve structure is covered by an additional layer of reinforcing shells. In the center, the sleeve structure is covered by helical wrapping of the reinforcing shells with a flexible reinforcing material, where the wrapping is done in the opposite direction as in the first wrapped layer. On the right, the sleeve structure is covered by a third and layer of reinforcing shells.
Figure 12:
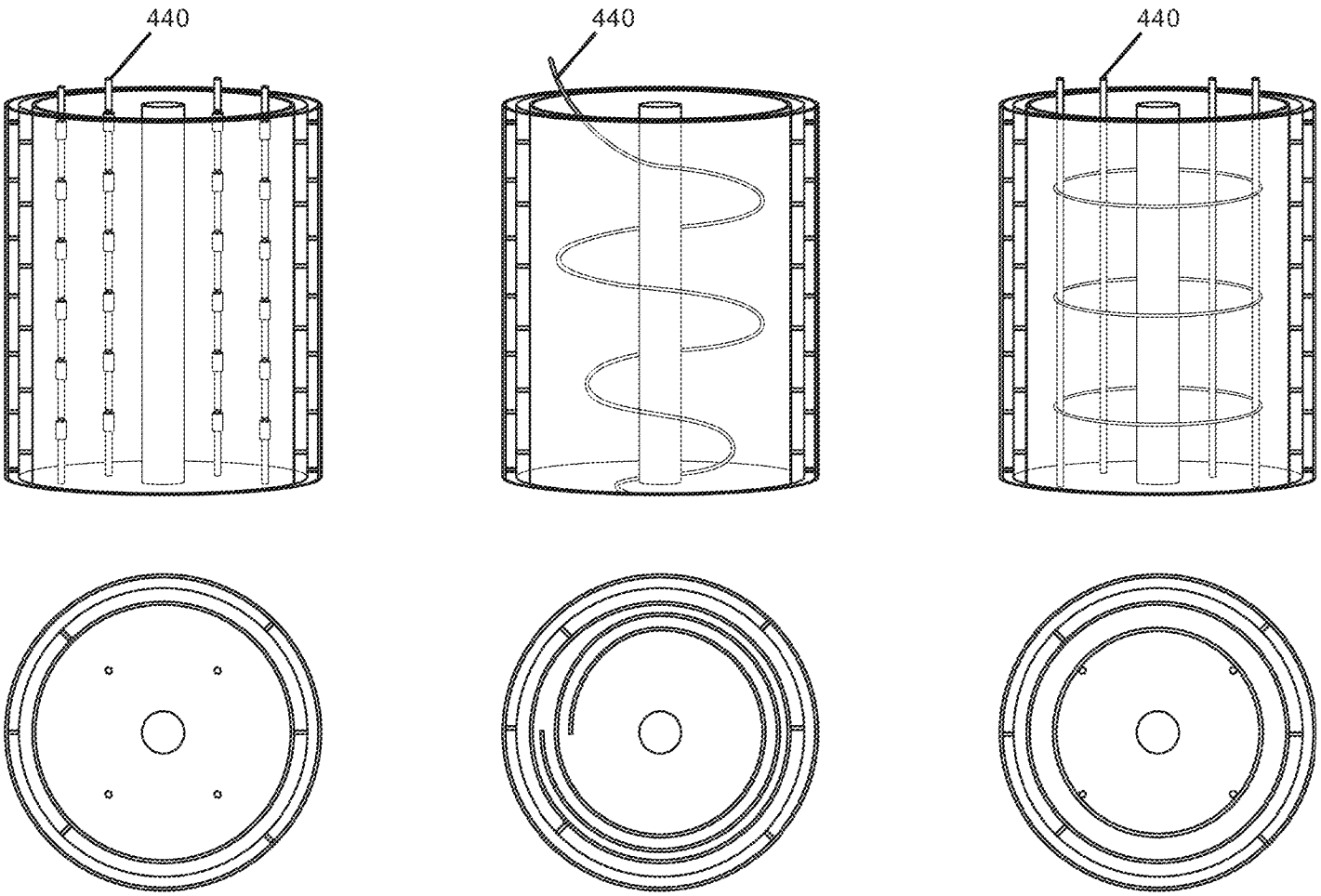
FIG. 12 shows examples of reinforced structural elements which include axial reinforcing members in the chamber between the sleeve structure and the structural element. On the left, the axial reinforcing members are vertical rods formed by coupled rebar segments. In the center, the axial reinforcing member is a helix which wraps around the structural element. On the right, the axial reinforcing members are vertical rods which are connected via circular reinforcing hoops.
Figure 13:
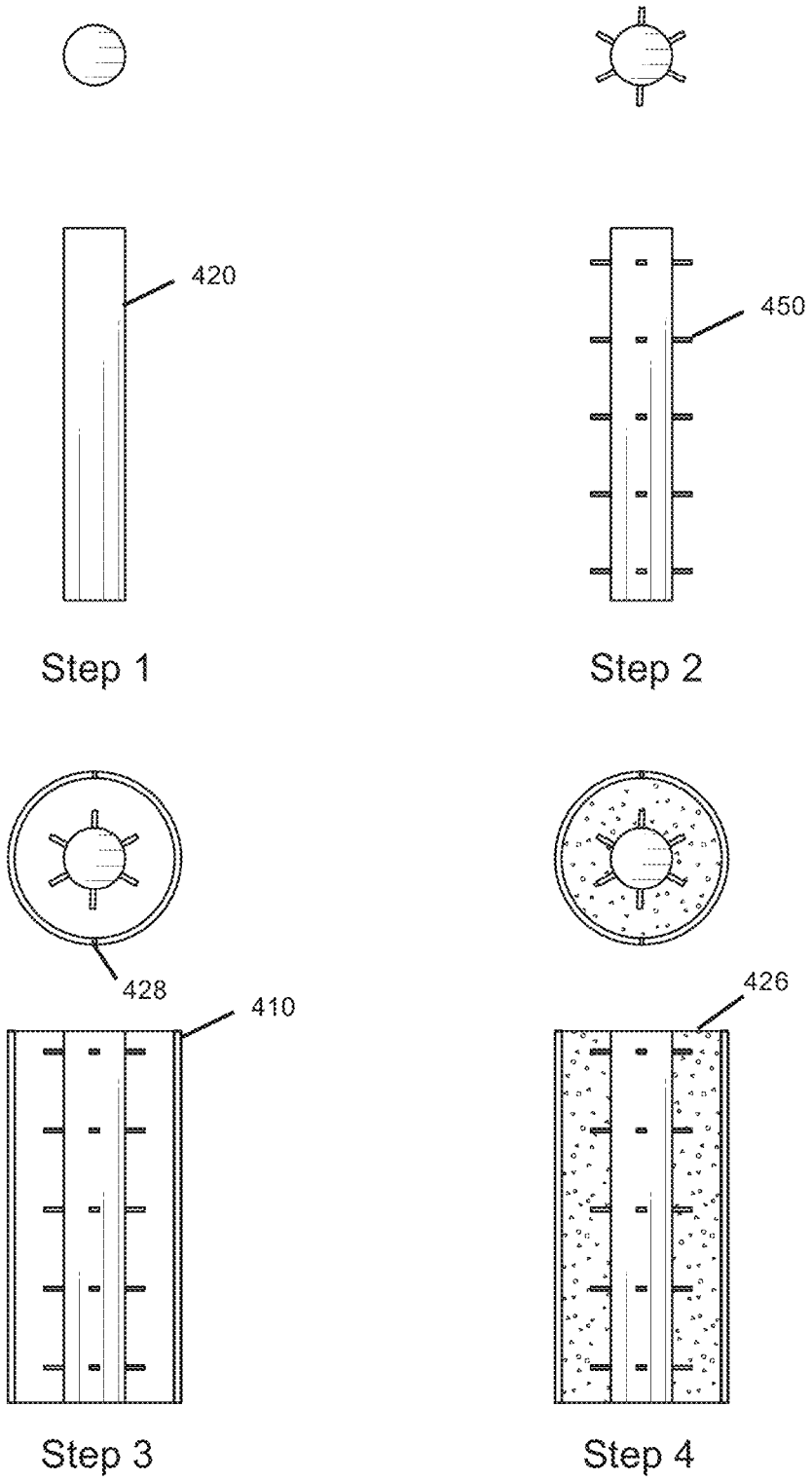
FIG. 13 shows a sequence for the reinforcement of a structural element. Step 1 shows the bare structural element. Step 2 shows the structural element with sheer keys drilled into the surface of the structural element. Step 3 shows the structural element surrounded by a sleeve structure. Step 4 shows the reinforced structural element with the chamber between the structural element and the sleeve structure filled with core filler material, which also encapsulates the sheer keys.
Figure 14:
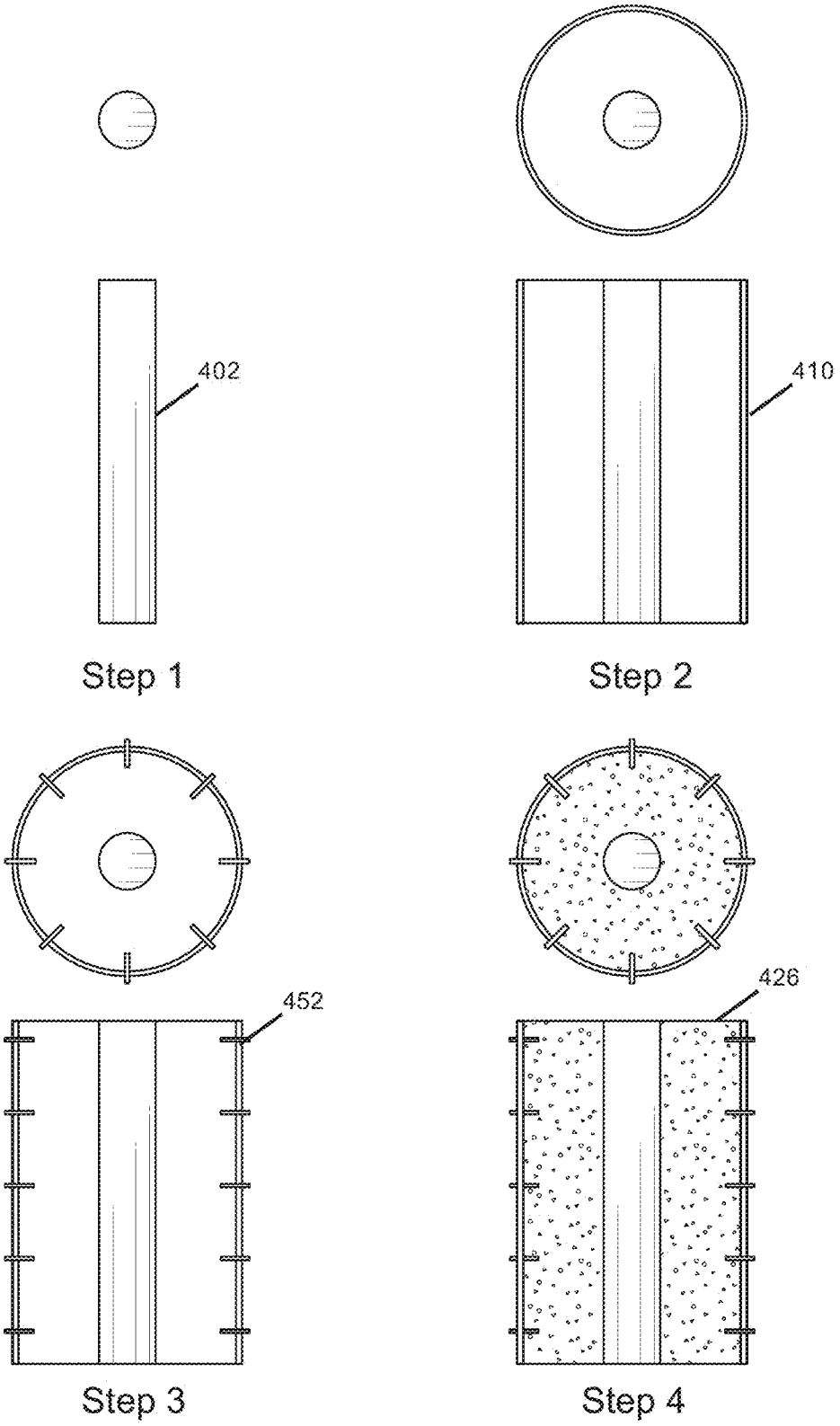
FIG. 14 shows a sequence for the reinforcement of a structural element. Step 1 shows the bare structural element. Step 2 shows the structural element surrounded by a sleeve structure. Step 3 shows the structural element with sheer key protrusions drilled into the sleeve structure. Step 4 shows the reinforced structural element with the chamber between the structural element and the sleeve structure filled with core filler material, which also encapsulates the sheer keys.
Figure 15:
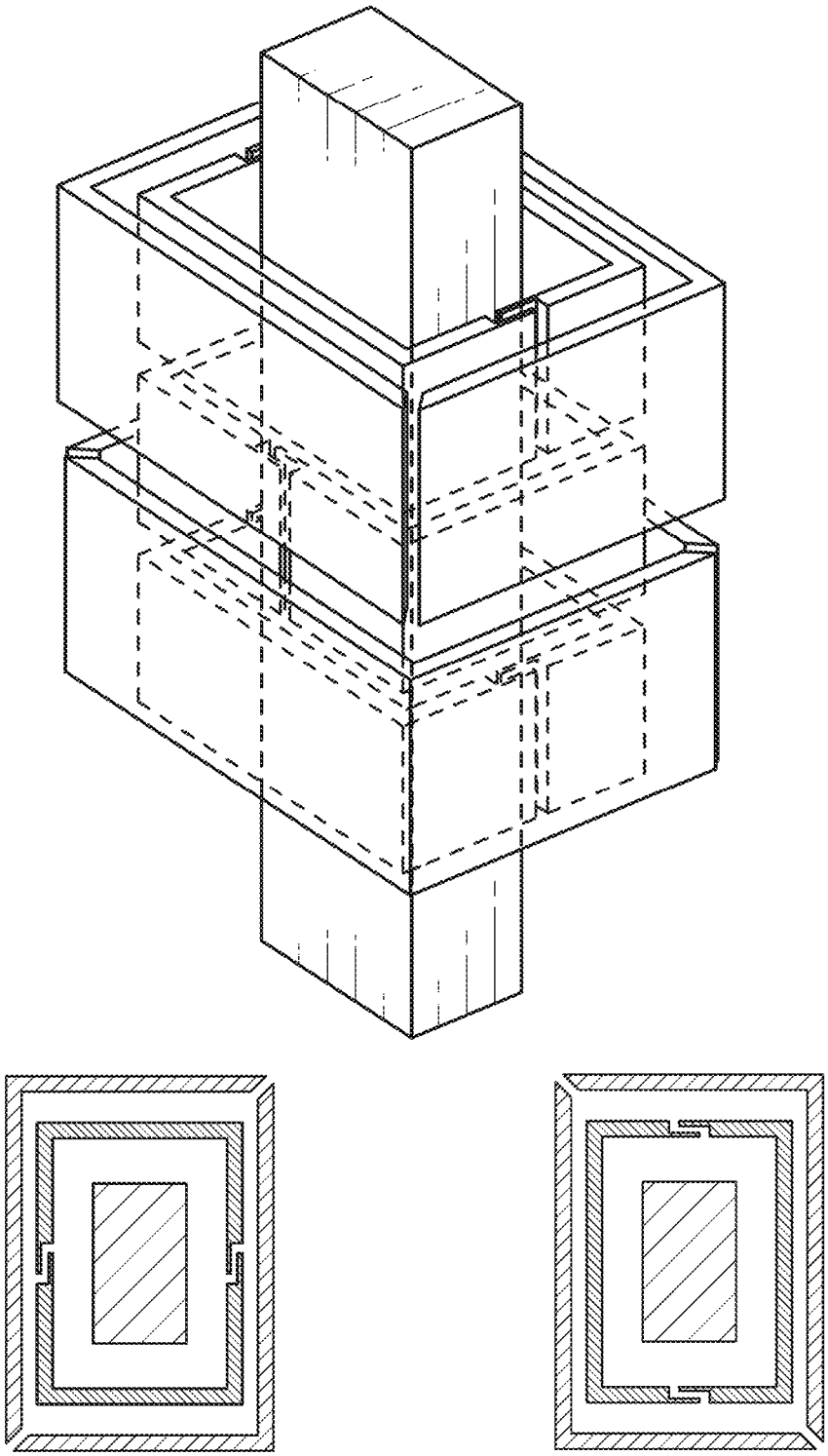
FIG. 15 shows the reinforcement of a rectangular structural element using a rectangular sleeve structure. The first layer of the rectangular sleeve structure has seams at the midpoint of the side of the rectangular sleeve structure and the second layer of the rectangular sleeve structure has seams at the corners of the rectangular sleeve structure. Note that the spacing between the first and second layers is not to scale, but rather expanded for clarity. These layers are in contact with only a thin layer of adhesive between them.

FIG. 6 shows a reinforced structural element 1 formed in accordance with the method exemplified with FIGS. 1-5. In particular, the reinforced structural element 1 comprises a structural element 2, the first pair of rigid, semi-rigid, or flexible fiber-reinforced shells 10, and the second pair of rigid, semi-rigid, or flexible fiber-reinforced shells 20. FIG. 6 also shows the first pair of rigid, semi-rigid, or flexible fiber-reinforced shells 10 disposed about the structural element 2, and the second pair of rigid, semi-rigid, or flexible fiber-reinforced shells 20 disposed about the first pair of rigid, semi-rigid, or flexible fiber-reinforced shells 10. The first pair of rigid, semi-rigid, or flexible fiber-reinforced shells 10 comprises the first rigid, semi-rigid, or flexible fiber-reinforced shell 12 and the second rigid, semi-rigid, or flexible fiber-reinforced shell 14, which are positioned to form the first seam 16 and the second seam 18 (not shown). The second pair of rigid, semi-rigid, or flexible fiber-reinforced shells 20 comprises the third rigid, semi-rigid, or flexible fiber-reinforced shell 22 and the fourth rigid, semi-rigid, or flexible fiber-reinforced shell 24, which are positioned to form the third seam 26 and the fourth seam (not shown).

Figure 16A:
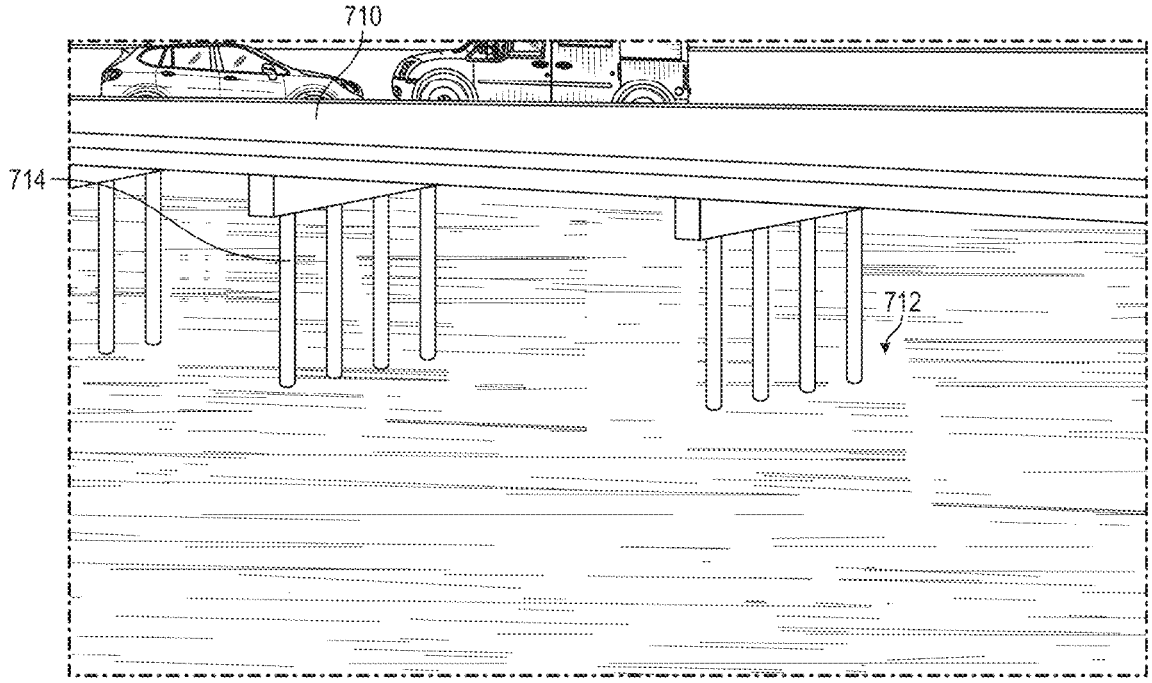
FIGS. 16A-16X show a method of reinforcing a marine pile.
Figure 16B:
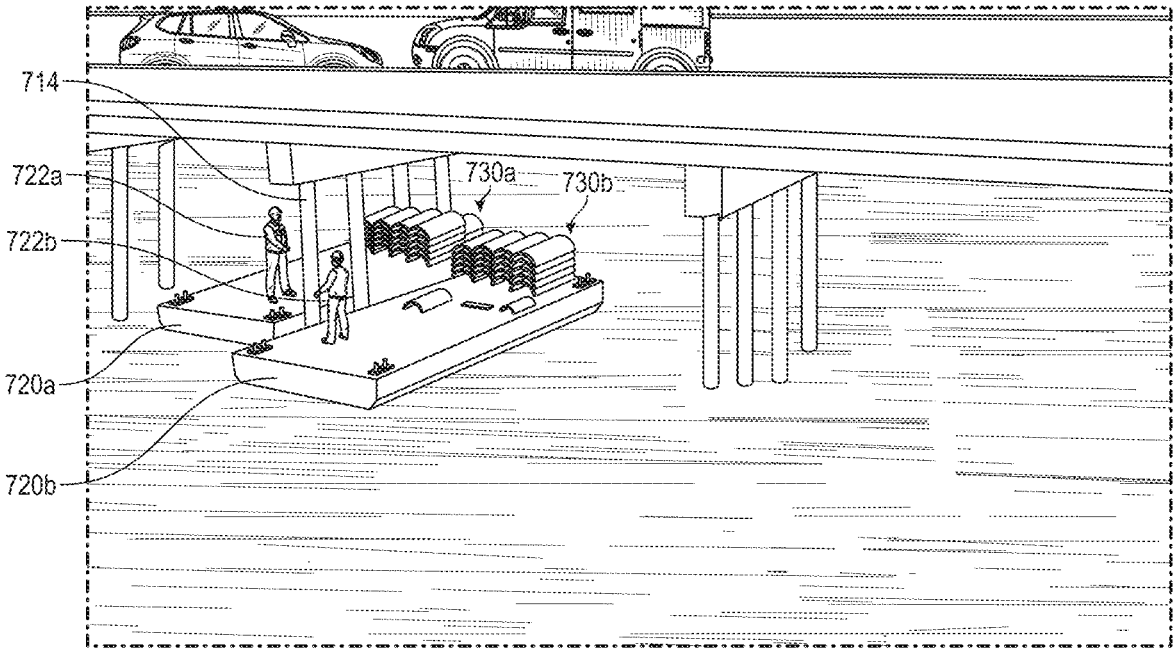
Figure 16C:
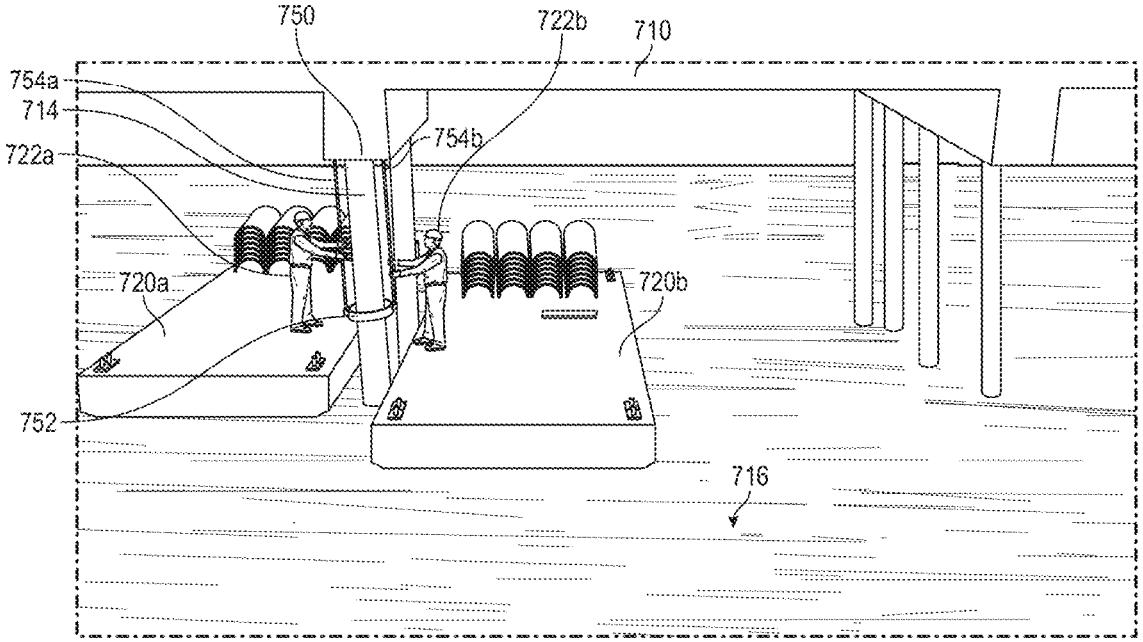
Figure 16D:
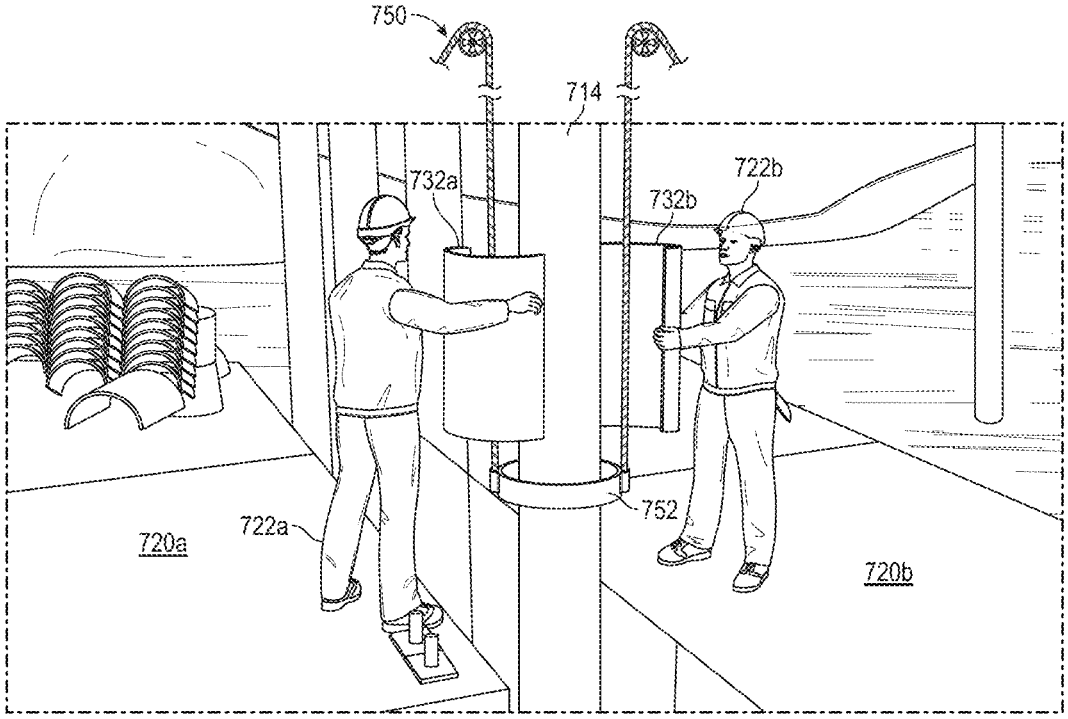
Figure 16E:
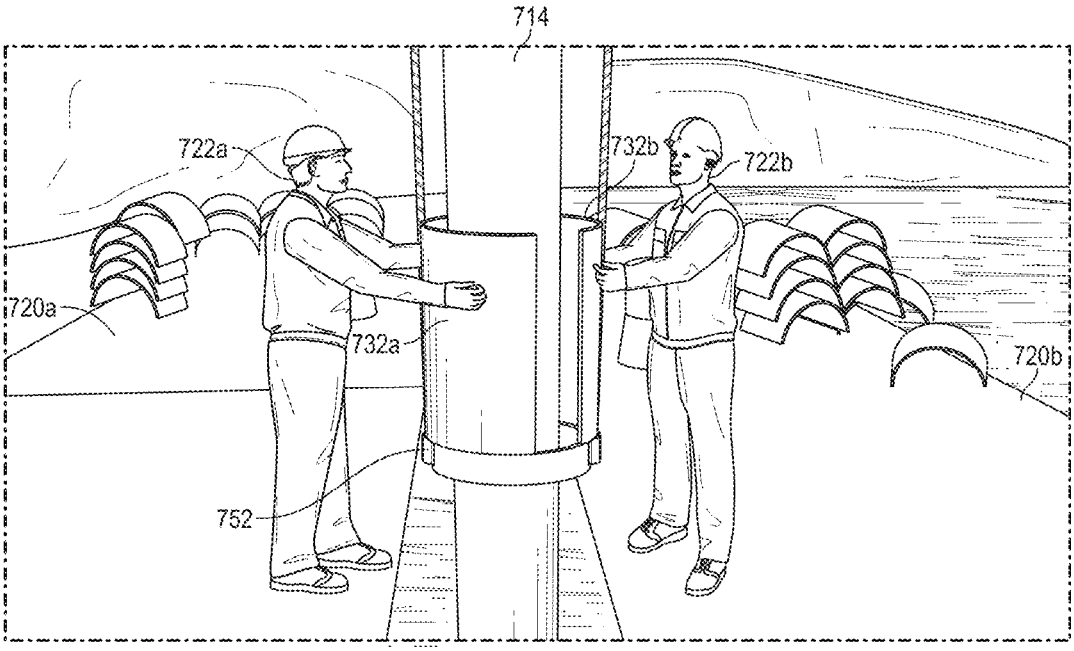
Figure 16F:
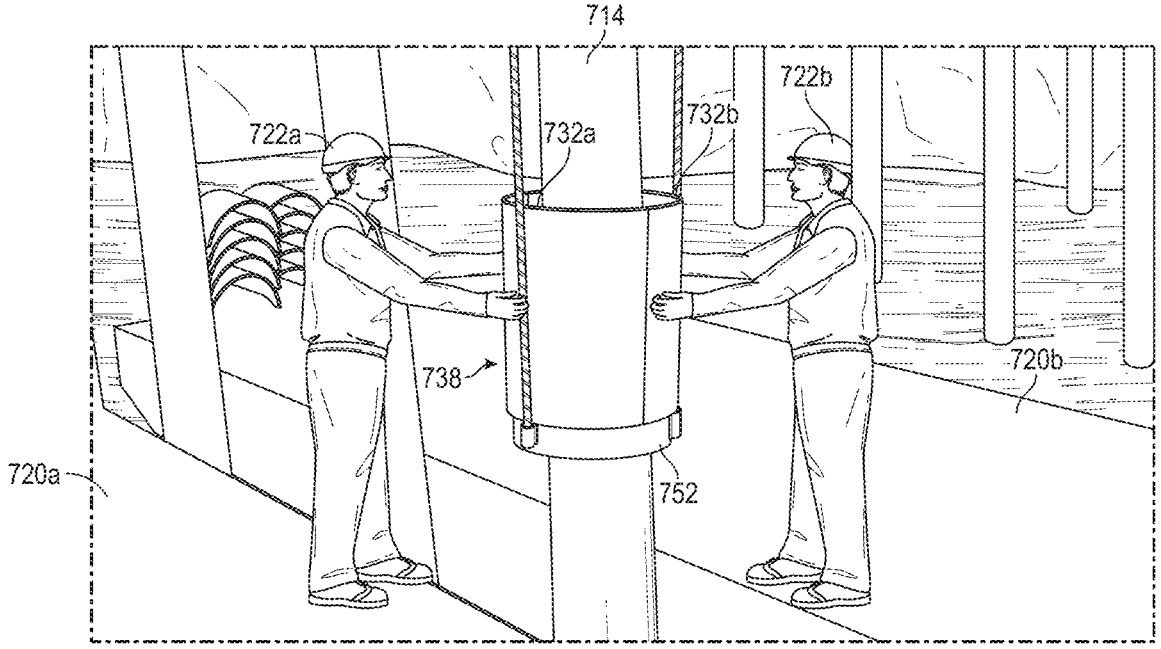
Figure 16G:
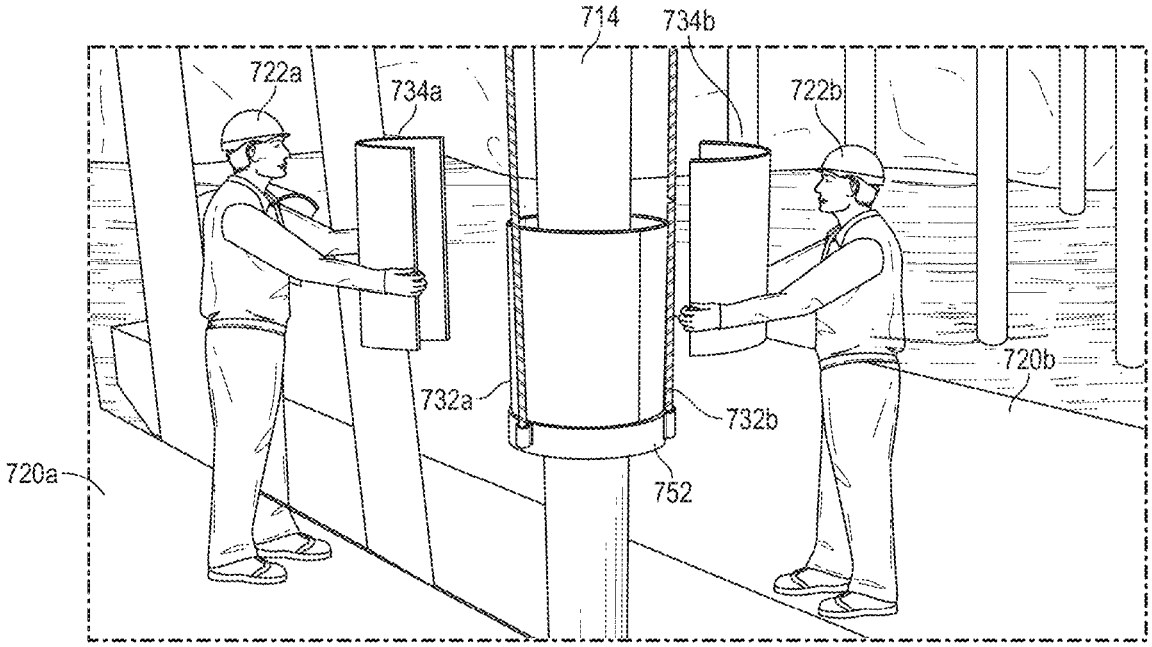
Figure 16H:
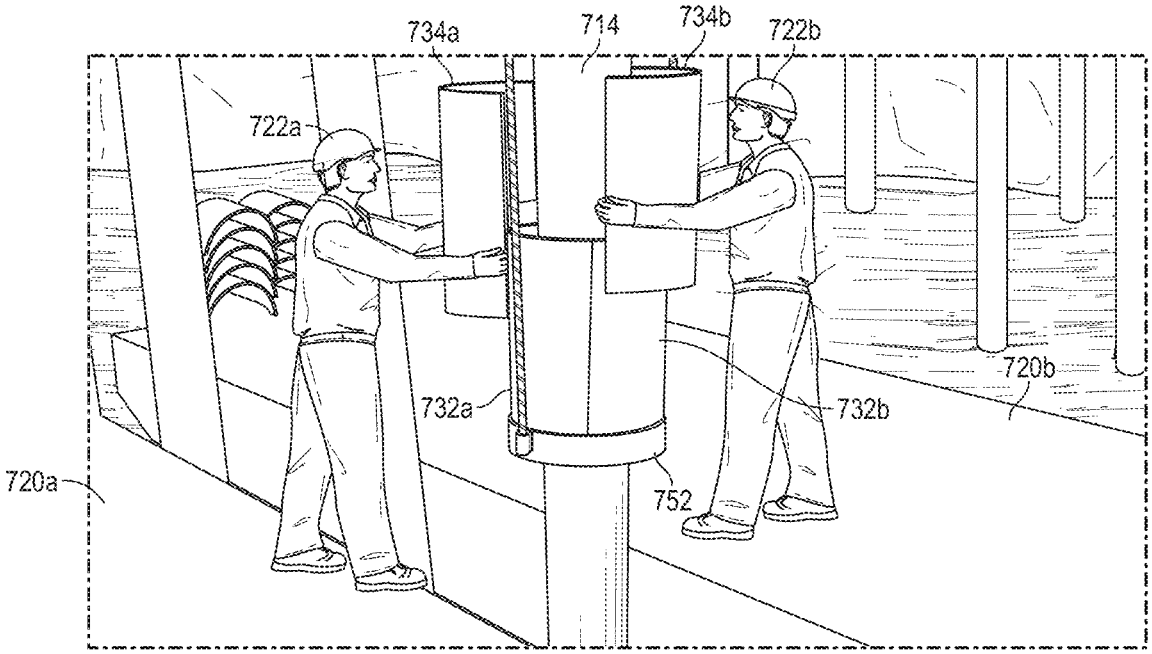
Figure 16I:
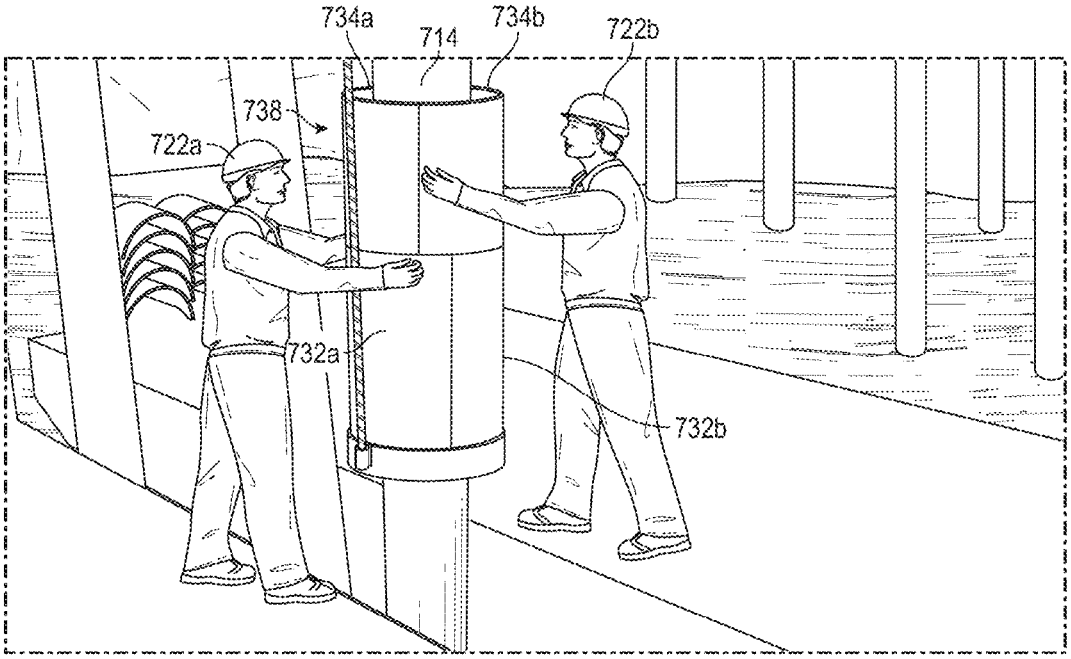
Figure 16J:
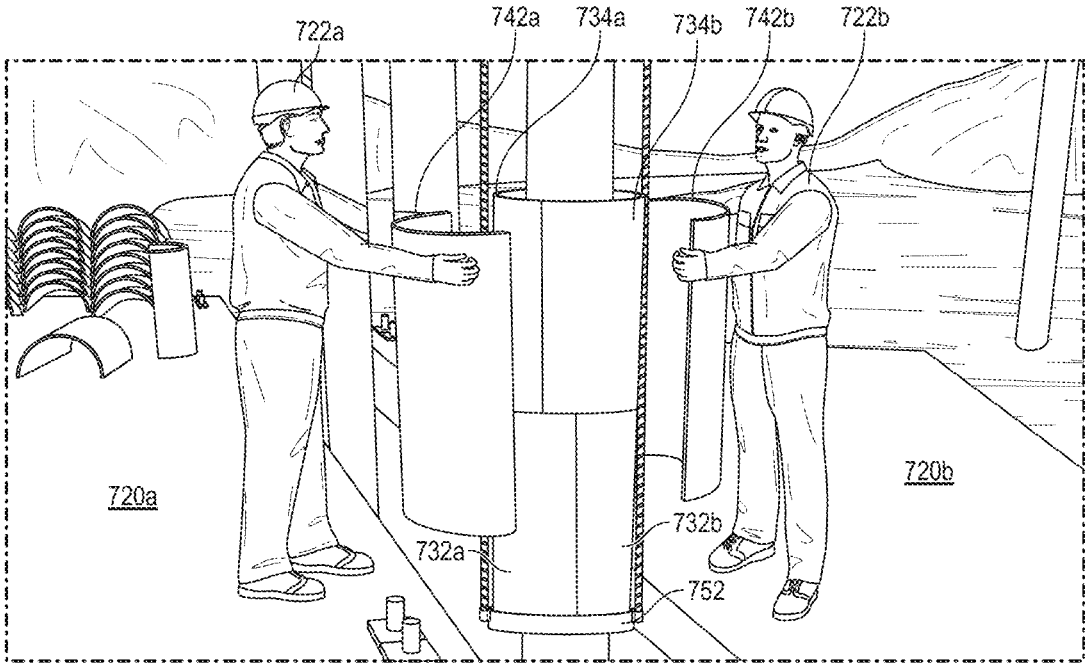
Figure 16K:
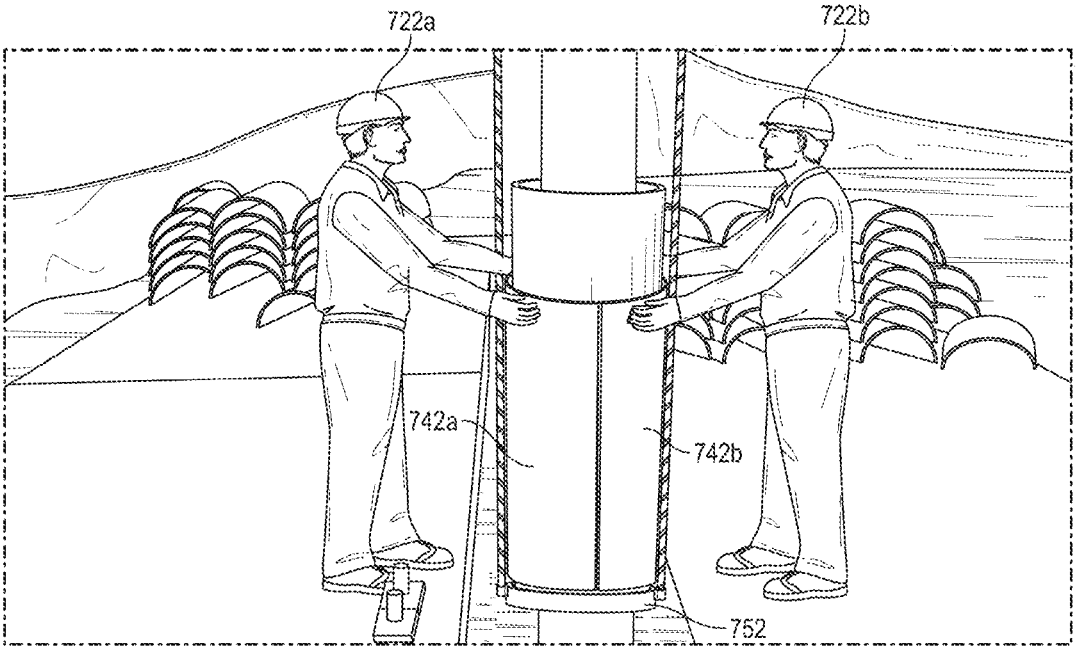
Figure 16L:
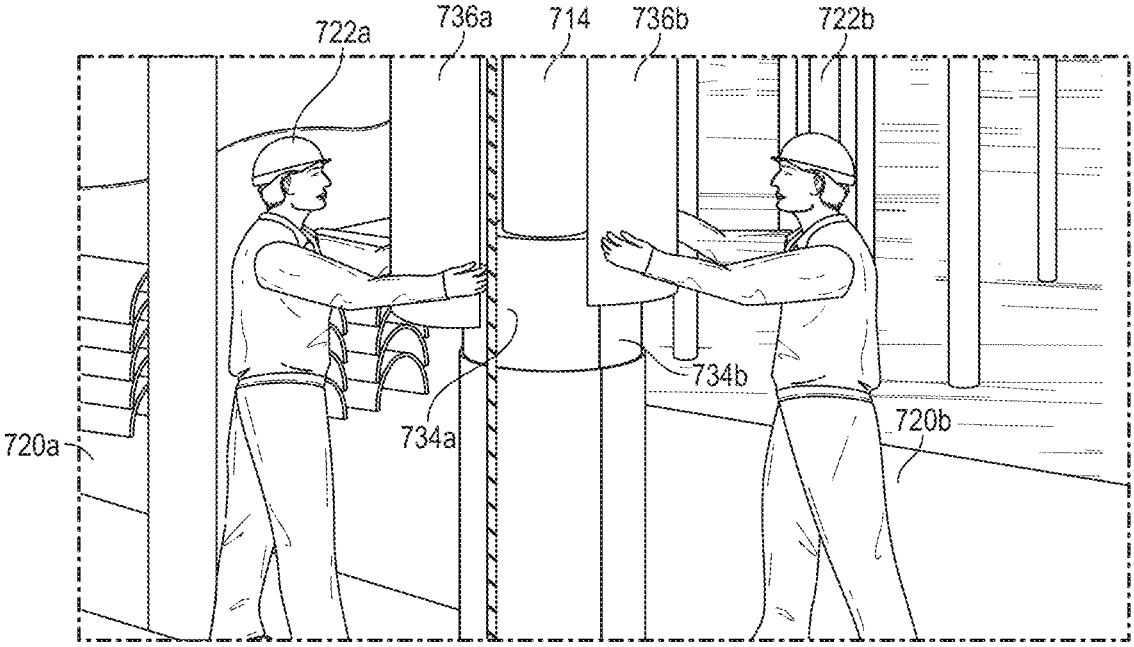
Figure 16M:
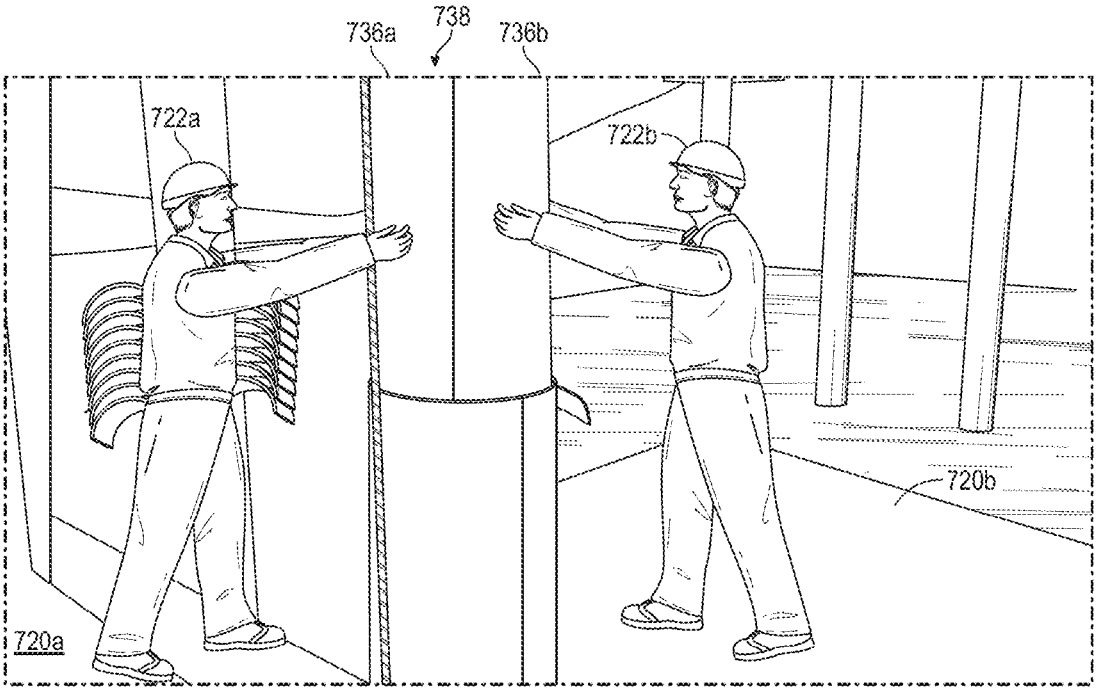
Figure 16N:
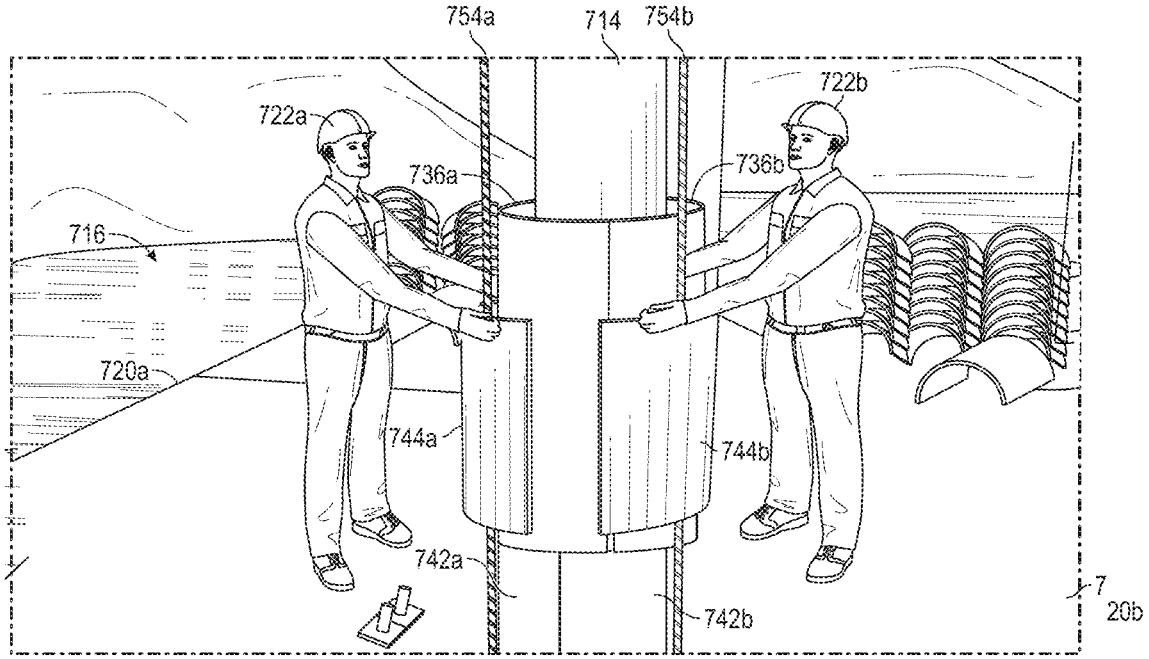
Figure 16O:
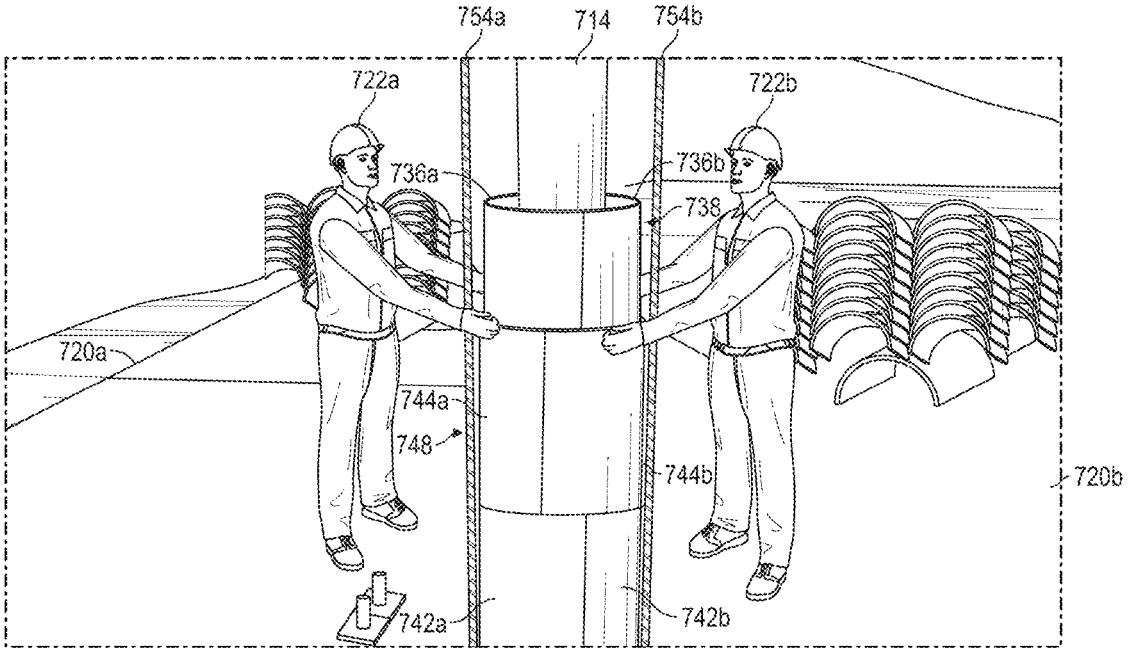
Figure 16P:
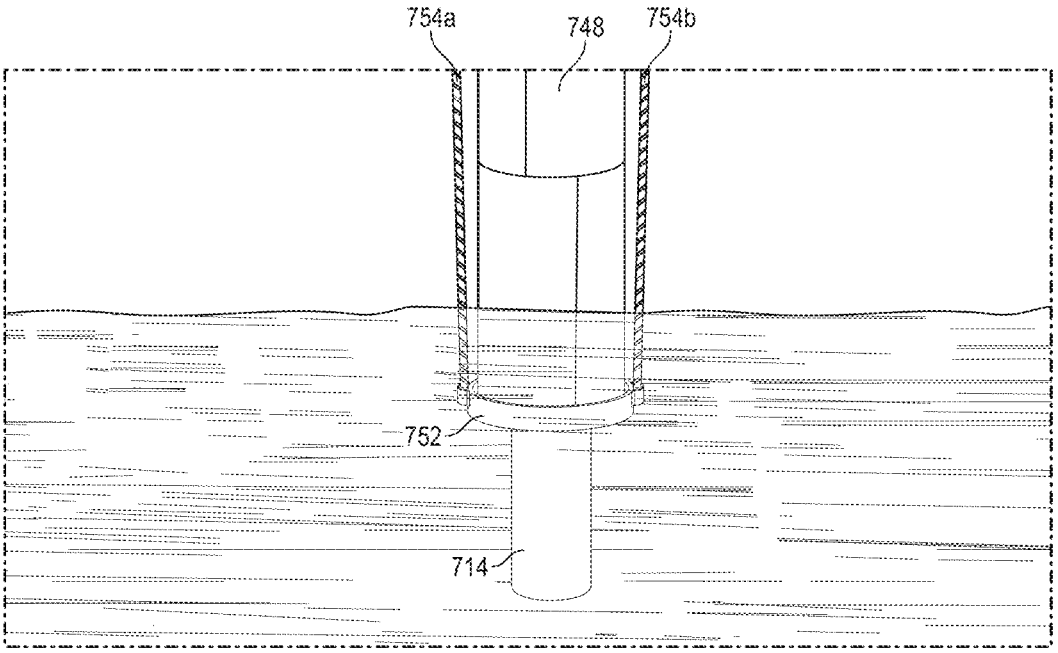
Figure 16Q:
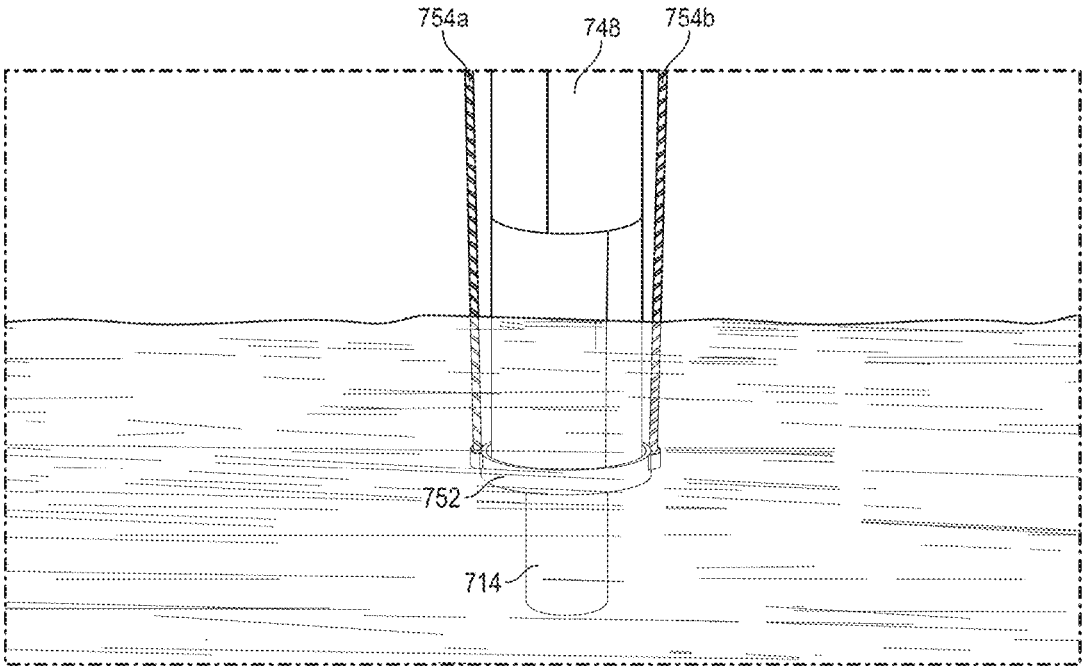
Figure 16R:
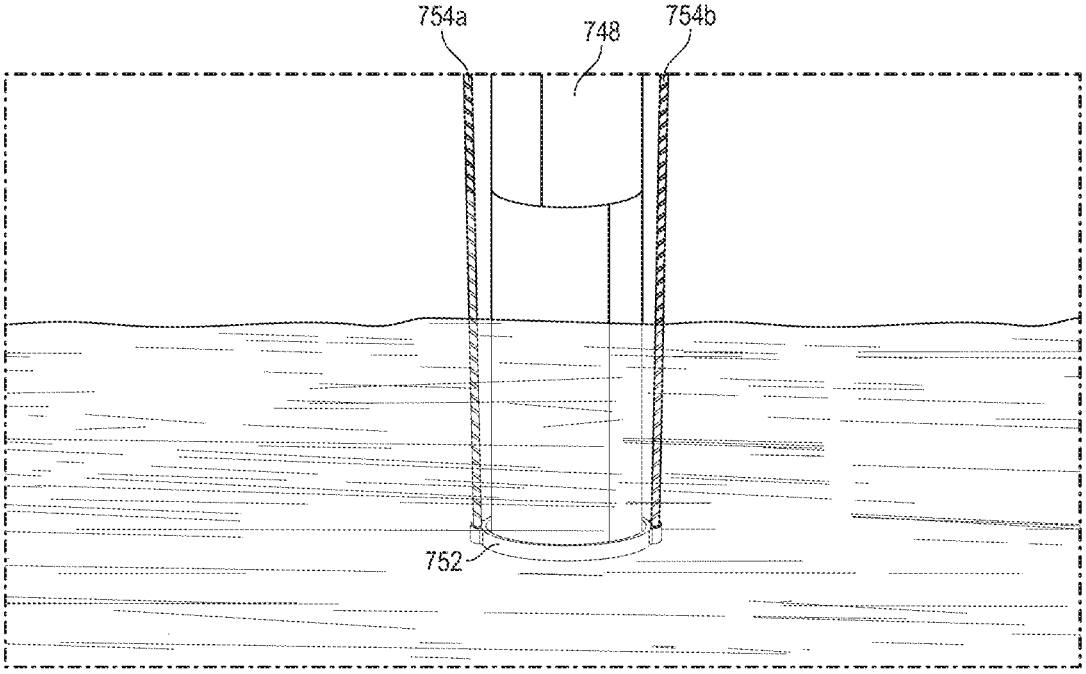
Figure 16S:
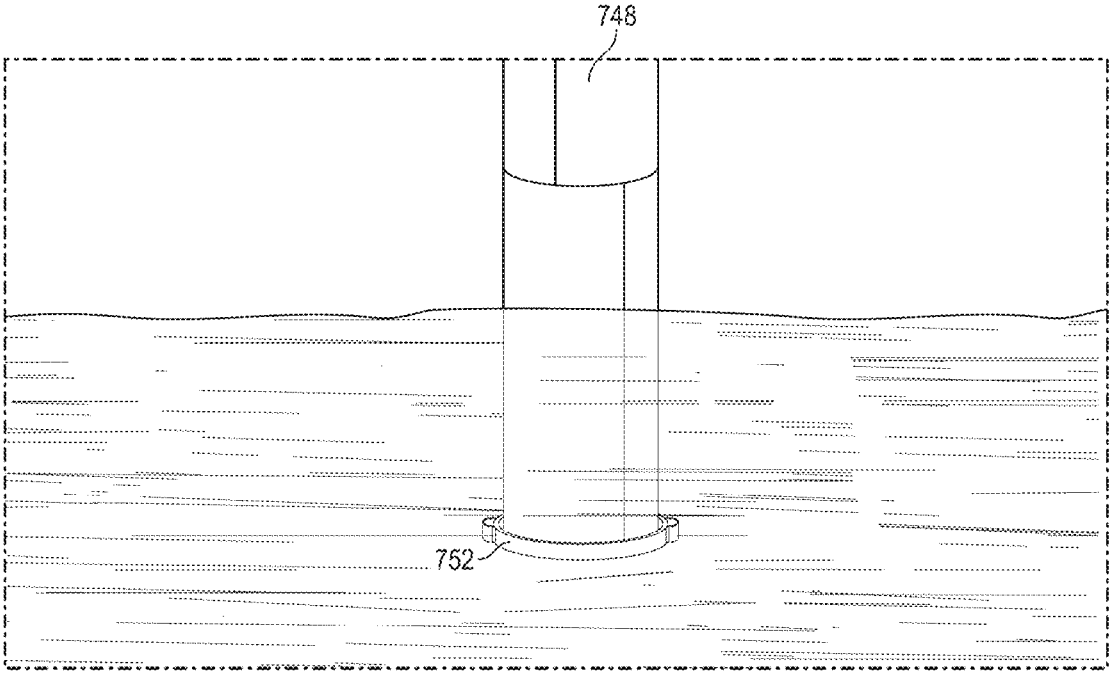
Figure 16T:
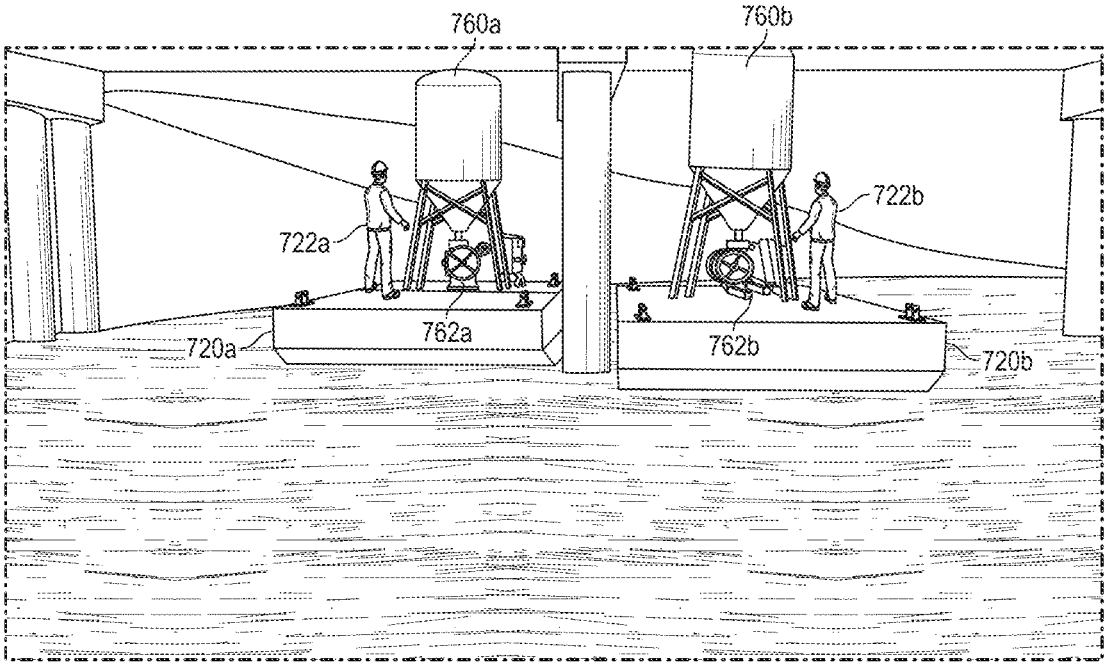
Figure 16U:
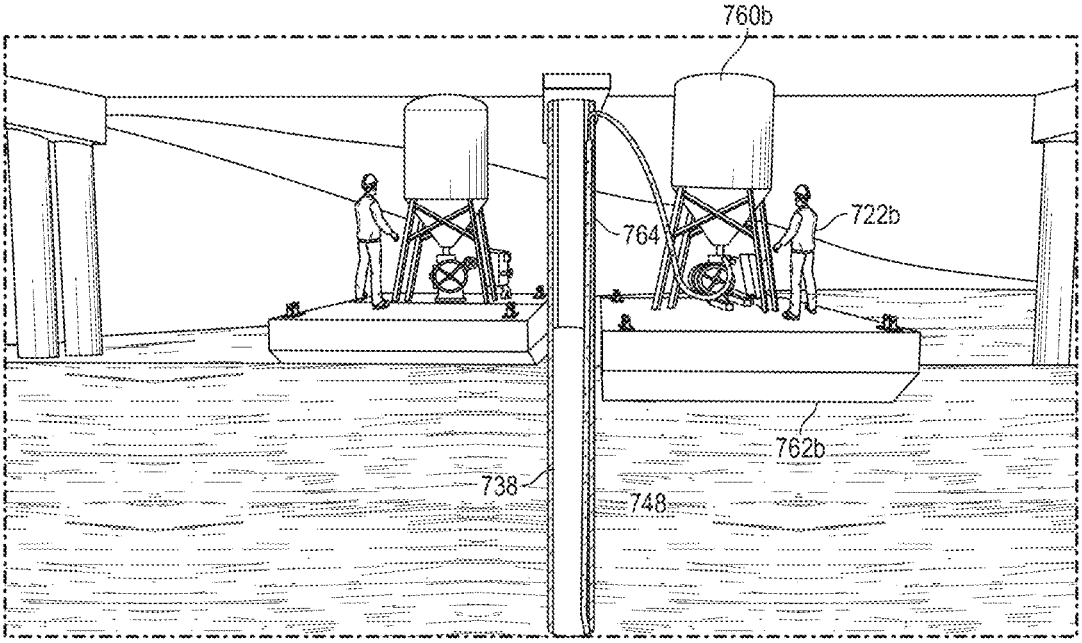
Figure 16V:
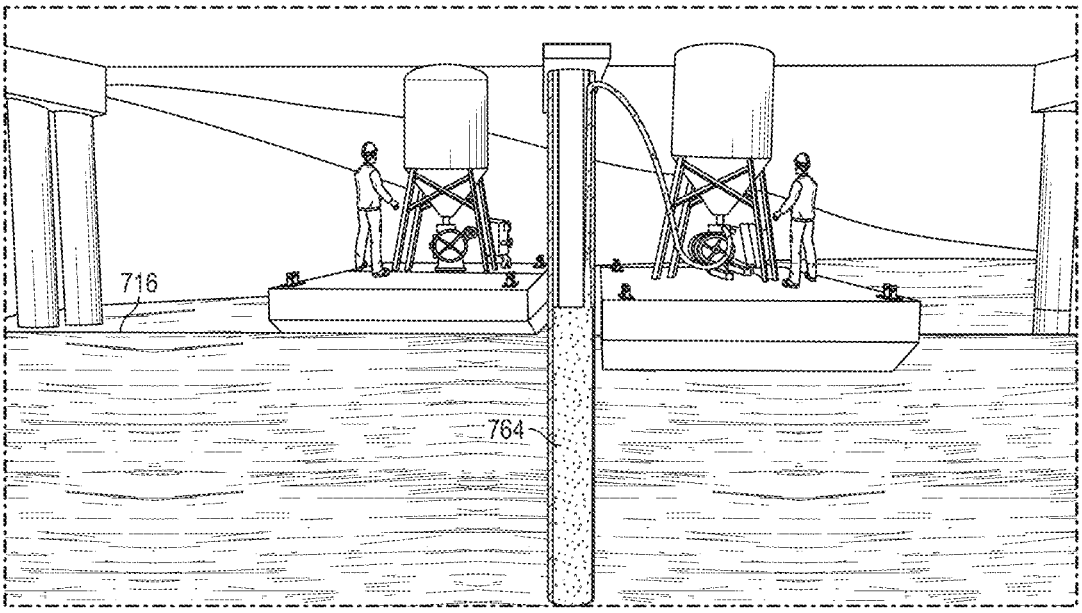
Figure 16W:
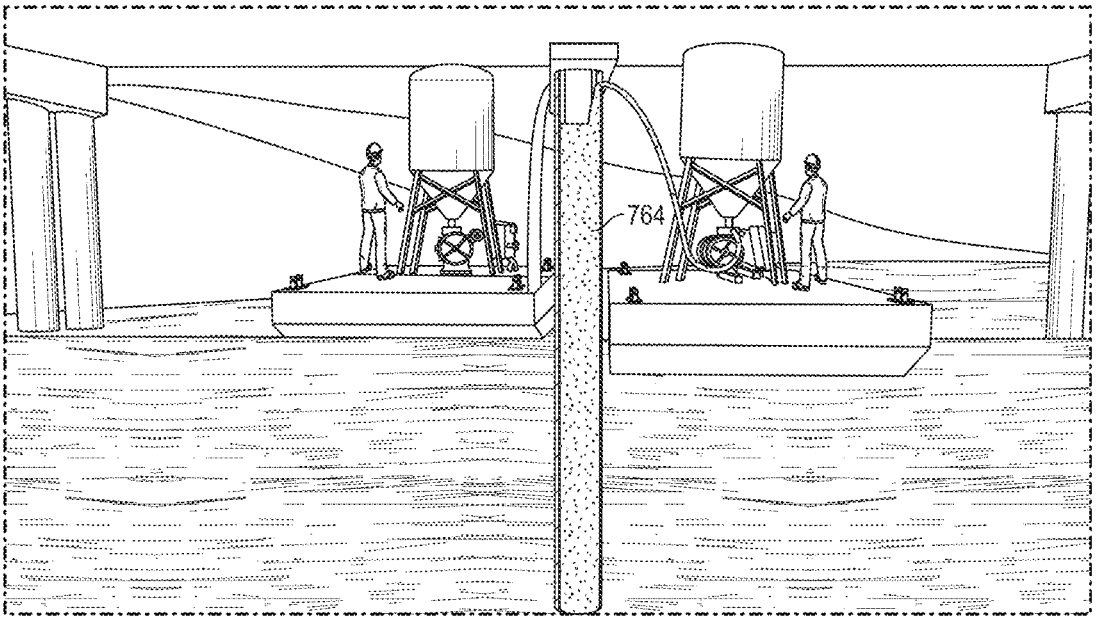
Figure 16X:
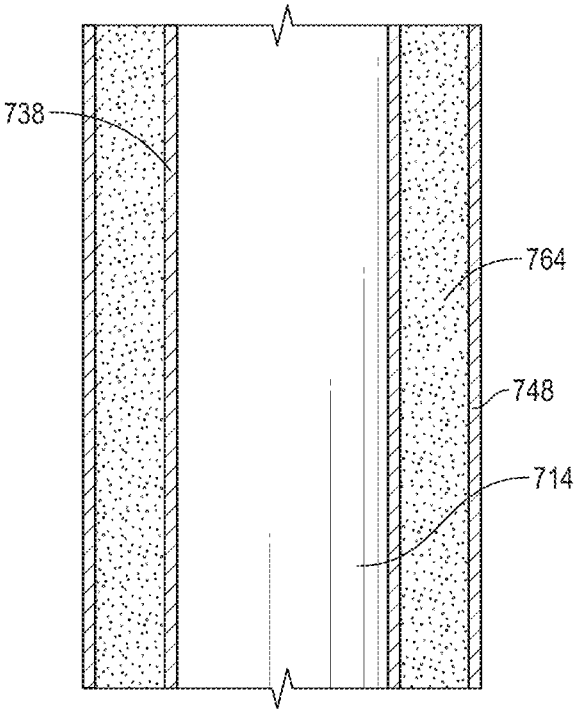
Figure 17:
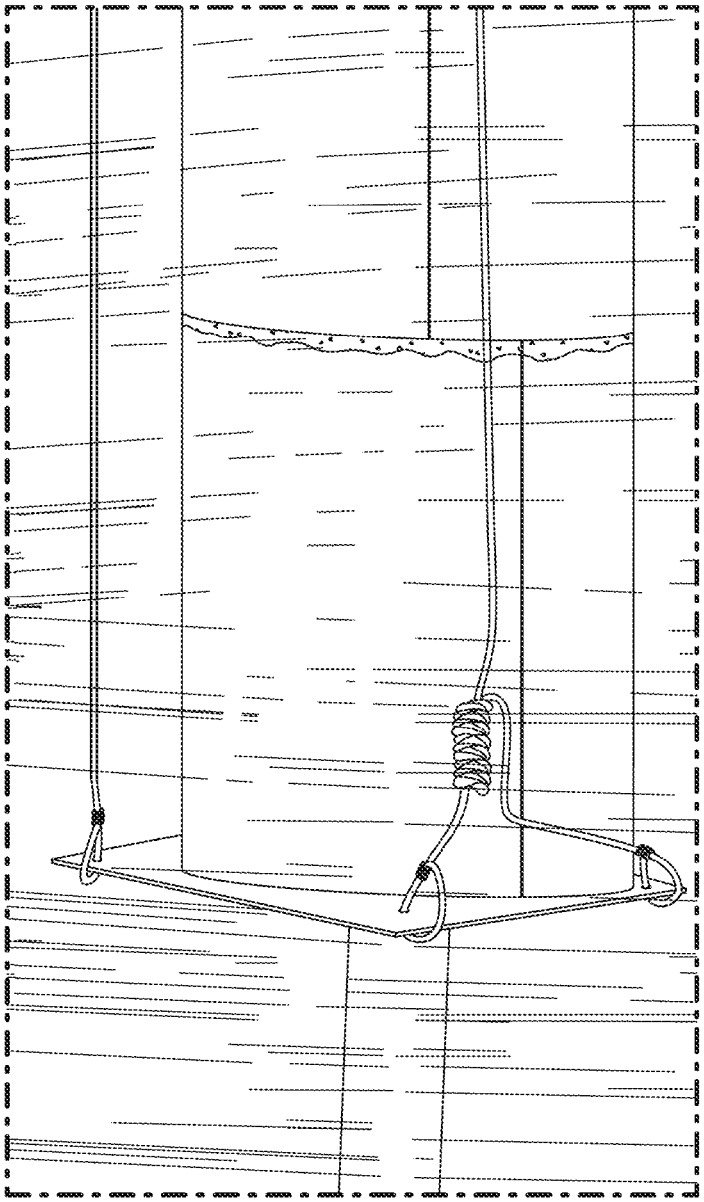
FIG. 17 shows an illustration of a submerged portion of a reinforced marine pile.
Figure 18A:
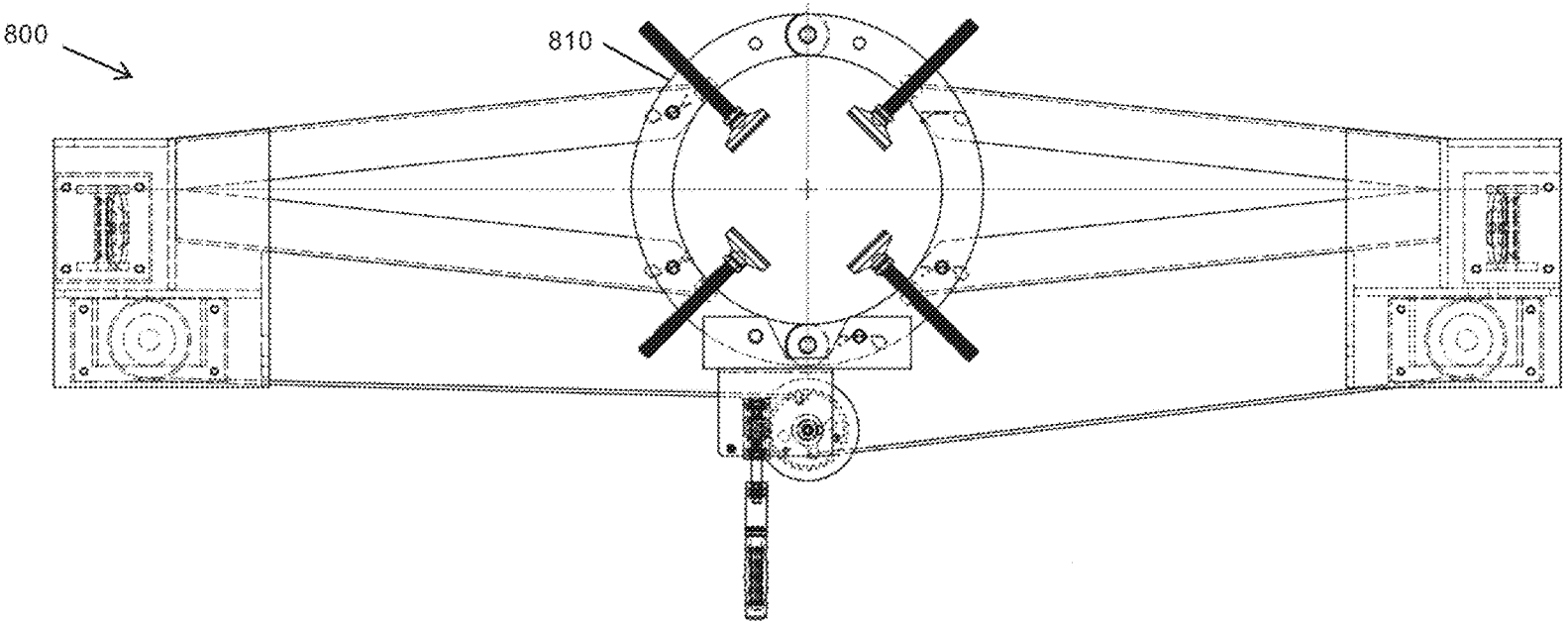
FIG. 18A shows a top view schematic of an upper unit of a sheath structure lowering apparatus of the present invention. This view clearly shows the four anchors which point inwardly towards the center of the upper unit so as to fix the upper unit to a structural element by screwing each anchor so as to tighten the anchor ends against the structural element.
Figure 18B:
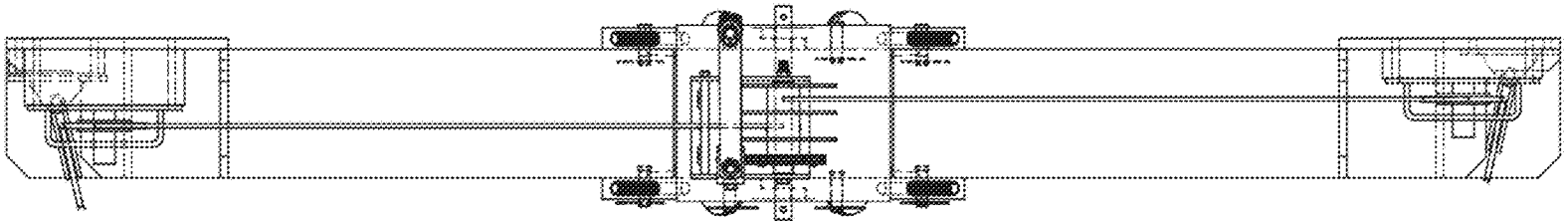
FIG. 18B shows a side view schematic of an upper unit of a sheath structure lowering apparatus of the present invention.
Figure 18C:
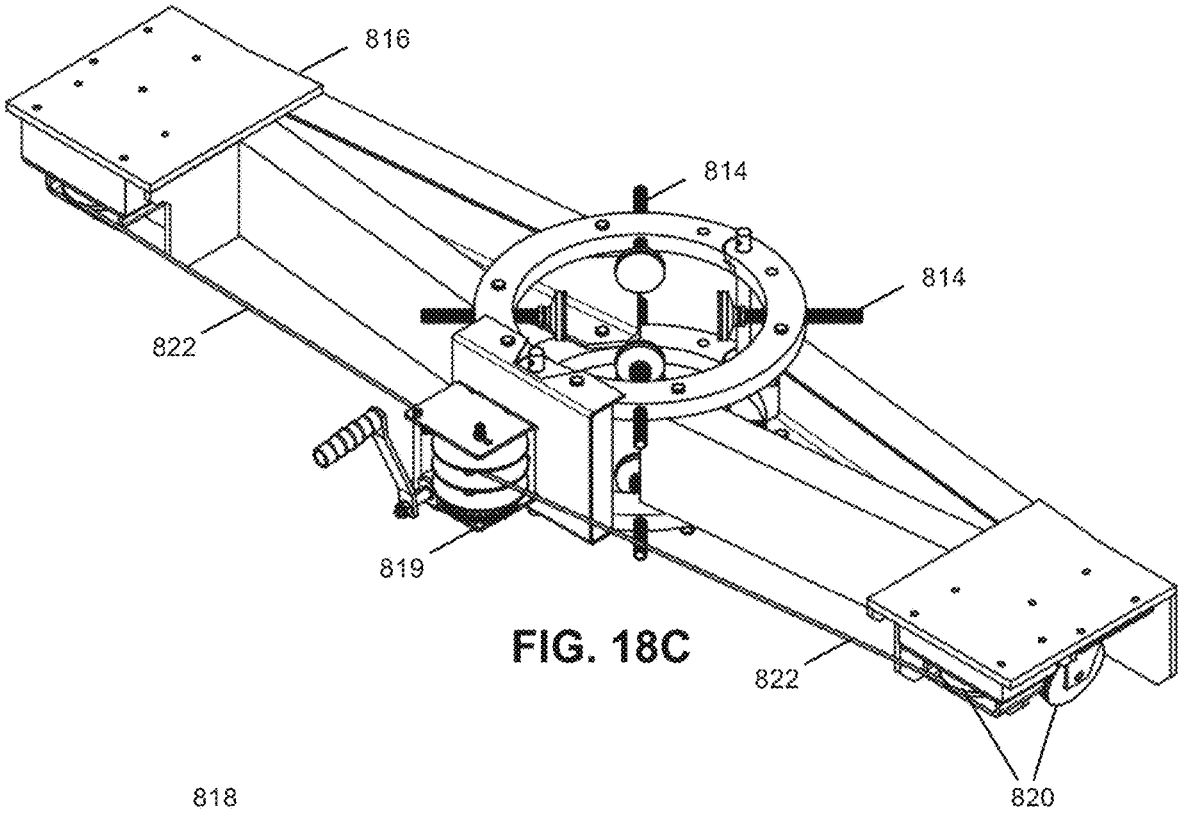
FIG. 18C shows a perspective view schematic of an upper unit of a sheath structure lowering apparatus of the present invention.
Figure 18D:
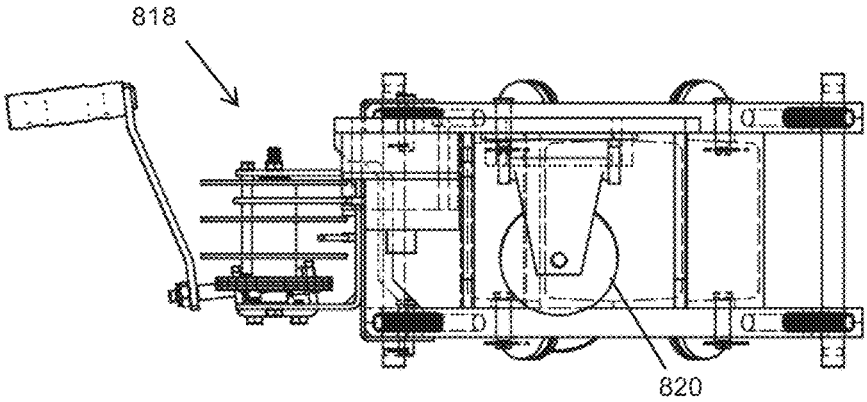
FIG. 18D shows an end view schematic of an upper unit of a sheath structure lowering apparatus of the present invention.
Figure 19A:
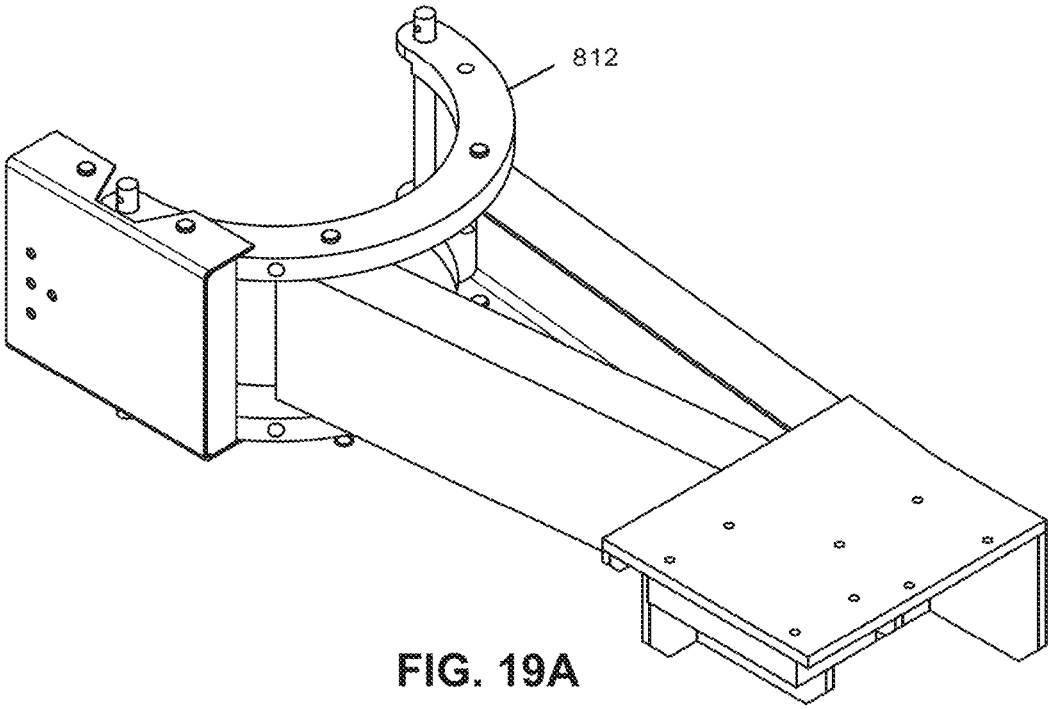
FIGS. 19A-B show a perspective view schematic of an upper unit of a sheath structure lowering apparatus of the present invention which has been disassembled into two halves so as to enable installation around a structural element.
Figure 19B:
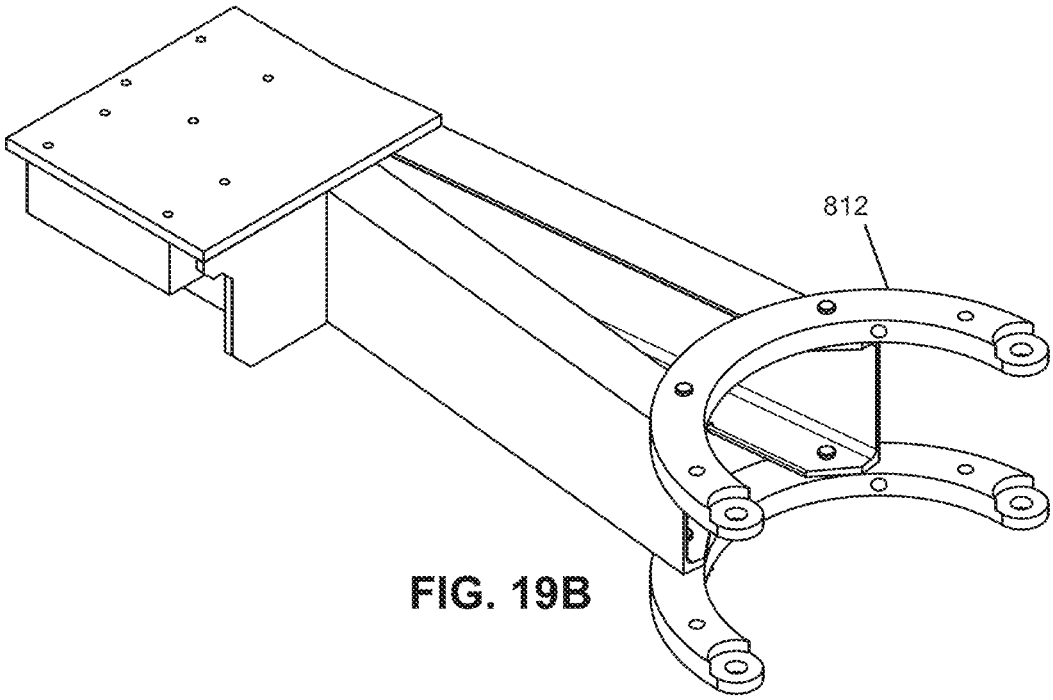
Figure 20A:
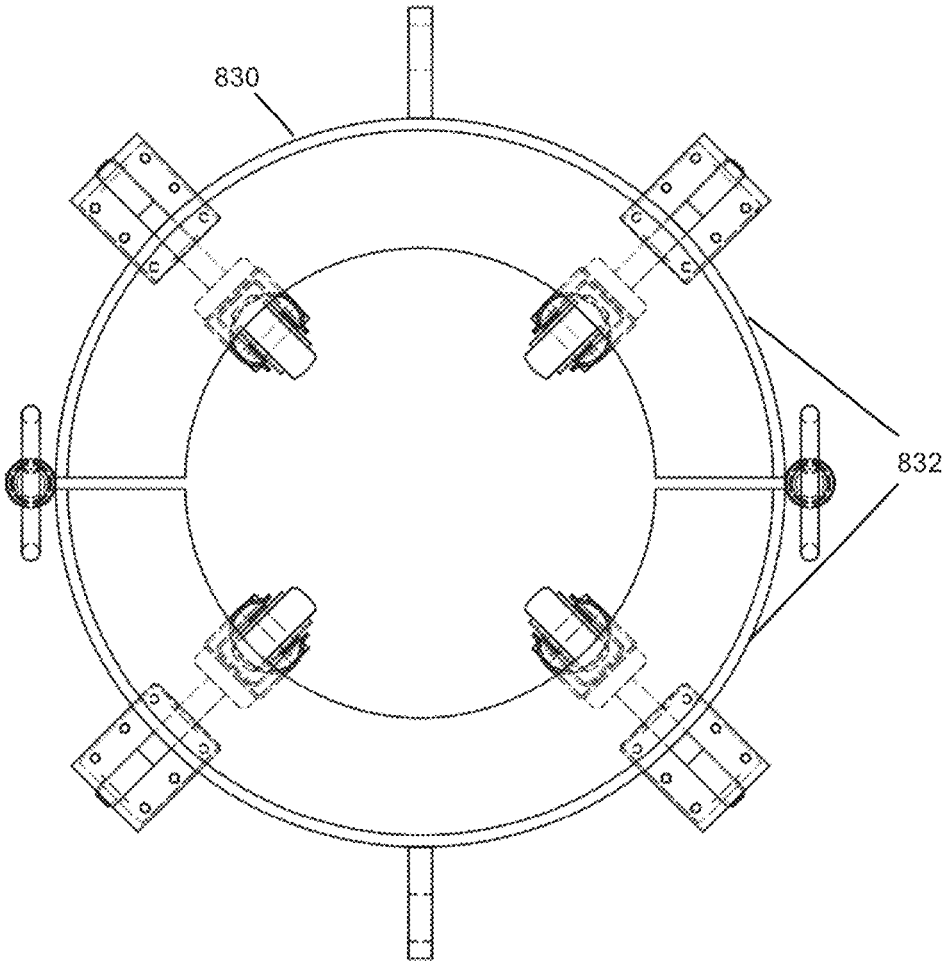
FIG. 20A shows a top view schematic of a lower unit of a sheath structure lowering apparatus of the present invention. The four wheels are oriented inwardly towards the center of the unit so as to contact a structural element and guide the lower unit as it is lowered around the structural element.
Figure 20B:
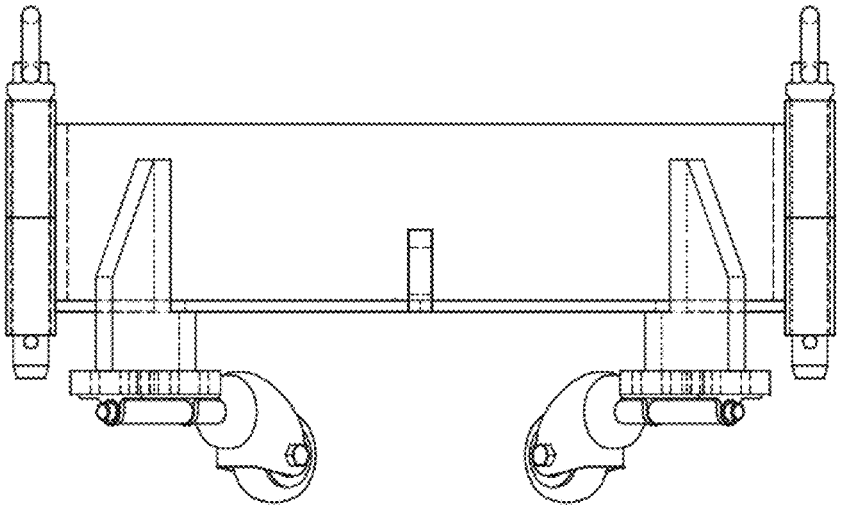
FIG. 20B shows a side view schematic of a lower unit of a sheath structure lowering apparatus of the present invention.
Figure 20C:
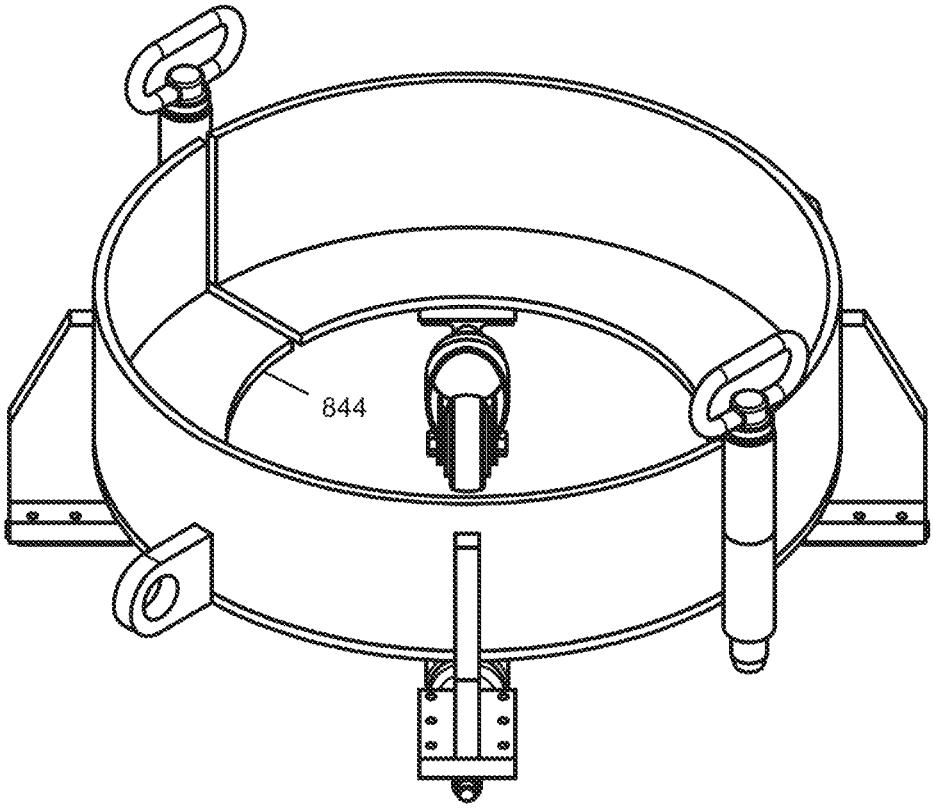
FIG. 20C shows a perspective view schematic of a lower unit of a sheath structure lowering apparatus of the present invention. This view clearly shows the two halves of the lower unit and their releasable attachment via two attachment pins which pass through end barrels of both halves of the lower unit and may be removed by means of a release cable passing through the eye of each attachment pin.
Figure 20D:
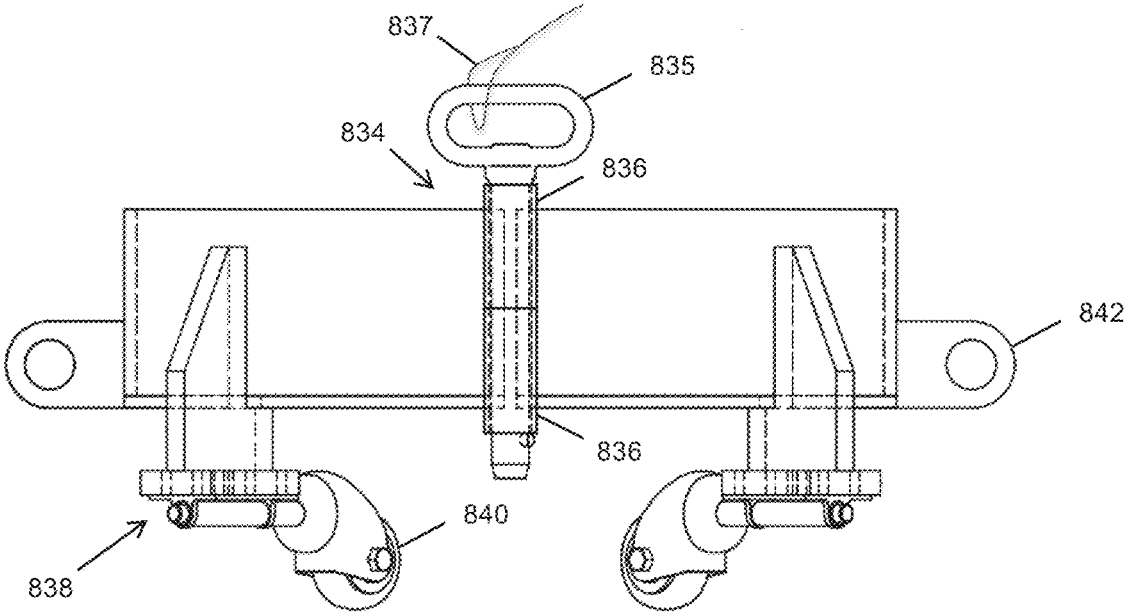
FIG. 20D shows another side view schematic of a lower unit of a sheath structure lowering apparatus of the present invention. This view clearly shows the lower attachment points for attachment of the cables or flexible support members which suspend the lower unit.
Figure 21A:
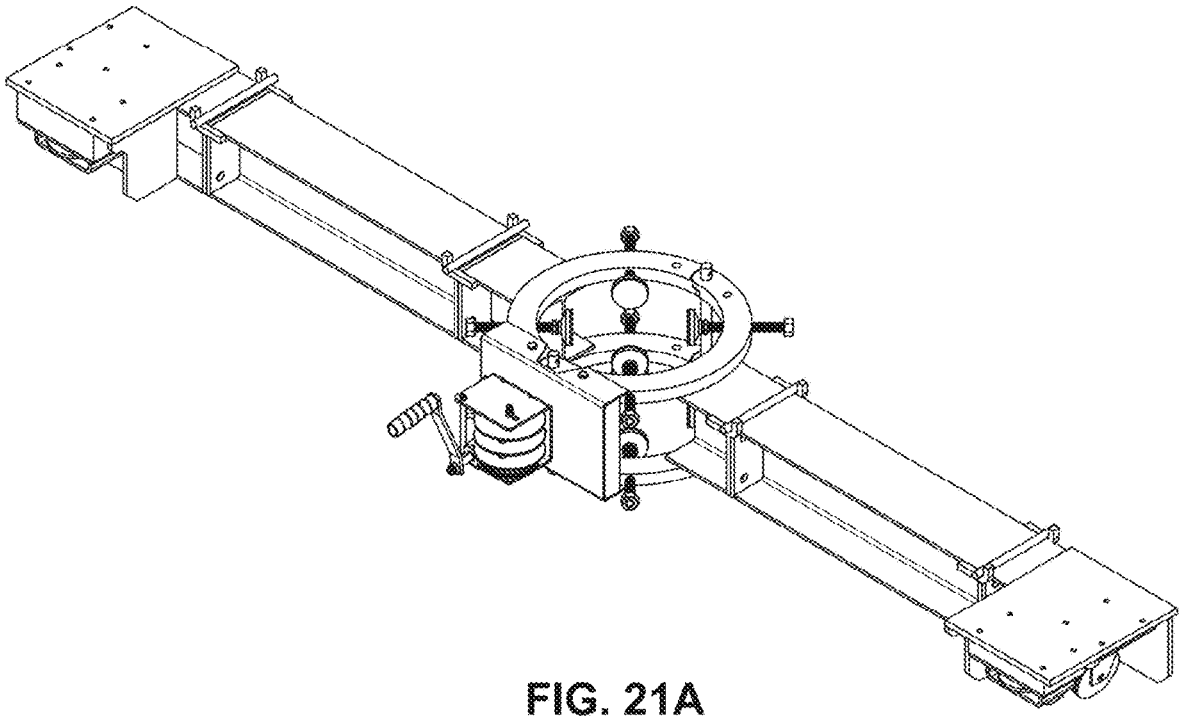
FIG. 21A shows an illustration of a complete upper unit of a sheath structure lowering apparatus of the present invention, including a hand winch. The support brackets, or arms, are segmented into multiple arm sections. This provides for ease of field assembly as well as extension of the arms by adding additional arm sections.
Figure 21B:
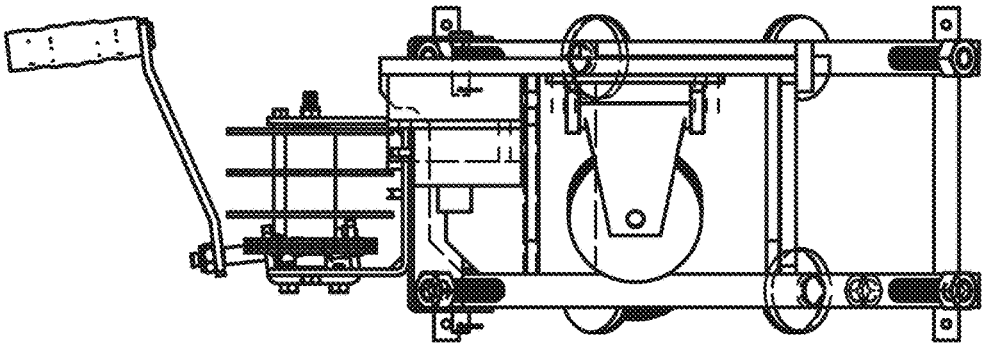
FIG. 21B shows an end view schematic of an upper unit of a sheath flow structure lowering apparatus of the present invention.
Figure 21C:
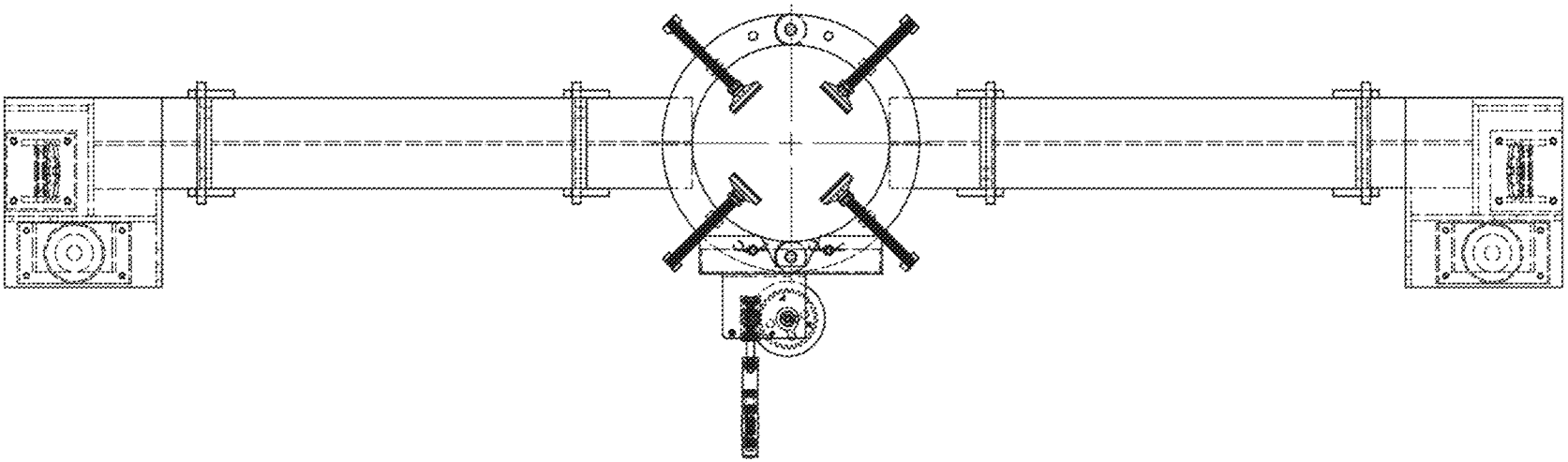
FIG. 21C shows a top view schematic of an upper unit of a sheath flow structure lowering apparatus of the present invention.
Figure 21D:
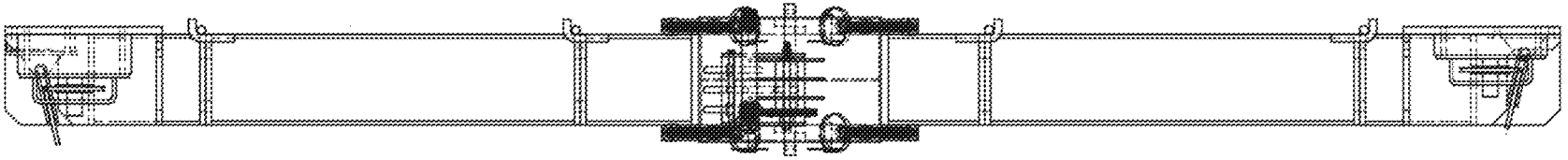
FIG. 21D shows a side view schematic of an upper unit of a sheath flow structure lowering apparatus of the present invention.
Figure 22A:
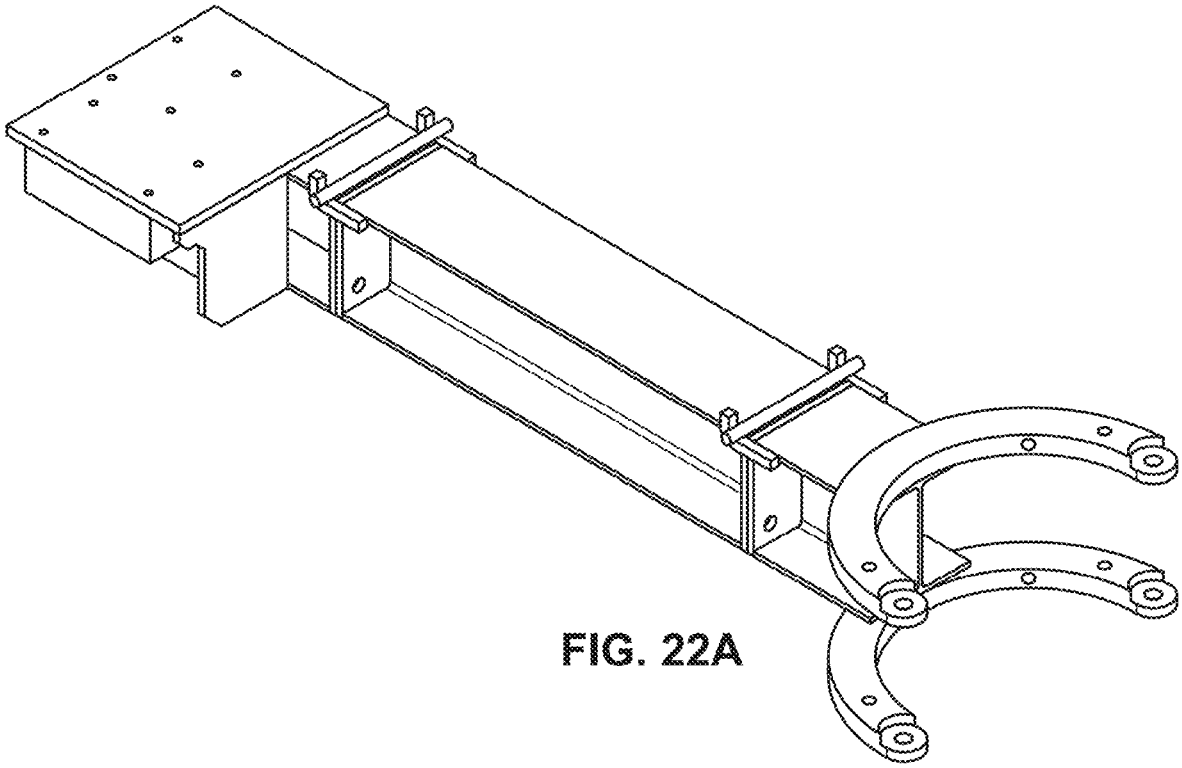
FIG. 22A-B show a perspective view schematic of an upper unit of a sheath structure lowering apparatus of the present invention which has been disassembled into two halves so as to enable installation around a structural element.
Figure 22B:
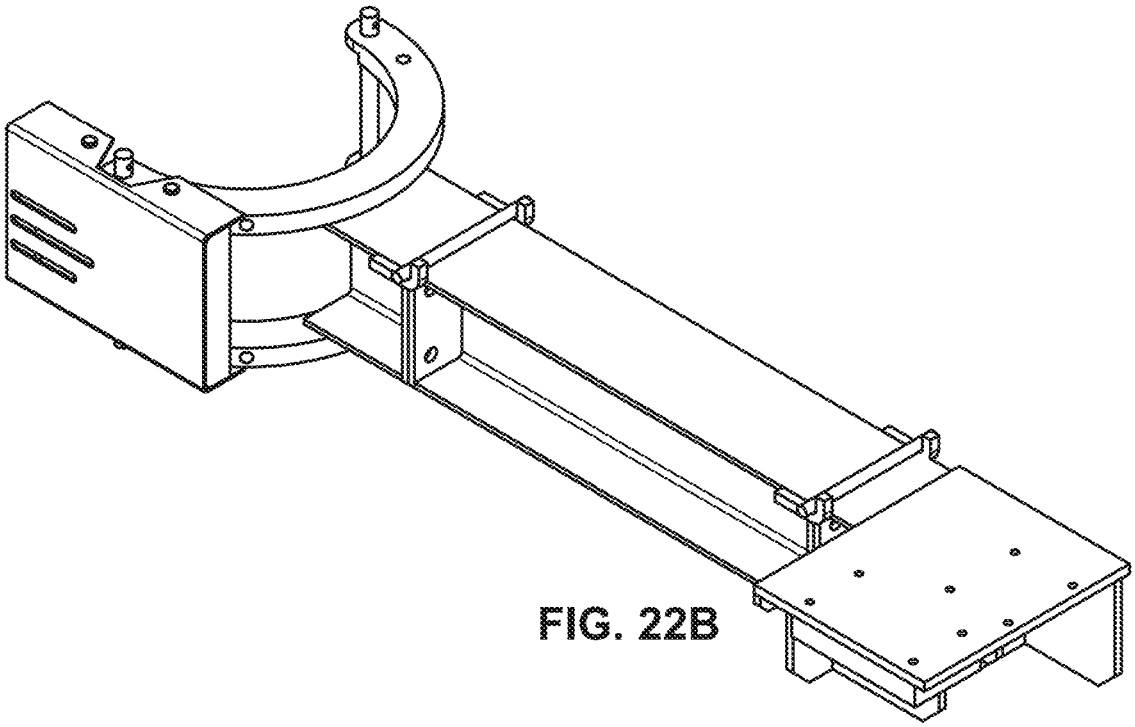
Figure 23A:
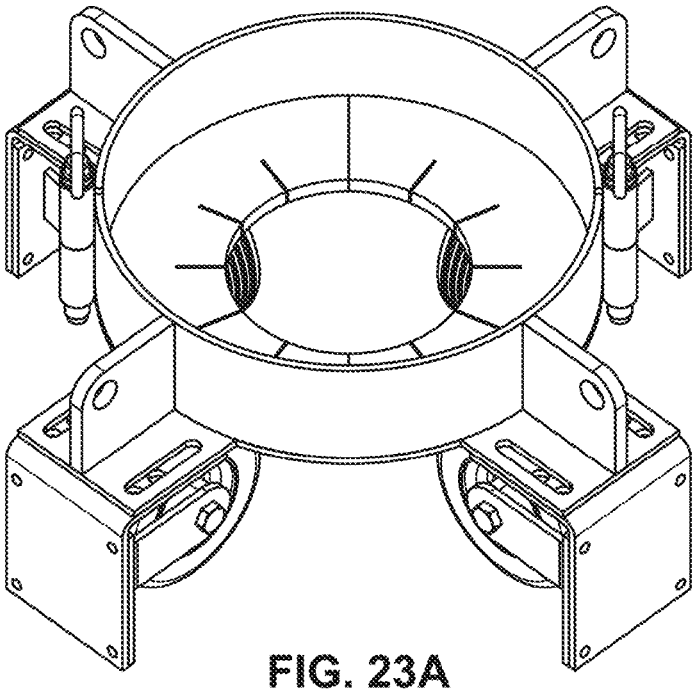
FIG. 23A shows a perspective view schematic of an lower unit of a sheath structure lowering apparatus of the present invention.
Figure 23B:
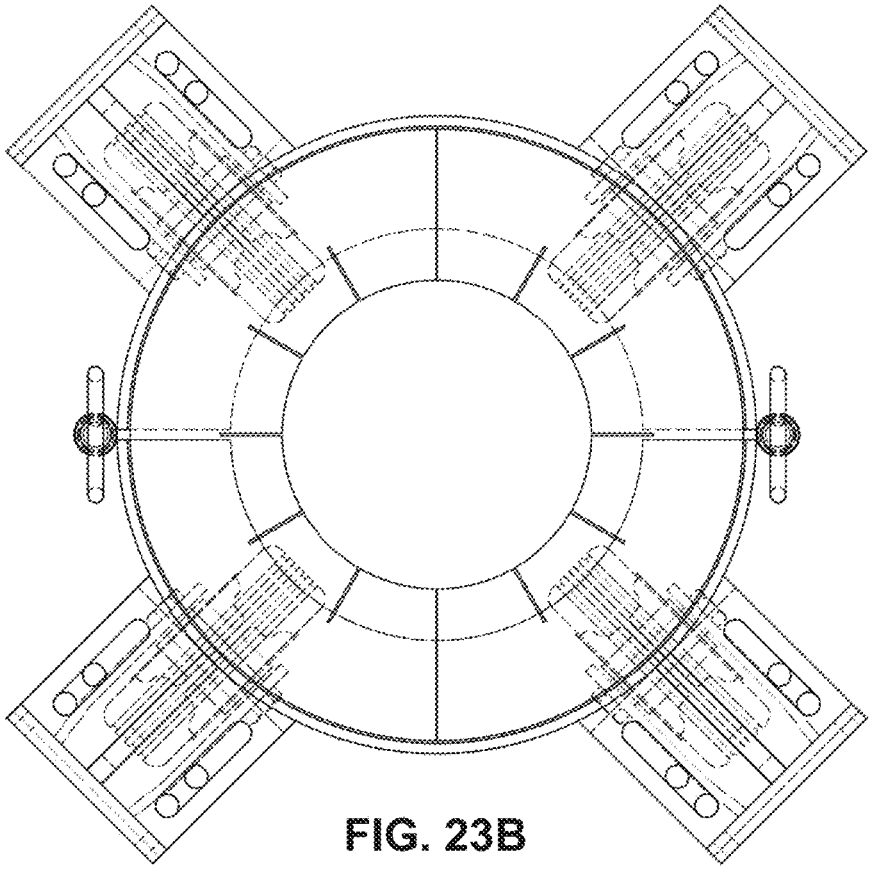
FIG. 23B shows a top view schematic of an lower unit of a sheath structure lowering apparatus of the present invention.
Figure 23C:
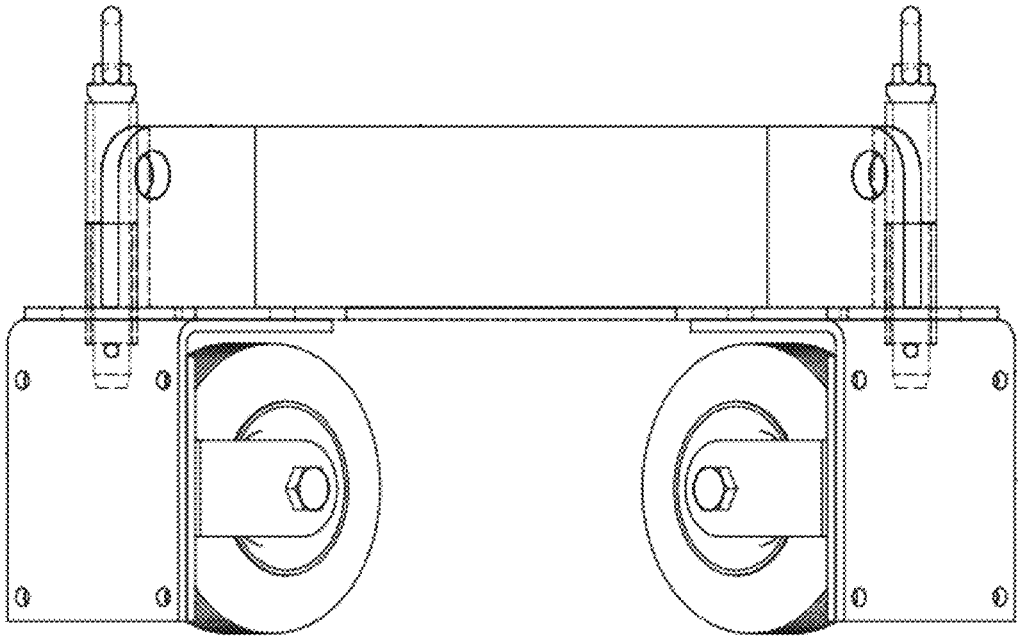
FIG. 23C shows a side view schematic of an lower unit of a sheath structure lowering apparatus of the present invention.
Figure 23D:
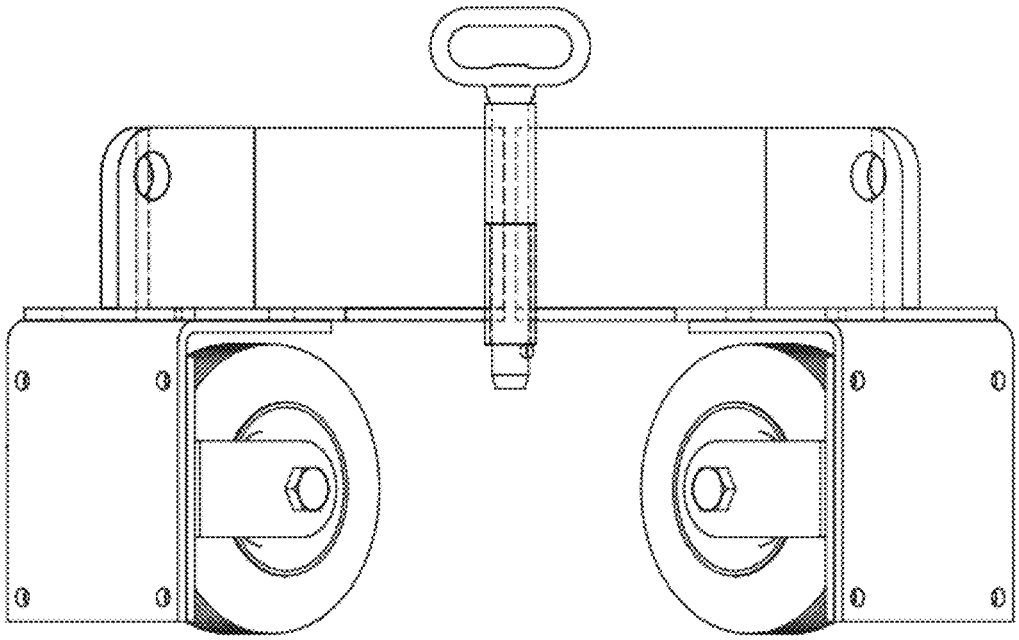
FIG. 23D shows another side view schematic of an lower unit of a sheath structure lowering apparatus of the present invention.
Figure 24A:
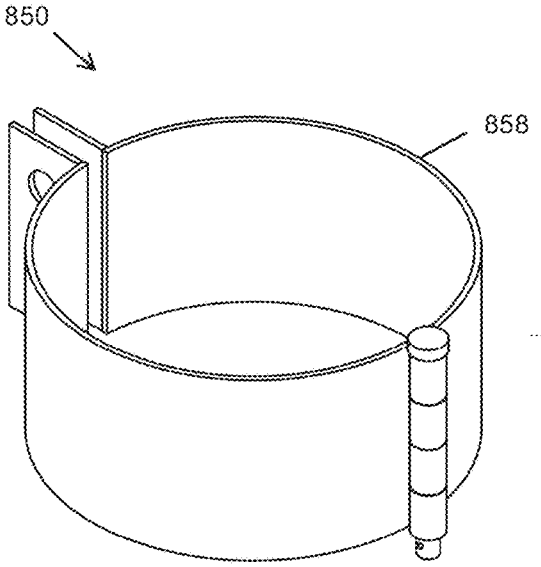
FIG. 24A shows a perspective view schematic of a support clamp of the present invention.
Figure 24B:
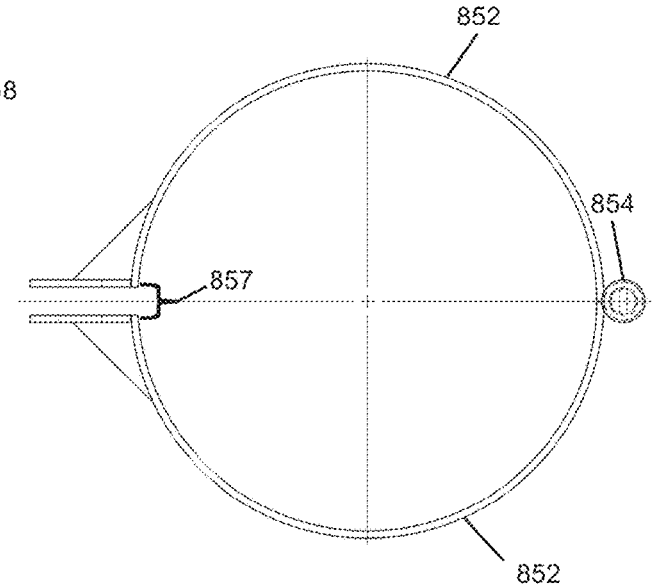
FIG. 24B shows a top view schematic of a support clamp of the present invention.
Figure 24C:
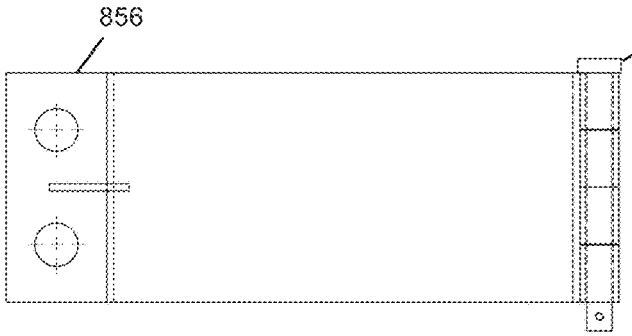
FIG. 24C shows a side view schematic of a support clamp of the present invention.
Figure 24D:
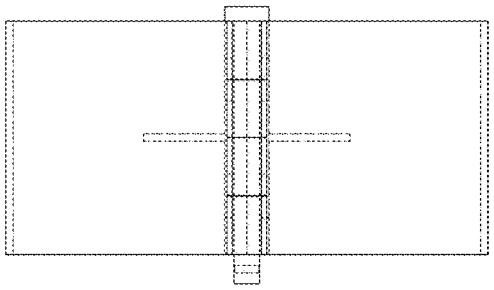
FIG. 24D shows another side view schematic of a support clamp of the present invention.

FIGS. 16A to 16X show a method of reinforcing a marine pile in accordance with an embodiment of the present invention. The method generally employs the fiber-reinforced shells, adhesives, seams, stacks, components, features and assembly techniques described above. Therefore, these specific embodiments and details need not be repeated. However, the method includes additional features and assembly techniques that are particularly well-suited to a marine environment.

FIG. 16A shows a bridge 710, a body of water 712 and a marine pile 714. The bridge 710 provides a causeway for vehicle traffic. The body of water 712 includes a water line 716 and overlays a seabed (not shown). The marine pile 714 is an elongated concrete column that extends along a vertical axis (similar to axis A) between the bridge 710 above the water line 716 and the seabed below the water line 716. The marine pile 714 is secured to the bridge 710 and anchored to the seabed. Thus, the marine pile 714 is partially submerged below the water line 716, partially exposed to the atmosphere above the water line 716 and partially ground within the seabed. The marine pile 714 is a structural element that supports the bridge 710 and may exhibit damage or degradation that warrants structural reinforcement.

FIG. 16B shows marine vessels 720*a* and 720*b* positioned about the marine pile 714. The marine vessels 720*a* and 720*b* are located on opposite sides of the marine pile 714 in close proximity to the marine pile 714. The marine vessels 720*a* and 720*a* are secured to remain relatively stationary relative to the marine pile 714 despite mild surface waves. For example, the marine vessels 720*a* and 720*b* can be tied to the marine pile 714 or anchored to the seabed. In this embodiment, the marine vessels 720*a* and 720*b* are small rafts that float on the water line 716. It will be appreciated that the marine vessels 720*a* and 720*b* can be various boats, barges, ships, rafts and the like that provide a platform for reinforcing the marine pile 714. The marine vessel 720*a* is manned and operated by a worker 722*a* and the marine vessel 720*b* is manned and operated by a worker 722*b*. The marine vessels 720*a* and 720*b* typically include conventional marine devices such as motors and steering mechanisms (not shown) so that the workers 722*a* and 722*b* can navigate them to the marine pile 714. The marine vessels 720*a* and/or 720*b* may also include a hoist (not shown) as well as a storage tank and a pump (not shown) for grout delivery.

The marine vessel 720*a* includes fiber-reinforced shells 730*a* and the marine vessel 720*b* includes fiber-reinforced shells 730*b*. The fiber-reinforced shells 730*a* include fiber-reinforced shells 732*a*, 734*a* and 736*a* for an inner reinforcement layer 738 and fiber-reinforced shells 742*a* and 744*a* for an outer reinforcement layer 748 as described below. Likewise, the fiber-reinforced shells 730*b* include fiber-reinforced shells 732*b*, 734*b* and 736*b* for the inner reinforcement layer 738 and fiber-reinforced shells 742*b* and 744*b* for the outer reinforcement layer 748 as described below.

The fiber-reinforced shells 732*a*, 732*b*, 734*a*, 734*b*, 736*a* and 736*b* are complementary to one another, the fiber-reinforced shells 742*a* and 742*b* are complementary to one another, and the fiber-reinforced shells 744*a* and 744*b* are complementary to one another. The fiber-reinforced shells 742*a*, 742*b*, 744*a* and 744*b* have the same peripheral dimensions and width. However, the fiber-reinforced shells 742*a* and 742*b* have a first height, the fiber-reinforced shells 732*a*, 732*b*, 734*a*, 734*b*, 736*a*, 736*b*, 744*a* and 744*b* have a second height, and the first height is greater than the second height. In this embodiment, the first height is about 150% of the second height. In addition, the fiber-reinforced shells 742*a*, 742*b*, 744*a* and 744*b* have a waterproof coating at the exterior surface but the fiber-reinforced shells 732*a*, 732*b*, 734*a*, 734*b*, 736*a* and 736*b* do not. In other embodiments, the fiber-reinforced shells 742*a*, 742*b*, 744*a* and 744*b* at the outer reinforcement layer 748 may have more robust structures, contours and/or materials than the fiber-reinforced shells 732*a*, 732*b*, 734*a*, 734*b*, 736*a* and 736*b* at the inner reinforcement layer 738 to withstand greater environmental exposure.

FIG. 16C shows a hoist 750 that includes a base 752 and cables 754*a* and 754*b*. The hoist 750 is secured to the marine pile 714 by the workers 722*a* and 722*b* and the base 752 is positioned about the marine pile 714 by the workers 722*a* and 722*b* to envelope a portion of the marine pile 714. The hoist 750 includes a pulley mechanism that enables the workers 722*a* and 722*b* to incrementally lower the base 752 in step-and-repeat fashion using the cables 754*a* and 754*b*. The base 752 has an annular shape with a central aperture through which the marine pile 714 extends. The base 752 is located above the water line 716 and includes a first end that faces downward toward the water line 716 and a second end that faces upward toward the bridge 710. The base 752 has the second end positioned at a loading elevation at roughly the same height as the knees of the workers 722*a* and 722*b* for ergonomically efficient loading as described below. In some embodiments, the hoist 750 is installed by the workers 722*a* and 722*b* as soon as the marine vessels 720*a* and 720*b* are positioned about the marine pile 714. In other embodiments, the hoist 750 is partially or fully installed by the workers 722*a* and 722*b* or other qualified personnel from the bridge 710 before the marine vessels 720*a* and 720*b* are launched.

FIGS. 16D to 16F show the worker 722*a* positioning the fiber-reinforced shell 732*a* with first and second edges and first and second ends about a first portion of the marine pile 714 by transferring the fiber-reinforced shell 732*a* from the marine vessel 720*a* to the base 752 such that the first end of the fiber-reinforced shell 732*a* faces toward and is coterminal with the second end of the base 752.

FIGS. 16D to 16F show the worker 722*b* positioning the fiber-reinforced shell 732*b* with first and second edges and first and second ends about a second portion of the marine pile 714 by transferring the fiber-reinforced shell 732*b* from the marine vessel 720*b* to the base 752 such that the first end of the fiber-reinforced shell 732*b* faces toward and is coterminal with the second end of the base 752, the first edge of the fiber-reinforced shell 732*a* is adjacent to the first edge of the fiber-reinforced shell 732*b* to provide a first inner seam and the second edge of the fiber-reinforced shell 732*a* is adjacent to the second edge of the fiber-reinforced shell 732*b* to provide a second inner seam.

FIG. 16F shows adhering the fiber-reinforced shells 732*a* and 732*b* together, thereby providing a first bonded shell pair for the inner reinforcement layer 738 that is complete and envelopes a portion of the marine pile 714. In some embodiments, the first edges of the fiber-reinforced shells 732*a* and 732*b* are bonded together by an adhesive at the first inner seam and the second edges of the fiber-reinforced shells 732*a* and 732*b* are bonded together by an adhesive at the second inner seam. In certain embodiments, the first ends of the fiber-reinforced shells 732*a* and 732*b* are bonded to the second end of the base 752 by an adhesive.

FIGS. 16G to 16I show the worker 722*a* positioning the fiber-reinforced shell 734*a* with first and second edges and first and second ends about a third portion of the marine pile 714 by transferring the fiber-reinforced shell 734*a* from the marine vessel 720*a* to the fiber-reinforced shell 732*a* such that the first end of the fiber-reinforced shell 734*a* faces toward and is coterminal with the second end of the fiber-reinforced shell 732*a*.

FIGS. 16G to 16I show the worker 722*b* positioning the fiber-reinforced shell 734*b* with first and second edges and first and second ends about a fourth portion of the marine pile 714 by transferring the fiber-reinforced shell 734*b* from the marine vessel 720*b* to the fiber-reinforced shell 732*b* such that the first end of the fiber-reinforced shell 734*b* faces toward and is coterminal with the second end of the fiber-reinforced shell 732*b*, the first edge of the fiber-reinforced shell 734*a* is adjacent to the first edge of the fiber-reinforced shell 734*b* to provide a third inner seam and the second edge of the fiber-reinforced shell 734*a* is adjacent to the second edge of the fiber-reinforced shell 734*b* to provide a fourth inner seam.

In some embodiments, the first and third inner seams are aligned and the second and fourth inner seams are aligned. In other embodiments, the first and third inner seams are offset, the second and fourth inner seams are offset and the first ends of the fiber-reinforced shells 734*a* and 734*b* are each coterminal with the second ends of the fiber-reinforced sheds 732*a* and 732*b*. In specific embodiments, the first and third inner seams are offset by less than 10% and the second and fourth inner seams are offset by less than 10%.

FIG. 16I shows adhering the fiber-reinforced shells 734*a* and 734*b* together, thereby providing a second bonded shell pair for the inner reinforcement layer 738 that is complete and envelopes a portion of the marine pile 714. In some embodiments, the first edges of the fiber-reinforced shells 734*a* and 734*b* are bonded together by an adhesive at the third inner seam and the second edges of the fiber-reinforced shells 734*a* and 734*b* are bonded together by an adhesive at the fourth inner seam. In certain embodiments, the first ends of the fiber-reinforced shells 734*a* and 734*b* are bonded to the second ends of the fiber-reinforced shells 732*a* and 732*b* by an adhesive.

FIGS. 16J to 16K show the worker 722*a* positioning the fiber-reinforced shell 742*a* with first and second edges and first and second ends about a first portion of the fiber-reinforced shells 732*a*, 732*b*, 734*a* and 734*b* as well as the first inner seam and a portion of the third inner seam by transferring the fiber-reinforced shell 742*a* from the marine vessel 720*a* to the base 752 such that the first end of the fiber-reinforced shell 742*a* faces toward and is coterminal with the second end of the base 752.

FIGS. 16J to 16K show the worker 722*b* positioning the fiber-reinforced shell 742*b* with first and second edges and first and second ends about a second portion of the fiber-reinforced shells 732*a*, 732*b*, 734*a* and 734*b* as well as the second inner seam and a portion of the fourth inner seam by transferring the fiber-reinforced shell 742*b* from the marine vessel 720*b* to the base 752 such that the first end of the fiber-reinforced shell 742*b* faces toward and is coterminal with the second end of the base 752, the first edge of the fiber-reinforced shell 742*a* is adjacent to the first edge of the fiber-reinforced shell 742*b* to provide a first outer seam and the second edge of the fiber-reinforced shell 742*a* is adjacent to the second edge of the fiber-reinforced shell 742*b* to provide a second outer seam.

FIG. 16K shows adhering the fiber-reinforced shells 742*a* and 742*b* together, thereby providing a first bonded shell pair for the outer reinforcement layer 748 that is complete and envelopes a portion of the inner reinforcement layer 738. Since the fiber-reinforced shells 742*a* and 742*b* have the first height they envelope not only the fiber-reinforced shells 732*a* and 732*b* in their entirety but also the lower half of the fiber-reinforced shells 734*a* and 734*b*. Likewise, the second ends of the fiber-reinforced shells 742*a* and 742*b* are offset relative to and protrude above the second ends of the fiber-reinforced shells 732*a* and 732*b*, and the second ends of the fiber-reinforced shells 724*a* and 724*b* are offset relative to and protrude above the second ends of the fiber-reinforced shells 742*a* and 742*b*, but the first ends of the fiber-reinforced shells 722*a*, 722*b*, 742*a* and 742*b* are aligned at the base 752.

In some embodiments, the first edges of the fiber-reinforced shells 742*a* and 742*b* are bonded together by an adhesive at the first outer seam and the second edges of the fiber-reinforced shells 742*a* and 742*b* are bonded together by an adhesive at the second outer seam. In certain embodiments, the first ends of the fiber-reinforced shells 742*a* and 742*b* are bonded to the second end of the base 752 by an adhesive, FIGS. 16L to 16M show the workers 722*a* and 722*b* continuing to stack the inner reinforcement layer 738 in the manner described above. The worker 722*a* positions the fiber-reinforced shell 736*a* with first and second edges and first and second ends about a fifth portion of the marine pile 714 by transferring the fiber-reinforced shell 736*a* from the marine vessel 720*a* to the fiber-reinforced shell 734*a* such that the first end of the fiber-reinforced shell 736*a* faces toward and is coterminal with the second end of the fiber-reinforced shell 734*a*. The worker 722*b* positions the fiber-reinforced shell 736*b* with first and second edges and first and second ends about a sixth portion of the marine pile 714 by transferring the fiber-reinforced shell 736*b* from the marine vessel 720*b* to the fiber-reinforced shell 734*b* such that the first end of the fiber-reinforced shell 736*b* faces toward and is coterminal with the second end of the fiber-reinforced shell 734*b*, the first edge of the fiber-reinforced shell 736*a* is adjacent to the first edge of the fiber-reinforced shell 736*b* to provide a fifth inner seam and the second edge of the fiber-reinforced shell 736*a* is adjacent to the second edge of the fiber-reinforced shell 736*b* to provide a sixth inner seam. The fiber-reinforced shells 736*a* and 736*b* are adhered together to provide a third bonded shell pair for the inner reinforcement layer 738 that is complete and envelopes a portion of the marine pile 714. The first edges of the fiber-reinforced shells 736*a* and 736*b* are bonded together by an adhesive at the fifth inner seam, the second edges of the fiber-reinforced shells 736*a* and 736*b* are bonded together by an adhesive at the sixth inner seam and the first ends of the fiber-reinforced shells 736*a* and 736*b* are bonded to the second ends of the fiber-reinforced shells 734*a* and 734*b* by an adhesive.

FIGS. 16N to 16O show the workers 722*a* and 722*b* continuing to stack the outer reinforcement layer 748 in the manner described above. However, before this occurs, the workers 722*a* and 722*b* incrementally lower the base 752 using the cables 754*a* and 754*b* so that the second ends of the fiber-reinforced shells 742*a* and 742*b* are located at the loading elevation. As a result, the fiber-reinforced shells 732*a*, 732*b*, 734*a*, 734*b*, 736*a*, 736*b*, 742*a* and 742*b* and the base 752 descend towards the seabed and the base 752 is submerged below the water line 716. At this stage, the fiber-reinforced shells 732*a*, 732*b*, 734*a*, 734*b*, 736*a*, 736*b*, 742*a* and 742*b* and the base 752 remain suspended by the cables 754*a* and 754*b* above the seabed and slidably coupled to the marine pile 714.

Thereafter, the worker 722*a* positions the fiber-reinforced shell 744*a* with first and second edges and first and second ends about a first portion of the fiber-reinforced shells 734*a*, 734*b*, 736*a* and 736*b* as well as portions of the third and fifth inner seams by transferring the fiber-reinforced shell 744*a* from the marine vessel 720*a* to the fiber-reinforced shell 742*a* such that the first end of the fiber-reinforced shell 744*a* faces toward and is coterminal with the second end of the fiber-reinforced shell 742*a*. The worker 722*b* positions the fiber-reinforced shell 744*b* with first and second edges and first and second ends about a second portion of the fiber-reinforced shells 734*a*, 734*b*, 736*a* and 736*b* as well as portions of the fourth and sixth inner seams by transferring the fiber-reinforced shell 744*b* from the marine vessel 720*b* to the fiber-reinforced shell 742*b* such that the first end of the fiber-reinforced shell 742*b* faces toward and is coterminal with the second end of the fiber-reinforced shell 744*b*, the first edge of the fiber-reinforced shell 744*a* is adjacent to the first edge of the fiber-reinforced shell 744*b* to provide a third outer seam and the second edge of the fiber-reinforced shell 744*a* is adjacent to the second edge of the fiber-reinforced shell 744*b* to provide a fourth outer seam. The fiber-reinforced shells 744*a* and 744*b* are adhered together to provide a second bonded shell pair for the outer reinforcement layer 748 that is complete and envelopes a portion of the inner reinforcement layer 738. The first edges of the fiber-reinforced shells 744*a* and 744*b* are bonded together by an adhesive at the third outer seam, the second edges of the fiber-reinforced shells 744*a* and 744*b* are bonded together by an adhesive at the fourth outer seam and the first ends of the fiber-reinforced shells 744*a* and 744*b* are bonded to the second ends of the fiber-reinforced shells 742*a* and 742*b* by an adhesive.

The method may include repeating the operations described in FIGS. 16L to 16O above until the inner and outer reinforcement layers 738 and 748 reach the desired depth below the water line 716. For example, the workers 722*a* and 722*b* may continue stacking the inner and outer reinforcement layers 738 and 748 by transferring the fiber-reinforced shells 730*a* and 730*b* from the marine vessels 720*a* and 720*b* to the underlying inner and outer reinforcement layers 738 and 748 on the base 752 and incrementally lowering the base 752 using the cables 754*a* and 754*b* in response to the stacking cycles. This enables the workers 722*a* and 722*b* to continue the stacking operations above the water line 716 in a rapid and efficient manner. The term "repeating", as used in this context, refers to stacking the fiber-reinforced sheds 730*a* and 730*b* on the immediately preceding fiber-reinforced shells 730*a* and 730*b* (rather than replacing them), and thus on the base 752 as well.

FIG. 16P shows the base 752 suspended by the cables 754*a* and 754*b* at a fixed depth below the water line 716 but above a mud line 756 that covers the seabed. The fiber-reinforced shells 742*a* and 742*b* in the outer reinforcement layer 748 cover the fiber-reinforced shells 732*a* and 732*b* in the inner reinforcement layer 738. At this stage, the workers 722*a* and 722*b* continue stacking the inner and outer reinforcement layers 738 and 748 above the water line 716.

FIG. 16Q shows the base 752 suspended by the cables 754*a* and 754*b* above the mud line 756 but closer to the seabed as the workers 722*a* and 722*b* continue stacking the inner and outer reinforcement layers 738 and 748 above the water line 716 and incrementally lowering the base 752 toward the seabed.

FIG. 16R shows the base 752 penetrating the mud line 756 and resting on the seabed. At this stage, the workers 722*a* and 722*b* stack the inner and outer reinforcement layers 738 and 748 about the marine pile 714 to the maximum extent permitted by the bridge 710.

FIG. 16S shows the base 752 resting on the seabed as the workers 722*a* and 722*b* detach the cables 754*a* and 754*b* from the base 752 and retract them from the water.

It will be appreciated that the inner and outer reinforcement layers 738 and 748 and the base 752 need not necessarily rest on the seabed when the stacking operation is complete. In some embodiments, the water line 716 is relatively close to the seabed and the base 752 is conveniently lowered to the seabed. In other embodiments, the water line 716 is far above the seabed and the base 752 is lowered to a predetermined depth below the water line 716 but above the seabed. In various other embodiments, the seabed presents an unreliable foundation and the base 752 is lowered to a predetermined depth below the water line 716 but above the seabed. In still other embodiments, the marine pile 714 presents visible damage only near the water line 716 and the base 752 is lowered only slightly below the water line 716 and far above the seabed. Likewise, the inner and outer reinforcement layers 738 and 748 can extend to or be spaced from the first and/or second ends of the marine pile 714.

FIG. 16T shows the marine vessels 720*a* and 720*b* with storage tanks 760*a* and 760*b* and pumps 762*a* and 762*b*. The storage tanks 760*a* and 760*b* contain a grout mixture 764 in a semi-liquid flowable state and the pumps 762*a* and 762*b* are operationally coupled to the storage tanks 760*a* and 760*b* respectively to deliver the grout mixture 764 in response to the workers 722*a* and 722*b* respectively as described below.

In some embodiments, the marine vessels 720*a* and 720*b* contain the fiber-reinforced shells 730*a* and 730*b* as well as the storage tanks 760*a* and 760*b* and the pumps 762*a* and 762*b*. In these embodiments, the storage tanks 760*a* and 760*b* and the pumps 762*a* and 762*b* are omitted from FIGS. 16A-16O, and any remaining fiber-reinforced shells 730*a* and 730*b* are omitted from FIGS. 16T-16X, for ease of depiction. In other embodiments, the workers 722*a* and 722*b* navigate the marine vessels 720*a* and 720*b* back to the launch site and return to the marine pile 714 in other marine vessels with the storage tanks 760*a* and 760*b* and the pumps 762*a* and 762*b*. In still other embodiments, the workers 722*a* and 722*b* navigate the marine vessels 720*a* and 720*b* back to the launch site and other workers navigate other marine vessels with the storage tanks 760*a* and 760*b* and the pumps 762*a* and 762*b* to the marine pile 714. In certain other embodiments, the marine vessel 720*a* (or another marine vessel) includes the storage tank 760*a* and the pump 762*a* but the storage tank 760*b* and the pump 762*b* are unnecessary or omitted, or vice-versa.

FIG. 16U shows the marine pile 714, the inner reinforcement layer 738 and the outer reinforcement layer 748 in cutaway view as the pump 762*b* operated by the worker 722*b* transfers the grout mixture 764 from the storage tank 760*b* through a tremie tube to an inner annular gap between the marine pile 714 and the inner reinforcement layer 738 that is bounded at the first end by the base 752 and open at the second end, and simultaneously, to an outer annular gap between the inner reinforcement layer 738 and the outer reinforcement layer 748 that is bounded at the first end by the base 752 and open at the second end. The grout mixture 764 may be any suitable product that is compatible with wet surfaces and adheres to the marine pile 714 (concrete) and the inner and outer reinforcement layers 738 and 748 (carbon fiber-reinforced polymer) once the grout sets and hardens. In certain embodiments, the grout mixture may be a polymeric, epoxy or cementitious product, or combinations thereof, which may be applied as a single mixture or as separate mixtures in any order at any location in the inner and outer annular gaps. In a specific embodiment, the grout mixture is Portland cement.

FIG. 16V shows the marine pile 714, the inner reinforcement layer 738 and the outer reinforcement layer 748 in cutaway view as the grout mixture 764 continues to fill the inner and outer annular gaps and rises above the water line 716.

FIG. 16W shows the marine pile 714, the inner reinforcement layer 738 and the outer reinforcement layer 748 in cutaway view as the grout mixture 764 fills the inner and outer annular gaps.

FIG. 16X shows the marine pile 714, the inner reinforcement layer 738 and the outer reinforcement layer 748 in enlarged cutaway view after the grout mixture 764 sets and hardens simultaneously in the inner and outer annular gaps to provide grout 766 that fills in the inner and outer annular gaps. The grout 766 in the inner annular gap contacts and extends between and mechanically couples the marine pile 714 and the inner reinforcement layer 738. Likewise, the grout 766 in the outer annular gap contacts and extends between and mechanically couples the inner and outer reinforcement layers 738 and 748. The marine pile 714 is now structurally reinforced and protected by the inner and outer reinforcement layers 738 and 748 and the grout 766.

In some embodiments, the workers 722*a* and 722*b* repeat these operations for the other marine piles that support the bridge 710 as general maintenance or safety precautions. In other embodiments, the marine pile 714 alone presents visible damage, such as a missing chunk due to boat collision, and the workers 722*a* and 722*b* navigate the marine vessels 720*a* and 720*b* back to the launch site after the marine pile 714 is repaired.

The present invention is additionally directed to a system for reinforcing a structural element 714 that is partially submerged and extends along an axis A between a structure 710 above a water line 716 and a seabed below the water line 715. In some embodiments, the system may comprise a first 720*a* and a second 720*b* marine vessel positioned about the structural element 714. Said marine vessels may be capable of transporting fiber-reinforced shells. The system may further comprise a first reinforcement layer 738 comprising an inner shell pair. The inner shell pair may comprise a first fiber-reinforced shell 732*a* having a first edge and a second edge and a second fiber-reinforced shell 732*b* having a first edge and a second edge. The first fiber-reinforced shell 732*a* may connect to the second fiber-reinforced shell at the first edges of each shell, creating a first inner seam, and at the second edges of each shell, creating a second inner seam. The first fiber-reinforced shell 732*a* may adhere to the second fiber-reinforced shell 732*b* at the first and second inner seams, and the first inner shell pair may envelop the structural element 714. The system may further comprise a second reinforcement layer 748 comprising a first outer shell pair. The outer shell pair may comprise a third fiber-reinforced shell 742*a* having a first edge and a second edge and a fourth fiber-reinforced shell 742*b* having a first edge and a second edge. The third fiber-reinforced shell 742*a* may connect to the fourth fiber-reinforced shell 742*b* at the first edges of each shell, creating a first outer seam, and at the second edges of each shell, creating a second outer seam. The third fiber-reinforced shell 742*a* may adhere to the fourth fiber-reinforced shell 742*b* at the first and second outer seams, the first outer shell pair may envelop the inner shell pair. The system may further comprise a base 752 enveloping the structural element 714, such that a first end of the base 752 faces the structure 710 and a second end of the base 752 faces the seabed. The system may further comprise a hoist 750 comprising a pulley system, a first 754*a* and a second 754*b* cable connected to the hoist 750 and suspending the base 752, and a first and a second grout.

In some embodiments of the system of the present invention, the first inner shell pair, the first outer shell pair, and the base 752 may be initially positioned above the water line 716. The first 732*a* and third 742*a* fiber-reinforced shells may be positioned about the structural element 714 from the first marine vessel, 720 and the second 732*b* and fourth 742*b* fiber-reinforced shells may be positioned about the structured element 714 from the second marine vessel 720*b*. The first inner shell pair and the first outer shell pair may be positioned adjacent to the first end of the base 752, and the hoist 750 may be actuated such that the first 754*a* and second 754*b* cables lower the base 752, the first inner shell pair, and the first outer shell pair towards the seabed. The first grout may be disposed between the first inner shell pair and the structural element 714 when the base 752 reaches the seabed, and the second grout may be disposed between the first outer shell pair and first inner shell pair when the base 752 reaches the seabed.

The present invention further provides a reinforced structural element 1 formed by the method described above. Typically, the reinforced structural element 1 has different physical properties than the structural element 2, such as an improved (e.g. an increased) loading capacity, structural efficiency, stiffness, compression strength, and/or shear strength, compared to the structural element. In another embodiment, for another purpose, the reinforced structural element may be protected against elements, corrosion, etc. without being stronger than the non-reinforced structural element. That is, the reinforcement of the present invention may be used as a protective layer to prevent damage, or as a reconstructive layer to repair damage.

The invention has been described in an illustrative manner, and it is to be understood that the terminology which has been used is intended to be in the nature of words of description rather than of limitation. Obviously, many modifications and variations of the present invention are possible in light of the above teachings. The invention may be practiced otherwise than as specifically described.

Likewise, it is also to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

Further, any ranges and subranges relied upon in describing various embodiments of the present invention independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present invention, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

As used herein, the term "about" refers to plus or minus 10% of the referenced number.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting essentially of" or "consisting of", and as such the written description requirement for claiming one or more embodiments of the present invention using the phrase "consisting essentially of" or "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. An apparatus (800) for assembling and lowering a sleeve structure (410) around a partially submerged structural element (402), the apparatus (800) comprising:

a. an upper unit (810), configured for fixation to the structural element (402), the upper unit (810) comprising:
   i. two or more upper perimeter components (812), configured to attach together so as to surround the structural element (402);
   ii. two or more anchors (814), each extending inwardly from the upper perimeter components (812) so as to fix the upper unit (810) to the structural element (402); and
   iii. two or more support brackets (816), each extending outward from the upper perimeter components (812);

b. two or more flexible support members (822), each extending downwardly from one of the support brackets (816); and c. a lower unit (830), configured to be suspended from the flexible support members (816), the lower unit (830) comprising:
   i. two or more lower perimeter components (832), configured to attach together so as to surround the structural element (402);
   ii. one or more releasable attachments (434) connecting two or more of the lower perimeter components (832), the releasable attachments (434) configured to be released from a distance;
   iii. two or more gap guides (838), each extending inwardly from the lower perimeter components (832) so as to maintain a gap between the lower perimeter components (832) and the structural element (402);

iv. two or more lower attachment points (842) for attachment of the lower perimeter components (832) to the flexible support members (822);

v. one or more sleeve structure supports (844), each extending inwardly or outwardly from the lower perimeter components (832);

wherein the lower unit (830) is configured to support the sleeve structure (410) as the sleeve structure (410) is assembled and lowered from the upper unit (810) by the flexible support members (822) and to release the lowered sleeve structure (410) upon release of the releasable attachments (834).

2. The apparatus of claim 1, wherein the flexible support members (822) comprise ropes, cables, or chains.

3. The apparatus of claim 1, wherein each releasable attachment (834) comprises an attachment pin (835) and two or more attachment barrels (836), each attachment barrel (836) affixed to an end of a lower perimeter component (832) such that lower perimeter components (832) may be attached by aligning their respective attachment barrels (836) and passing the attachment pin (835) through the aligned attachment barrels (836), and wherein the apparatus (800) additionally comprises a flexible release member (837) attached to each attachment pin (834) so as to enable release of the releasable attachments (834) via puling the one or more flexible release members (837).

4. The apparatus of claim 1, wherein the flexible support members (822) are configured to allow for recovery of the detached lower perimeter components (832) of the lower unit (830) after release of the releasable attachments (834).

5. The apparatus of claim 1, wherein the lower unit (830) comprises two or more rollers (840) positioned extending inwardly from the gap guides (838) so as to guide the lower unit (830) around the structural element (410).

* * * * *